US012235085B2

(12) United States Patent
Coryell et al.

(10) Patent No.: US 12,235,085 B2
(45) Date of Patent: Feb. 25, 2025

(54) SHOOTING TARGET THROWER

(71) Applicant: AOB Products Company, Columbia, MO (US)

(72) Inventors: Paul Coryell, Columbia, MO (US); Michael Lindsay, Columbia, MO (US); Michael Cottrell, Ashland, MO (US); James Tayon, Moberly, MO (US)

(73) Assignee: AOB Products Company, Columbia, MO (US)

( * ) Notice: Subject to any disclaimer, the term of this patent is extended or adjusted under 35 U.S.C. 154(b) by 0 days.

(21) Appl. No.: 18/484,969

(22) Filed: Oct. 11, 2023

(65) Prior Publication Data

US 2024/0044622 A1 Feb. 8, 2024

Related U.S. Application Data

(63) Continuation of application No. 18/095,997, filed on Jan. 11, 2023, now Pat. No. 11,885,599.

(60) Provisional application No. 63/267,396, filed on Feb. 1, 2022, provisional application No. 63/266,653, filed on Jan. 11, 2022.

(51) Int. Cl.
*F41J 9/22* (2006.01)
*F41J 9/30* (2006.01)

(52) U.S. Cl.
CPC .. *F41J 9/22* (2013.01); *F41J 9/30* (2013.01)

(58) Field of Classification Search
CPC . F41J 9/18; F41J 9/20; F41J 9/22; F41J 9/24; F41J 9/30
See application file for complete search history.

(56) References Cited

U.S. PATENT DOCUMENTS 252,230 A * 1/1882 Ligowsky ..... F41J 9/20 124/36
806,663 A * 12/1905 Hardy ..... F41J 9/20 248/185.1
829,963 A * 9/1906 Haughawout ..... F41J 9/20 248/183.3

(Continued)

FOREIGN PATENT DOCUMENTS

CN 204240867 U 4/2014
CN 217442401 U 9/2022

(Continued)

OTHER PUBLICATIONS

Automatic Clay Pigeon Thrower, https://www.youtube.com/watch?v=WLN3qbPA_Rc, uploaded 2016, by BYUIdahoMechatronics.

(Continued)

*Primary Examiner* — John A Ricci
(74) *Attorney, Agent, or Firm* — Stinson LLP

(57) ABSTRACT

A shooting target thrower for throwing a shooting target includes a throwing arm rotatable about a throwing axis to throw the shooting target. A throwing spring is operatively coupled to the throwing arm and rotates the throwing arm to throw the shooting target. A drive train is operatively coupled to the throwing arm and includes a charge pedal and a fire pedal. The charge pedal rotates the throwing arm toward a cocked position. The fire pedal releases the throwing arm to rotate, under a force of the throwing spring, from the cocked position to throw the shooting target.

14 Claims, 37 Drawing Sheets

(56) References Cited

U.S. PATENT DOCUMENTS

| | | | | | |
|---|---|---|---|---|---|
| 3,601,112 | A * | 8/1971 | Dale | F41J 9/20 | 124/80 |
| 3,924,600 | A * | 12/1975 | Luebkeman | F41J 9/22 | 124/36 |
| 3,971,357 | A | 7/1976 | LaPorte et al. | | |
| 4,014,310 | A | 3/1977 | LaPorte et al. | | |
| 4,699,116 | A | 10/1987 | Freeland et al. | | |
| 4,831,996 | A * | 5/1989 | Cero | F41J 9/24 | 74/2 |
| 5,427,380 | A | 6/1995 | Hazard et al. | | |
| 5,470,078 | A | 11/1995 | Conlan | | |
| 5,605,139 | A | 2/1997 | Orwoll | | |
| 5,704,341 | A | 1/1998 | Ritzenthaler | | |
| 6,062,207 | A * | 5/2000 | Underhill | F41J 9/20 | 124/8 |
| 7,263,986 | B2 * | 9/2007 | Lovell | F41J 9/30 | 124/9 |
| 10,088,282 | B2 | 10/2018 | LaPorte et al. | | |
| 10,458,760 | B1 | 10/2019 | Liu | | |
| 10,690,458 | B2 * | 6/2020 | Laporte | F41J 9/30 | |
| 10,746,513 | B1 * | 8/2020 | Liu | F41J 9/24 | |
| 11,077,353 | B1 | 8/2021 | Kamstra et al. | | |
| 11,441,879 | B1 | 9/2022 | Dunning et al. | | |
| 11,920,908 | B2 * | 3/2024 | Arnold | F41J 9/22 | |
| 2007/0023022 | A1 * | 2/2007 | Lentz | F41J 9/22 | 124/8 |
| 2022/0412703 | A1 | 12/2022 | Dunning et al. | | |

FOREIGN PATENT DOCUMENTS

| | | | |
|---|---|---|---|
| KR | 20130025779 | A | 3/2013 |
| WO | 2010149993 | A2 | 12/2010 |

OTHER PUBLICATIONS

DIY Homemade Sporting Clay Rabbit Thrower Trap First Test, https://youtube.com/watch?v=FaZwaSKjz7w, uploaded Apr. 2022, by Donnie D.

Homemade Air Skeet Thrower, https://www.youtube.com/watch?v=Ct7IEUT_pl8, uploaded 2010, by Grevy 132.

Homemade Clay Pigeon Thrower, https://www.youtube.com/watch?v=JepWolrT9nc, uploaded 2023, by Meal Team Six.

The Flurry Launcher, https://www.youtume.com/watch?v=SyyhNF202W8, uploaded 2012, by Fieldsports Channel.

Champion Traps & Targets, Standard Hand Thrower, Catalog Description, downloaded Apr. 17, 2023, www.championtarget.com/clays-and-throwers/manual-and-stationary/standard-hand-thrower/CH-40915.html, 2 pages.

Allen Company, Claymaster Sporting Clay Target Thrower, Amazon Product Description, downloaded Apr. 17, 2023, www.amazon.com, 6 pages.

Atlas Trap Company, AT 400, Safe Operating Manual, Not Dated, downloaded Apr. 17, 2023, www.atlastraps.com, 6 pages.

Atlas Trap Company, ATA AT-400 Commercial Series, Catalog Description, downloaded Apr. 17, 2023, htpps://www.atlastraps.com/ATA-AT-400--Commercial-Series_p_46.html, 2 pages.

Atlas Trap Company, Model: HARE, Safe Operating Manual, Not Dated, downloaded Apr. 17, 2023, www.atlastraps.com, 8 pages.

Atlas Trap Company, Hare:Rabbit, Catalog Description, downloaded Apr. 17, 2023, htpps://www.atlastraps.com/Hare-Rabbit-_p_120.html, 3 pages.

Atlas Trap Company, Rabbit Models Trap Machines, Catalog Description, downloaded Apr. 17, 2023, htpps://www.howelltraps.com/atlas-rabbit-clay-target-throwing-trap-machines.html, 3 pages.

Birchwood Casey, WingOne Ultimate Handheld Clay Target Thrower, Amazon Product Description, downloaded Apr. 17, 2023, https://www.amazon.com/Birchwood-Casey-49301-Handlheld-Thrower-Right/dp/B07BS2BPFF/ref=sr_1_6?crid=2MRNEBEVUOQPN&keywords_clay_thrower . . . , 9 pages.

Caldwell Clay Launcher, Model 505501, Catalog Description, downloaded Apr. 17, 2023, https://www.zoro.com/caldwell_clay_launcher-505501/i/G000911389/?utm_source=google&utm_medium=surfaces&utm_campaign=shopping . . . , 6 pages.

Champion Traps & Targets, Easybird Auto-Feed 6_Packer, Instruction Manual, Part Nos. 40911 and 40912, Not Dated, downloaded Apr. 17, 2023, www.championtarget.com, 28 pages.

Champion Traps & Targets, Flightmaster Jr., Trap Owner's Instruction Manual, Part No. 40240, Not Dated, downloaded Apr. 17, 2023, www.championtarget.com, 16 pages.

Champion Traps & Targets, High Fly Target Thrower, Assembly and Operating Instructions, Part No. 40901, Not Dated, downloaded Apr. 17, 2023, www.championtarget.com, 16 pages.

Champion Traps & Targets, High Fly Target Thrower, Part No. 40901, Catalog Description, downloaded Apr. 17, 2023, www.championtarget.com/clays-and-throwers/manual-and-stationary/high-fly-string-release-manual-trap/CH-40901.html, 3 pages.

Champion Traps & Targets, Matchbird Trap (Double & Single Versions), Owner's/Operator's Manual, Parts and Assembly Instructions, Part Nos. 40904 and 40907, Not Dated, downloaded Apr. 17, 2023, www.championtarget.com, 24 pages.

Champion Traps & Targets, Skybird Trap, Owner's/Operator's Manual, Parts and Assembly Instructions, Part No. 40903, Not Dated, downloaded Apr. 17, 2023, www.championtarget.com, 28 pages.

Champion Traps & Targets, Skybird Tripod Mount Trap, Owner's/Operator's Manual, Parts and Assembly Instructions, Part No. 40906, Not Dated, downloaded Apr. 17, 2023, www.championtarget.com, 24 pages.

Champion Traps & Targets, Skybird 3/4 Cock Trap Tripod Mount Trap, Part No. 40906, Catalog Description, downloaded Apr. 17, 2023, www.championtarget.com/clays-and-throwers/manual-and-stationary/skybird-3%2F4-cock-trap-with-tri-pod-stand/CH-40906.html, 3 pages.

Champion Traps & Targets, Wheelybird 2.0 Auto-Feed Trap, Instruction Manual, Part No. 40925, Not Dated, downloaded Apr. 17, 2023, www.championtarget.com, 57 pages.

Champion Traps & Targets, Wheelybird 2.0 Auto-Feed Trap, Catalog Description, Part No. 40925, downloaded Apr. 17, 2023, https://www.championtarget.com/wheelybird-auto-feed-trap-2.0/CH-40925.html, 5 pages.

Do-All Outdoors, Auto Traps, Catalog Description, downloaded Apr. 17, 2023, https://www.doalloutdoors.com/collections/auto-traps, 4 pages.

Do-All Outdoors, Backyard 3/4 Cock Single Trap Thrower, Model BY56, Operating Manual, Not Dated, downloaded Apr. 17, 2023, www.doalloutdoors.com, 4 pages.

Do-All Outdoors, Clay Cannon Clay Pigeon Handheld Skeet Clay Pigeon Thrower, Amazon Product Description, downloaded Apr. 17, 2023, https://www.amazon.com/Clay-Cannon/dp/B085NX9LZG, 7 pages.

Do-All Outdoors, Clayhawk Full Cock, Model CH300, Operating Manual, Not Dated, downloaded Apr. 17, 2023, www.doalloutdoors.com, 4 pages.

Do-All Outdoors, Double Eagle Auto Trap, Model DE2, Operating Manual, Not Dated, downloaded Apr. 17, 2023, www.doalloutdoors.com, 7 pages.

Do-All Outdoors, Double Head Full Cock Trap, Model DT500, Operating Manual, Not Dated, downloaded Apr. 17, 2023, www.doalloutdoors.com, 4 pages.

Do-All Outdoors, Firefly Auto Trap, Model FF550, Operating Manual, Not Dated, downloaded Apr. 17, 2023, www.doalloutdoors.com, 6 pages.

Do-All Outdoors, Fowl Play Auto Trap, Model FP25, Operating Manual, Not Dated downloaded Apr. 17, 2023, www.doalloutdoors.com, 6 pages.

Do-All Outdoors, The Competitor, Model CT101, Operating Manual, Not Dated, downloaded Apr. 17, 2023, www.doalloutdoors.com, 4 pages.

Do-All Outdoors, The Raven, Model RAV1, Operating Manual, Not Dated, downloaded Apr. 17, 2023, www.doalloutdoors.com, 4 pages.

(56) References Cited

OTHER PUBLICATIONS

Do-All Outdoors, USA Clay Auto Trap, Model USAAT20, Operating Manual, Not Dated, downloaded Apr. 17, 2023, www.doalloutdoors.com, 6 pages.
FERUS Outdoors, Model 21210, 21211 XT 210 3/4 Collapsible Trap Thrower Operators Manual, Not Dated, downloaded Apr. 17, 2023 , www.ferusoutdoors.com, 28 pages.
FERUS Outdoors, XT 210 3/4 Collapsible Trap Thrower, Amazon Product Description, downloaded Apr. 17, 2023 , https://www.amazon.com/Ferus-Outdoors-Clay-Thrower-Collapsible/dp/B0B94M8KMQ/ref=sr_1_12?crid=2N39QATLWWKV0&keywords=clay+pigeon . . . , 7 pages.
FlurryLauncher, Simulated Game Shooting, Operator Instruction Manual, Not Dated, downloaded Apr. 17, 2023 , www.flurrylauncher.com, 2 pages.
GoSports Outdoors, Catapult-Handheld Clay Pigeon Thrower, Model GSO-CLAYTOSS-2, Amazon Product Description, Downloaded Apr. 17, 2023, www.amazon.com, 7 pages.
MEC Outdoors, Trap & Skeet Series, Catalog Descriptions, Not Dated, downloaded Apr. 17, 2023, https://www.mecoutdoors.com/trap-and-skeet-series, 3 pages.
Old Vintage Cast Iron Western Trap/Skeet Shooting Clay Pgeon Thrower, K-BID Online Auctions, Online Description, Lot #164, downloaded Apr. 17, 2023, https://www.k-bid/com/auction/34277/item/164, 4 pages.
Promatic, ISSF, Operating Instructions Pigeon-Clay Target Launcher, Version 1.4, Jun. 2022, downloaded Apr. 17, 2023, Promatic International Ltd., www.promatic.co.uk, 12 pages.
Promatic, ISSF, Routine Maintenance Pigeon-Clay Target Launcher, Version 1, Mar. 2018, downloaded Apr. 17, 2023, Promatic International Ltd., www.promatic.co.uk, 8 pages.
Promatic, ISSF, Promatic Pigeon, Catalog Description, downloaded Apr. 17, 2023, Promatic International Ltd., https://promatic.co.uk/products/promatic-pigeon, 2 pages.
Promatic, ISSF, Operating Instructions Super Hawk—Clay Target Launcher, Version 2.1, Nov. 2021, downloaded Apr. 17, 2023, Promatic International Ltd., www.promatic.co.uk, 20 pages.
Promatic, ISSF, Operating Instructions Wobble Units—Merlin & Hobby, Version 1.3, Dec. 2022, downloaded Apr. 17, 2023, Promatic International Ltd., www.promatic.co.uk, 20 pages.
Promatic, ISSF, Operating Instructions Wobble Units—Super Hawk, Version 1.6, Mar. 2019, downloaded Apr. 17, 2023, Promatic International Ltd., www.promatic.co.uk, 20 pages.
Rogers Sporting Goods, Workin' Man Trap Thrower, Catalog Description, downloaded Apr. 17, 2023, https://rogerssportinggoods.com/rogers-workin-man-trap-thrower, 4 pages.
Sure Throw, Clay Target Throwers for Skeet Shotgun Shooting, Not Dated, downloaded Apr. 17, 2023, https://surethrow.com, 5 pages.
Trap Thrower, Vintage Western Hand Trap/Clay Pigeon Thrower, Item Specifications, EBAY, downloaded Apr. 17, 2023, https://www.ebay.com/itm/165762092251?hash=item269830ccdb:g:BcUAAOSwkcFb19zp, 4 pages.
TRIUS Traps Instruction Manual, #10571, Rev. 0209, www.triustraps.com, Not Dated, downloaded Apr. 17, 2023, https://www.manuals/trius/trap-master/manual, 12 pages.
Vintage Remington Automatic Hand Trap Clay Pigeon Launcher c. 1950s-1960s, Item Specifications, EBAY, downloaded Apr. 17, 2023, https//www.ebay.com/itm/323762278328?_ul=IL, 3 pages.
Western Retro, Trouble Shooting, Target Flight Adjustment, and Maintenance Manual, Western Self Loading Skeet Trap, Model V1574A, Not Dated, downloaded Apr. 17, 2023, http://westernretro.net, 28 pages.

* cited by examiner

SHOOTING TARGET THROWER

CROSS-REFERENCE TO RELATED APPLICATIONS

This application is a continuation of U.S. Nonprovisional patent application Ser. No. 18/095,997, filed Jan. 11, 2023, which claims priority to U.S. Provisional Patent Application No. 63/267,396, filed Feb. 1, 2022, and to U.S. Provisional Patent Application No. 63/266,653, filed Jan. 11, 2022, the entireties of which are hereby incorporated by reference.

FIELD

The present disclosure generally relates to shooting target throwers for throwing shooting targets, and more particularly to manually operated shooting target throwers.

BACKGROUND

Shooting target throwers throw shooting targets, often called clays or clay pigeons, into the air to be shot by a firearm, such as a shotgun.

SUMMARY

In one aspect, a shooting target thrower for throwing a shooting target comprises a frame and a throwing arm supported by the frame and rotatable about a throwing axis. The throwing arm is rotatable to a cocked position and a thrown position, the throwing arm is configured to throw the shooting target as the throwing arm rotates about the throwing axis from the cocked position toward the thrown position. A throwing spring is operatively coupled to the throwing arm. The throwing spring is arranged to rotate the throwing arm from the cocked position toward the thrown position to throw the shooting target. A drive train is operatively coupled to the throwing arm. The drive train includes a charge pedal configured to rotate the throwing arm from the thrown position to the cocked position and a fire pedal configured to permit the throwing arm to rotate, under a force of the throwing spring, from the cocked position toward the thrown position to throw the shooting target.

In another aspect, a shooting target thrower for throwing a shooting target comprises a frame and a throwing arm supported by the frame and rotatable about a throwing axis. The throwing arm is rotatable to a cocked position and a thrown position. The throwing arm is configured to throw the shooting target as the throwing arm rotates about the throwing axis from the cocked position toward the thrown position. A throwing spring is operatively coupled to the throwing arm. The throwing spring is configured to rotate the throwing arm from the cocked position toward the thrown position to throw the shooting target. A drive train is operatively coupled to the throwing arm. The drive train includes a charge pedal configured to be operated by a foot of a user to rotate the throwing arm from the thrown position to the cocked position and to charge the throwing spring.

In another aspect, a clay shooting target thrower for throwing a clay shooting target comprises a frame and a throwing arm supported by the frame and rotatable about a throwing axis. The throwing arm is rotatable to a cocked position and a thrown position. The throwing arm is configured to throw the clay shooting target as the throwing arm rotates about the throwing axis from the cocked position toward the thrown position. A throwing spring is operatively coupled to the throwing arm. The throwing spring is arranged to rotate the throwing arm from the cocked position toward the thrown position to throw the shooting target; a charge pedal supported by the frame and configured to be operated by a foot of a user to rotate the throwing arm from the thrown position toward the cocked position. A fire pedal is supported by the frame and is configured to be movable by the foot of the user to permit the throwing arm to rotate, under a force of the throwing spring, from the cocked position toward the thrown position to throw the shooting target. A hopper is configured to be supported by the frame to store a plurality of shooting targets to be fed to the throwing arm. A target feeder is configured to feed the plurality of shooting targets, one at a time, to the throwing arm.

In another aspect, a shooting target thrower for throwing a shooting target comprises a frame and a throwing arm supported by the frame and rotatable about a throwing axis in a first direction. The throwing arm is configured to throw the shooting target as the throwing arm rotates about the throwing axis in the first direction. The throwing arm includes an engagement surface arranged to engage a side of the shooting target to impart force to the side of the shooting target to throw the shooting target from the throwing arm. A throwing spring is operatively coupled to the throwing arm. The throwing spring is configured to rotate the throwing arm in the first direction to throw the shooting target. A target feeder is configured to feed the shooting target to the throwing arm. A throwing arm stop is arranged to engage the throwing arm to stop movement of the throwing arm about the throwing axis in the first direction before the engagement surface engages the side of the shooting target.

In another aspect, a shooting target thrower for throwing a shooting target comprises a frame and a throwing arm supported by the frame and rotatable about a throwing axis. The throwing arm is rotatable to a cocked position and a thrown position. The throwing arm is configured to throw the shooting target as the throwing arm rotates about the throwing axis from the cocked position toward the thrown position. A throwing spring is operatively coupled to the throwing arm. The throwing spring is arranged to rotate the throwing arm from the cocked position toward the thrown position to throw the shooting target. A charge pedal is movable through a charging cycle. The charge pedal is movable in a charging stroke of the charging cycle to move the throwing arm toward the cocked position. A fire mode selector is moveable between a fire position and a non-fire position to change between a fire mode in which the charge pedal is operable to release the throwing arm to rotate, under force of the throwing spring, from the cocked position toward the thrown position to throw the shooting target and a non-fire mode in which the charge pedal is not operable to release the throwing arm to rotate, under force of the throwing spring, from the cocked position toward the thrown position to throw the shooting target.

In another aspect, a shooting target thrower for throwing a shooting target comprises a frame and a throwing arm supported by the frame and rotatable about a throwing axis. The throwing arm is rotatable to a cocked position and a thrown position. The throwing arm is configured to throw the shooting target as the throwing arm rotates about the throwing axis from the cocked position toward the thrown position. A throwing spring is operatively coupled to the throwing arm. The throwing spring is configured to rotate the throwing arm from the cocked position toward the thrown position to throw the shooting target. A force imparted by the throwing spring to the throwing arm varies as the throwing arm rotates about the throwing axis. A ratchet is operatively coupled to the throwing arm and configured to permit the throwing arm to rotate in one direction about the throwing axis. The ratchet is configured to hold the throwing arm in the thrown position after the throwing arm throws the shooting target. A force imparted by the throwing spring on the throwing arm when the throwing arm is in the thrown position is greater than a lowest amount of force imparted by the throwing spring on the throwing arm.

In another aspect, a shooting target thrower for throwing a shooting target of a plurality of shooting targets comprises a frame and a throwing arm supported by the frame and rotatable about a throwing axis in a first direction. The throwing arm is rotatable to a cocked position. The throwing arm is configured to throw the shooting target as the throwing arm rotates about the throwing axis in the first direction from the cocked position. The throwing arm includes an engagement surface arranged to engage a side of the shooting target to impart force to the side of the shooting target to throw the shooting target from the throwing arm. A throwing spring is operatively coupled to the throwing arm. The throwing spring is configured to rotate the throwing arm in the first direction from the cocked position to throw the shooting target. A charge pedal is operatively coupled to the throwing arm and configured to rotate the throwing arm toward the cocked position when the charge pedal is manually actuated by a user. A hopper is configured to store the plurality of shooting targets. A target feeder is configured to feed the plurality of shooting targets to the throwing arm one at a time. The target feeder includes a first brush segment and a second brush segment. The first brush segment is arranged to bring the shooting target into engagement with the engagement surface of the throwing arm and the second brush segment is arranged to set a radial distance of the shooting target from the throwing axis.

In another aspect, a shooting target thrower for throwing a shooting target of a plurality of shooting targets comprises a frame and a central shaft supported by the frame. The central shaft defines and is rotatable about a throwing axis. A throwing arm is supported by the central shaft and rotatable with the central shaft about the throwing axis in a first direction. The throwing arm is rotatable to a cocked position. The throwing arm is configured to throw the shooting target as the throwing arm rotates about the throwing axis in the first direction from the cocked position. A throwing spring is operatively coupled to the throwing arm. The throwing spring is configured to rotate the throwing arm in the first direction from the cocked position to throw the shooting target. A hopper is configured to store the plurality of shooting targets. A target feeder is configured to feed the plurality of shooting targets to the throwing arm one at a time. The target feeder includes a movable feed door arranged to release the shooting target toward the throwing arm and a movable feed foot for retaining the plurality of shooting targets. The feed foot is disposed adjacent a first end of the feed door and the central shaft is disposed adjacent an opposite second end of the feed door.

Other objects and features of the present disclosure will be in part apparent and in part pointed out herein.

BRIEF DESCRIPTION OF THE DRAWINGS

Corresponding reference numbers indicate corresponding parts throughout the drawings.

DETAILED DESCRIPTION

The present disclosure is directed to shooting target throwers for throwing shooting targets T (e.g., clay shooting targets), commonly referred to as clay pigeons, clay targets, or simply clays, into the air to be shot by a firearm, such as a shotgun. The shooting target throwers of the present disclosure are non-motorized and are configured to be operated entirely through manual input by an operator or user, such as by using foot pedals. It is understood and appreciated that aspects of the shooting target throwers of the present disclosure can be implemented in other types of target throwers (e.g., motorized target throwers, hand held target throwers, etc.) without departing from the scope of the present disclosure.

Figure 1:
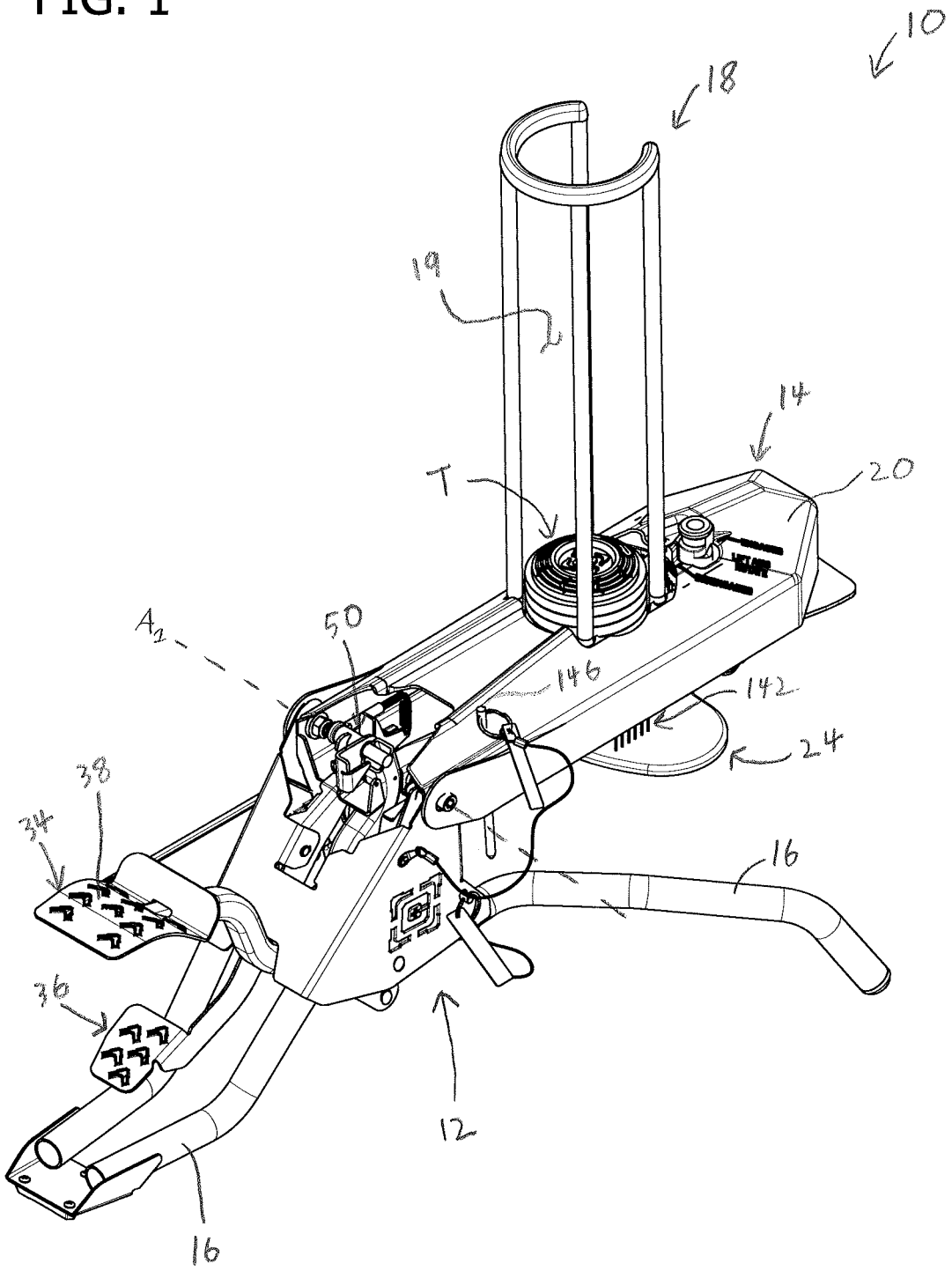
FIG. 1 is a perspective of a shooting target thrower according to one embodiment of the present disclosure.
Figure 2:
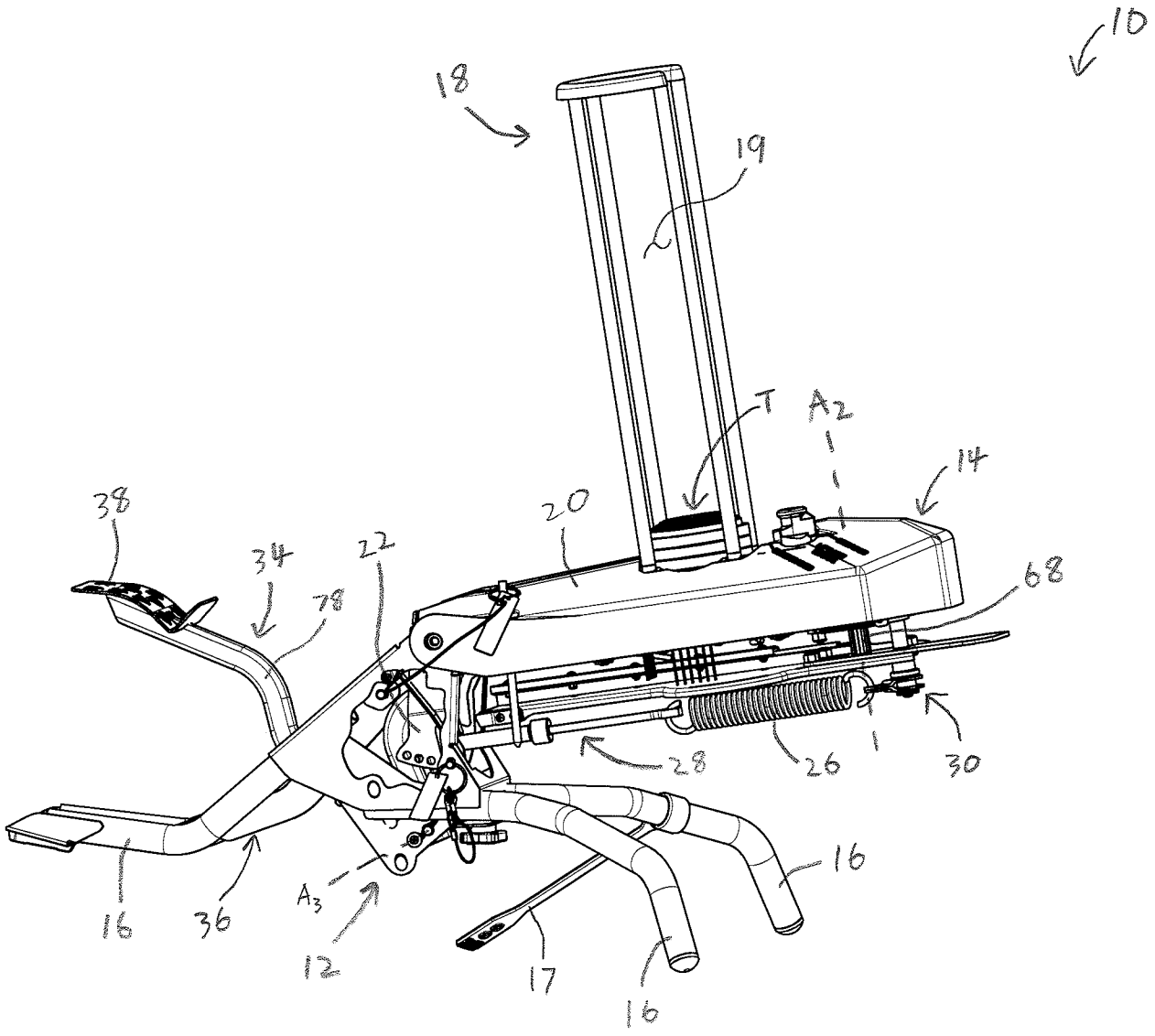
FIG. 2 is another perspective of the shooting target thrower, with portions of the shooting target thrower cut away to show interior details.
Figure 3:
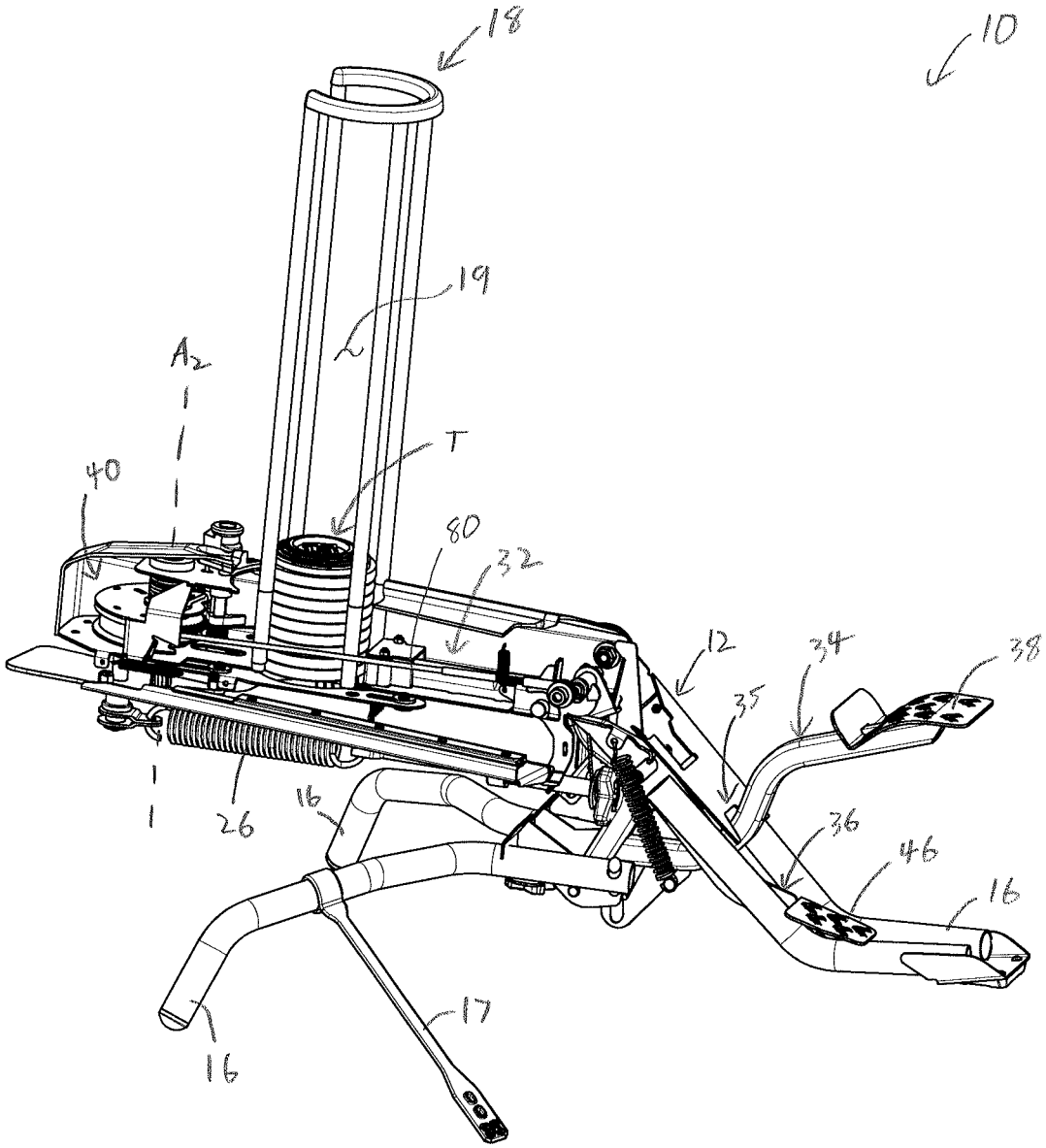
FIG. 3 is another perspective of the shooting target thrower, with portions of the shooting target thrower hidden from view or cut away to show interior details.

Referring to the figures, one embodiment of a shooting target thrower according to the present disclosure is generally indicated at reference numeral 10. As shown in FIG. 1, the target thrower 10 includes a frame 12 that supports a head 14. The frame 12 includes a plurality of legs 16 arranged to rest on a support surface, such as a floor, throwing pad, ground, etc. to support the target thrower 10. In one embodiment, the legs 16 are each pivotably connected to the rest of the frame so that the legs can be moved from a deployed position (as illustrated) to a collapsed, stowed position (not shown) for easy storage and transport. The target thrower 10 may include a strap 17, such as an elastic strap, for securing the legs 16 in the stowed position. The target thrower 10 also includes a hopper 18 for storing and holding a plurality of targets T. The hopper 18 includes an interior 19 sized and shaped to receive the plurality of targets T. In the illustrated embodiment, the hopper 18 stores and holds the targets T in a stack such that the targets are stacked one on top of the other. The targets T are fed from the bottom of the stack to a throwing mechanism of the target thrower 10.

The head 14 includes a housing having a shroud or cover 20 covering and protecting internal components of the target thrower. The head 14 is mounted to the frame 12. Desirably, the head 14 is pivotably attached to the frame 12. This allows the angle (e.g., lunch angle) relative to the horizontal (e.g., a horizontal plane) the targets T are thrown by the throwing mechanism to be changed as desired by the user. In the illustrated embodiment, the head 14 is pivotable about a head axis $A_1$ (FIG. 1). The head 14 includes an adjustment bracket 22 having a plurality of openings. As illustrated, the adjustment bracket 22 has five openings, corresponding to five different throwing angles generally ranging from approximately parallel to the horizontal to approximately 45 degrees relative to the horizontal. The target thrower 10 includes a retainer 24 (specifically, a retaining pin) for securing the head 14 relative to the frame 12. The retaining pin 24 extending through an opening in the frame 12 and into one of the openings of the adjustment bracket 22 to secure the head 14 relative to the frame 12 at the desired throwing angle. To adjust the throwing angle, the retaining pin 24 is removed, the head 14 is manually pivoted up or down by the user until the opening for the desired angle aligns with the opening in the frame 12, and then the retaining pin is reinserted to secure the head at the chosen angle.

Figure 7A:
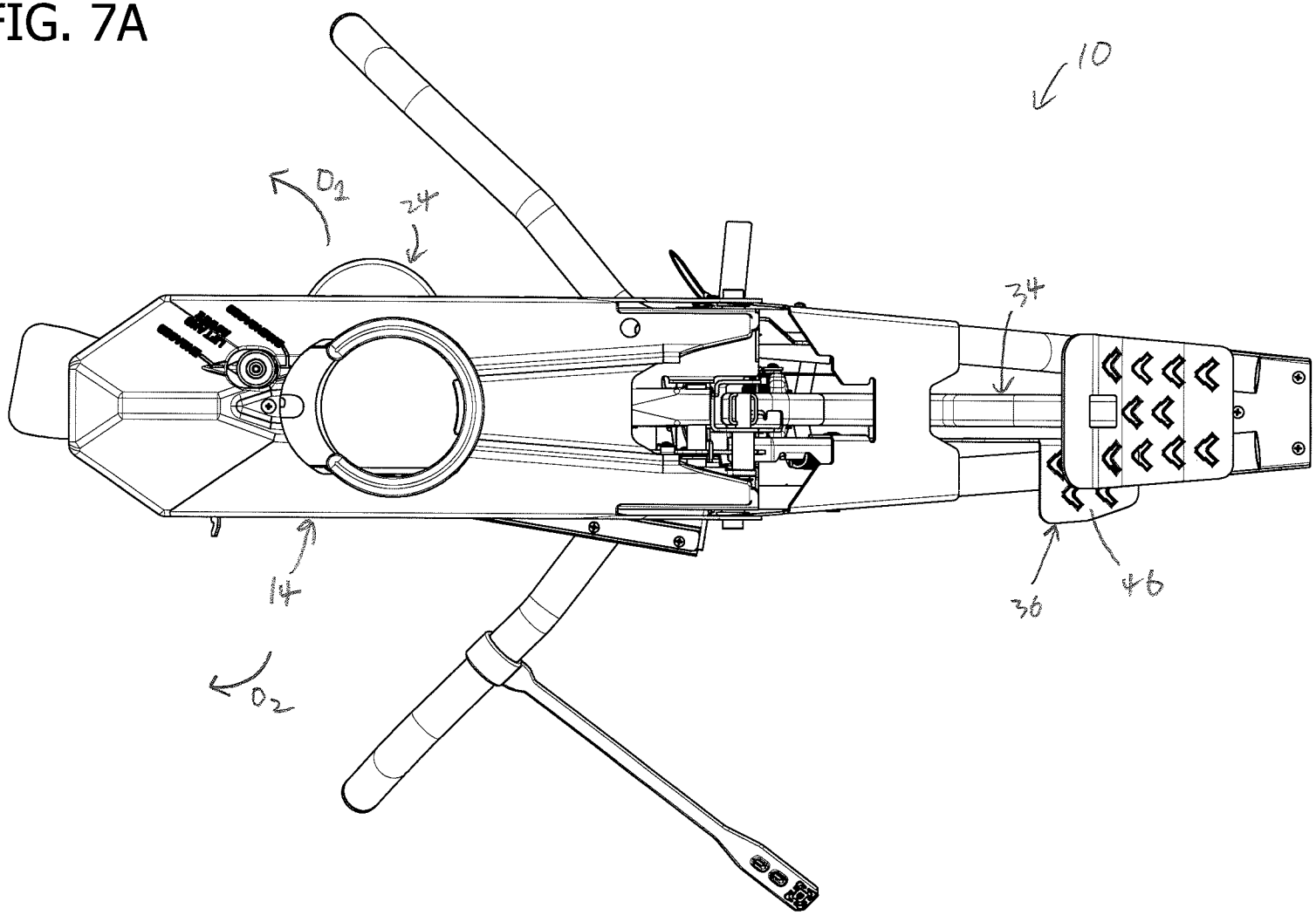
FIG. 7A is a top view of the shooting target thrower, with a throwing arm in a cocked position.
Figure 7B:
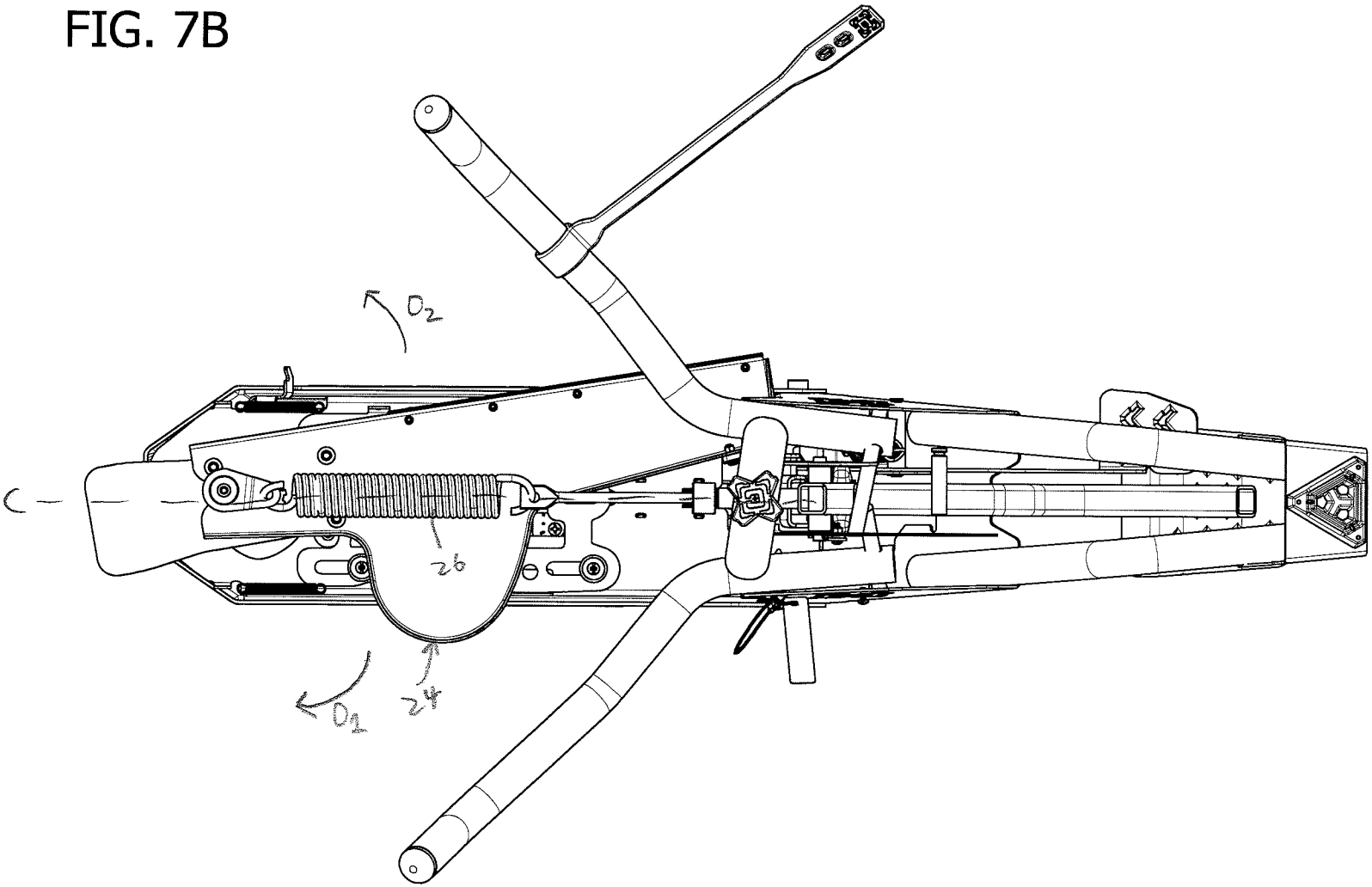
FIG. 7B is a bottom view of the shooting target thrower, with the throwing arm in the cocked position.
Figure 8:
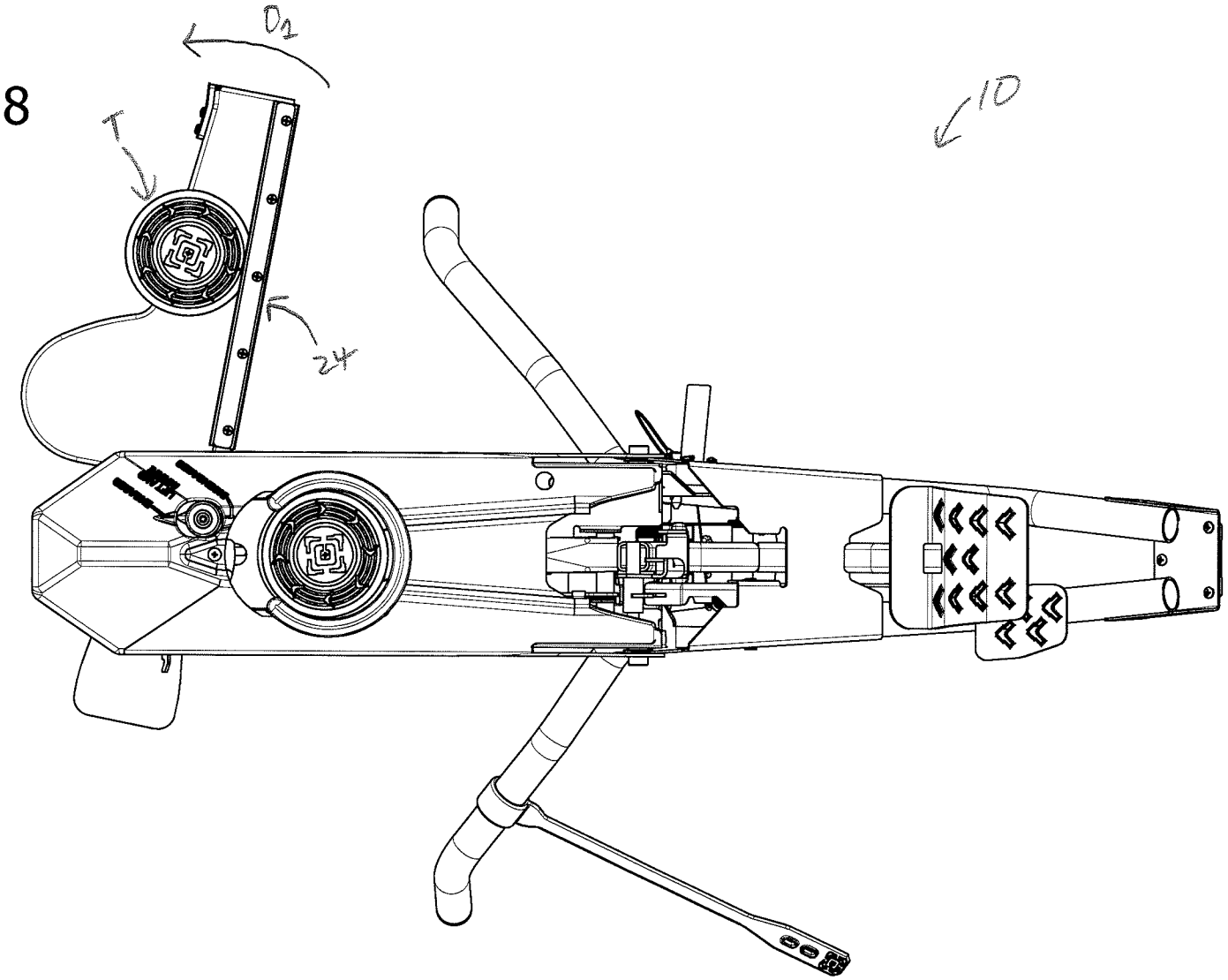
FIG. 8 is a top view of the shooting target thrower, with the throwing arm throwing a target.
Figure 9A:
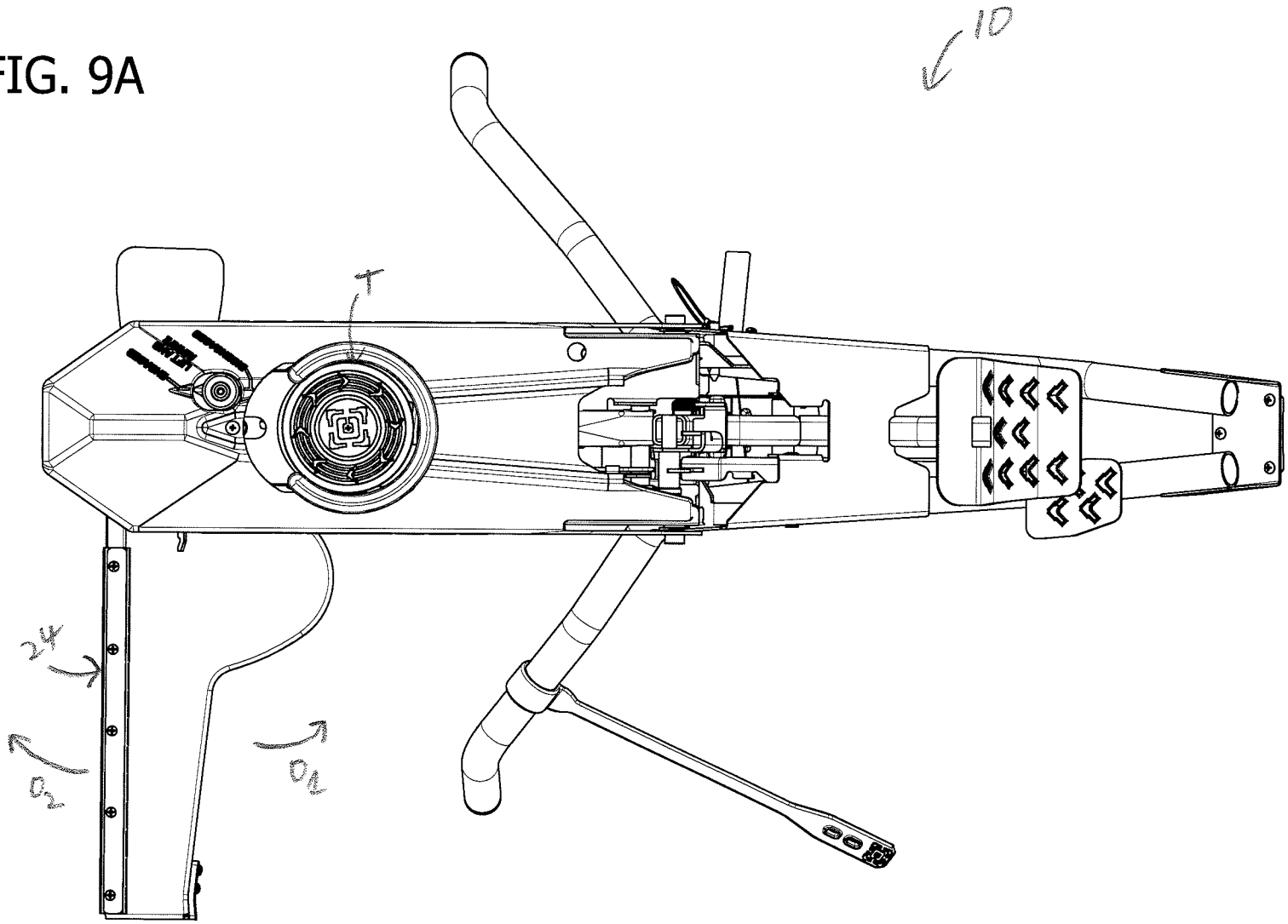
FIG. 9A is a top view of the shooting target thrower, with the throwing arm in a thrown position.
Figure 9B:
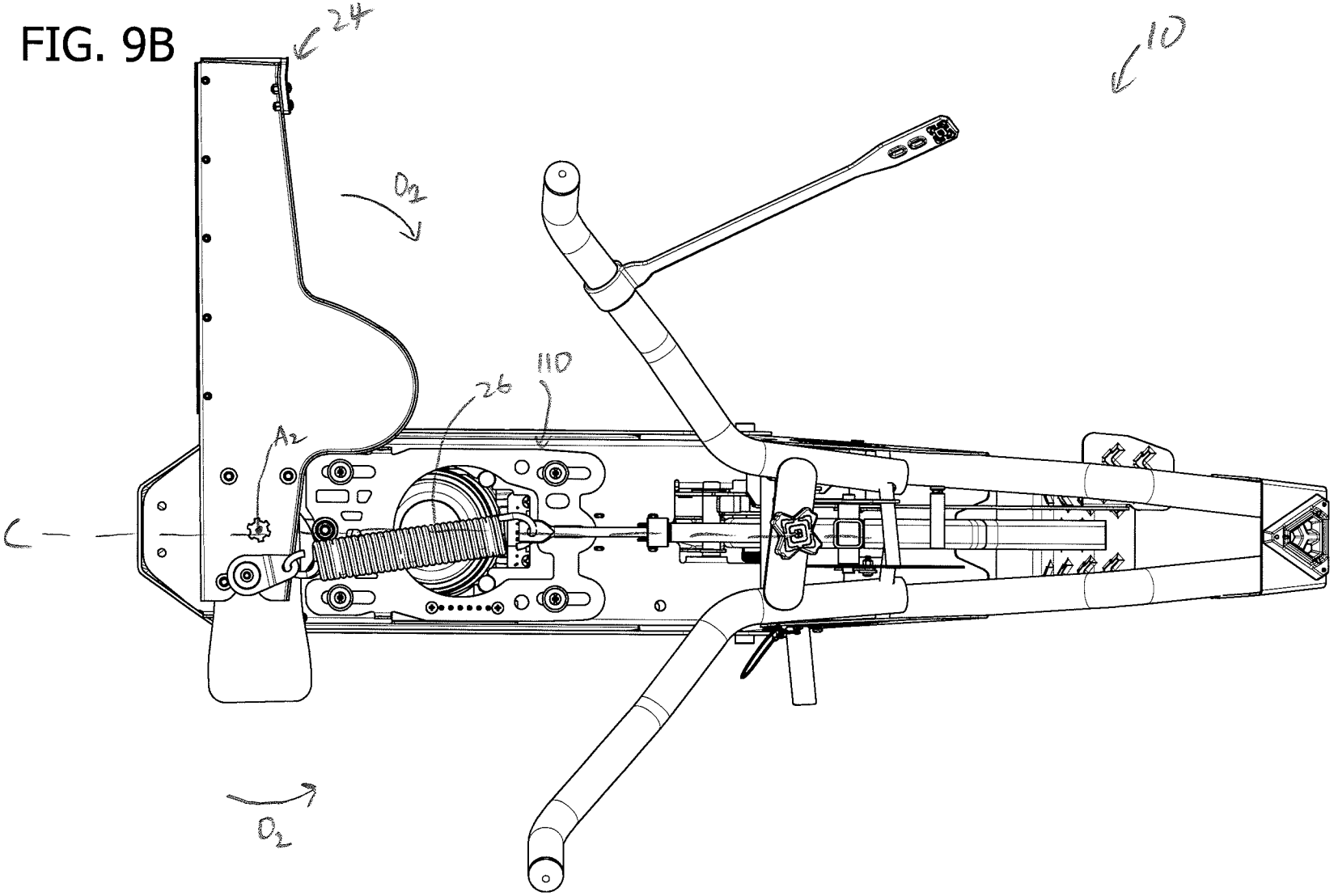
FIG. 9B is a bottom view of the shooting target thrower, with the throwing arm in the thrown position.
Figure 10A:
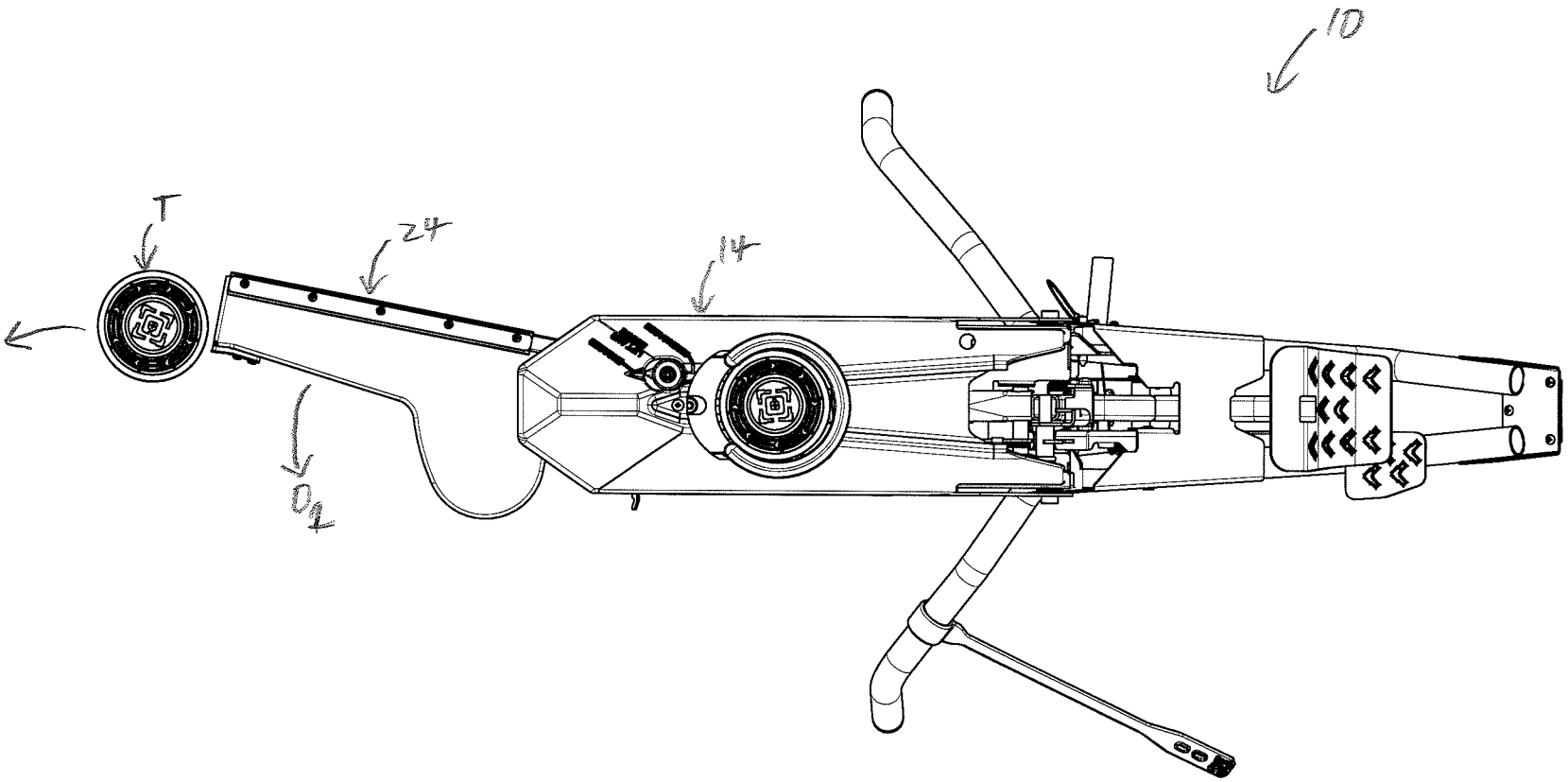
FIG. 10A is a top view of the shooting target thrower, with the throwing arm in a non-cocked position.
Figure 10B:
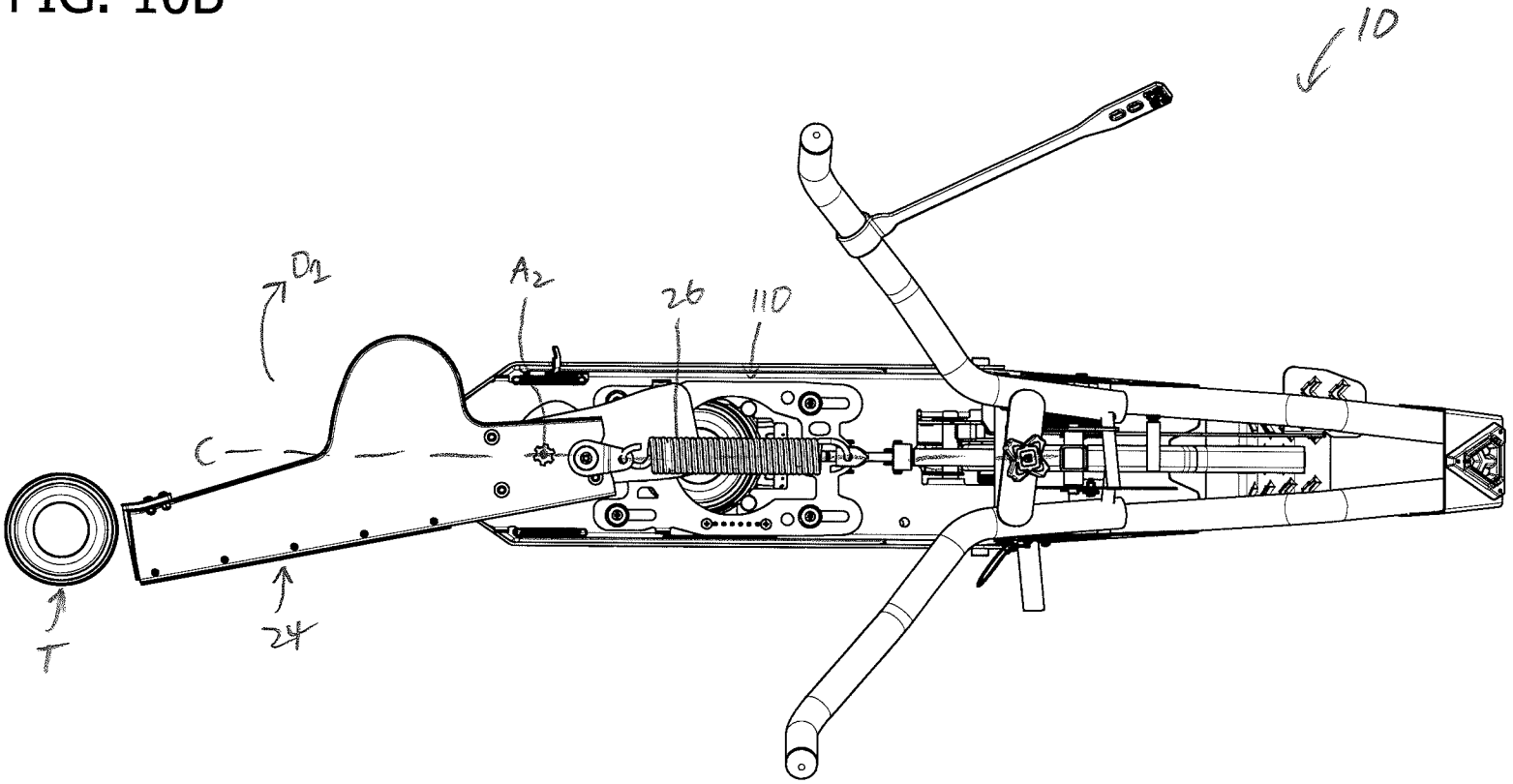
FIG. 10B is a bottom view of the shooting target thrower, with the throwing arm in the non-cocked position.

The throwing mechanism includes a throwing arm 24 supported by the frame 12. Specifically, the throwing arm 24 is coupled to the head 14. The throwing arm 24 rotates 360 degrees through a range of motion or throwing cycle about a throwing or pivot axis $A_2$. The throwing axis $A_2$ is disposed in front of the hopper 18. The throwing mechanism also includes a throwing spring 26 operatively coupled to the throwing arm 24. In the illustrated embodiment, the throwing spring 26 comprises a coiled tension spring, although other configurations are within the scope of the present disclosure. Referring to FIGS. 7A-10B, the throwing arm 24 rotates through a variety of different positions during the throwing cycle (e.g., a single revolution about the throwing axis $A_2$). Generally speaking, the throwing arm 24 rotates in only one direction $D_1$ (e.g., a first or throwing direction) about the throwing axis $A_2$, especially during the throwing cycle. In the illustrated embodiment, with reference to FIG. 7A, the throwing arm 24 rotates in a counter-clockwise direction about the throwing axis $A_2$. FIGS. 7A-B show the throwing arm 24 in a cocked position. In this position, the throwing spring 26 is near its maximum tension and the throwing arm 24 is ready to throw a target T. FIG. 8 shows the throwing arm 24 rotating in the first direction $D_1$ about the throwing axis $A_2$ to throw the target. FIGS. 9A-B show the throwing arm 24 in a thrown position. The throwing arm 24 is configured to throw the target T as the throwing arm rotates from the cocked position, about the throwing axis $A_2$ in the first direction $D_1$, toward the thrown position. In the thrown position, the throwing arm 24 has thrown the target T and is at rest (e.g., not moving about the throwing axis $A_2$). The thrown position may also be referred to as a partially cocked (e.g., ½ cocked, ¾ cocked) position as the throwing arm is partially cocked in this position (e.g., the throwing spring 26 has a tension greater than its lowest amount of tension applied during the throwing cycle). FIGS. 10A-B show the throwing arm 24 in a non-cocked position. In this position, the throwing spring 26 imparts the least amount of force on the throwing arm 24. A spring pin 30 (described below) is generally closest to the charge pedal 34 (e.g., farthest rearward) when the throwing arm 24 is in the non-cocked position. Generally, the throwing arm 24 rotates past the non-cocked position when throwing the target T and the throwing arm is only in this positon when moved there by the operator. The momentum of the throwing arm 24 carries the throwing arm past the non-cocked position and into the thrown position. During the throwing cycle, the throwing arm 24 rotates from the cocked position, through to the non-cocked position, and to the thrown position to throw the target. The throwing arm is then rotated from the thrown position to the cocked position to repeat the cycle.

Generally, the throwing spring 26 is arranged to rotate the throwing arm 24 in the first direction $D_1$ about the throwing axis $A_2$ to throw the target T. In particular, the throwing spring 26 is arranged to rotate the throwing arm 24 from the cocked position toward (e.g., to) the thrown position to throw the target T. In the illustrated embodiment, the target thrower 10 includes a tensioner 28 to adjust the force or tension imparted by the throwing spring 26. The tensioner 28 is coupled to the frame 12 and includes a rotatable knob coupled to the threaded shaft. A first end of the throwing spring 26 is coupled to the shaft and an opposite second end is coupled to the throwing arm 26. The throwing arm 26 includes a spring pin 30 to which the end of the throwing spring 26 is coupled. Rotating the knob moves the shaft toward or away from the spring pin 30 to adjust the tension of the throwing spring 26. The spring pin 30 (specifically, the connection between the spring pin and the throwing spring 26) is offset or spaced apart from the throwing axis $A_2$.

The force (e.g., spring force) imparted by the throwing spring 26 on the throwing arm 24 varies as the throwing arm rotates about the throwing axis $A_2$ (e.g., during the throwing cycle). As the throwing arm 24 rotates through the throwing cycle, the throwing spring 26 expands and contracts as force applied to and released by the throwing spring. When the throwing arm 24 is in the cocked position, the force imparted by the throwing spring 26 is generally at (specifically, slightly less than) the maximum amount applied by the throwing spring 26 during the throwing cycle. In this position, a distance (e.g., a first distance) between the first and second ends of the throwing spring 26 is generally at (specifically, slightly less than) the maximum distance between the first and second ends of the throwing spring 26 during the throwing cycle. When the throwing arm is in the non-cocked position, the force imparted by the throwing spring 26 is at the lowest amount applied by the throwing spring 26 during the throwing cycle. In this position, the distance (e.g., a second distance) between the first and second ends of the throwing spring 26 is at the smallest distance during the throwing cycle. When the throwing arm 24 is in the thrown position, the force imparted by the throwing spring 26 is greater than the lowest amount applied by the throwing spring (and less than the maximum amount applied by the throwing spring). In this position, the distance (e.g., a third distance) between the first and second ends of the throwing spring 26 is greater than the second distance (and less than the first distance). Thus, in the thrown position, the throwing arm 24 may be considered partially cocked because the throwing spring 26 is partially tensioned (relative to the non-cocked position). As a result of the throwing arm 24 coming to rest at the thrown position after throwing a target T, the target thrower 10 reduces the total amount of force required to be exerted by the operator to move the throwing arm to the cocked position to throw another target T. For instance, the operator would need to exert more force to move the throwing arm 24 from the non-cocked position to the cocked position than from the thrown position to the cocked position. By stopping the throwing arm 24 at the thrown position, the target thrower 10 is able to recapture some of the force released by the throwing spring 26 while rotating the throwing arm to throw a target T. Desirably, the thrown position of the throwing arm is at a location that is greater than 180 degrees or 3.14 radians about the throwing axis $A_2$ from the cocked position. More desirably, the location of the thrown position is within the inclusive range of about 225 degrees to about 315 degrees (about 3.9 radians to about 5.5 radians) about the throwing axis $A_2$ from the cocked position. In one embodiment, the location of the thrown position is about 270 degrees (about 4.7 radians) about the throwing axis $A_2$ from the cocked position.

Referring to FIGS. 1-6, the target thrower 10 includes a drive train 32 (broadly, charging and firing assembly) for charging and firing the target thrower. The drive train 32 is operatively coupled to the throwing arm 24. The drive train 32 generally controls the movement of the throwing arm 24 during the throwing cycle. The drive train 32 includes a charge or charging pedal 34 and a fire pedal 36. Both the charge and fire pedals 34, 36 are arranged to be manually actuated or engaged (e.g., pressed by the foot of) by the operator. The charge pedal 34 is pivotably coupled to the frame 12 and rotates about a charge pedal axis $A_3$. The charge pedal 34 includes a charge bracket or weldment 78. The charge pedal 34 includes a foot pad 38 arranged to receive or be pressed by the foot of the operator. The foot pad 38 is mounted to the charge bracket 78. The charge pedal 34 pivots (e.g., rotates) about the charge pedal axis $A_3$ when pressed by the operator. The charge pedal 34 receives energy from the operator as an input to the target thrower 10 to throw the target T. The charge pedal 34 is movable through a charging cycle including a downward or charging stroke and an upward or return stroke. The charge pedal 34 is resiliently biased (as explained in more detail below) toward an initial or at-rest position, shown in FIGS. 1-4. The frame 12 includes a stop 35 (FIG. 3) which the charge pedal 34 contacts when in the initial position. The stop 35 holds the charge pedal 34 in the initial position. From the initial position, to start the charge cycle, the operator pushes the foot pad 38 downward to perform the charging stroke and then raises (or removes) their foot to allow the charge pedal 34 to perform the return stroke (e.g., return to the initial position). The charge pedal 34 is operatively connected to the throwing arm 24 and is configured to rotate the throwing arm 24 toward the cocked position when actuated by the operator. The phrase "operatively connected" includes both direct and indirect operative connections. The drive train 32 includes a puller 40 for cocking (e.g., rotating) the throwing arm 24. During the charging stroke, the charge pedal 36 actuates (e.g., moves) the puller 40 to move (e.g. rotate) the throwing arm 24 toward (e.g., to) the cocked position, thereby tensioning the throwing spring 26. Therefore, when the operator actuates the charge pedal 34, the throwing arm 24 is brought to the cocked position and the throwing spring 26 is tensioned to throw the target T. As explained in further detail below, actuating the charge pedal 34 also operates other aspects of the target thrower, such as feeding a target T from the hopper 18 to the throwing arm 24.

The drive train 32 includes a throwing arm stop 42. The throwing arm 24 engages the throwing arm stop 42 when the throwing arm is in the cocked position. In this manner, the throwing arm stop 42 holds the throwing arm 24 in the cocked position. The throwing arm stop 42 includes a throwing arm engagement portion that engages the throwing arm 24. The throwing arm stop 42 is movable relative to the throwing arm 24 to disengage the throwing arm to release the throwing arm to rotate, under the force of the throwing spring 26, from the cocked position toward the thrown position to throw the target T. The throwing arm stop 42 is movably (e.g., pivotably) coupled to the frame 12. In the illustrated embodiment, the throwing arm stop 42 pivots about a stop axis $A_4$. In a retained or holding position, the throwing arm stop 42 (e.g., throwing arm engagement portion) is arranged to engage the throwing arm 24. In other words, the throwing arm stop 42 is arranged to block the travel path of the throwing arm 24 from the cocked position to the thrown position. In a release position, the throwing arm stop 42 (e.g., throwing arm engagement portion) is arranged to be spaced from or disengage the throwing arm 24 to permit the throwing arm to rotate about the throwing arm axis $A_2$ in the first direction under the force of the throwing arm spring 26 to throw the target T. The throwing arm stop 42 pivots between the holding position and the release position. A return spring 44 biases the throwing arm stop 42 toward the holding position.

Referring to FIG. 7B, the throwing spring 26 biases the throwing arm 24 against the throwing arm stop 42 in the cocked position. The throwing spring 26 is in an over-center arrangement when the throwing arm is in the cocked position to hold the throwing arm 24 in the cocked position. As the throwing arm 24 rotates in the first direction $D_1$ and nears the cocked position, the spring pin 30 (where the force from the throwing spring 26 is applied to the throwing arm) crosses over a main spring centerline C. The main spring centerline C extends through the throwing axis $A_2$ and the end of the throwing spring 26 attached to the tensioner 28. The point in the throwing cycle where the spring pin 30 is aligned with the main spring centerline C, and the throwing axis $A_2$ is between the spring pin and the end of the throwing spring 26 attached to the tensioner 28, is the point when the throwing spring 26 applies its maximum tension or force. The point in the throwing cycle where the spring pin 30 is aligned with the main spring centerline C, and the spring pin is between the throwing axis $A_2$ and the end of the throwing spring 26 attached to the tensioner 28, is the point when the throwing spring 26 applies the its least tension or force. When the spring pin 30 crosses over the main spring centerline C, the throwing spring 26 begins to start pulling the throwing arm 24 in the first direction $D_1$, instead of the opposite second direction $D_2$. A few degrees of rotation after the spring pin 30 crosses the main spring centerline C, the throwing arm 24 hits the throwing arm stop 42 and remains there until the throwing arm stop is moved to the release position. This over-center arrangement of the force imparted on the throwing arm 24 by the throwing spring 26 holds the throwing arm in the cocked position against the throwing arm stop 42. In this cocked position, the throwing arm 24 is ready to throw the target T.

The fire pedal 36 is configured to permit or release the throwing arm 24 to rotate, under the force of the throwing spring 26, in the first direction from the cocked position toward the thrown position to throw the target T. The fire pedal 36 includes a foot pad 46 arranged to receive or be pressed by the foot of the operator. The fire pedal 36 pivots (e.g., rotates) about the fire pedal axis $A_5$ when pressed by the operator. The operator moves the fire pedal 36 from an initial or at-rest position (shown in FIGS. 1-4) toward a firing position (shown in FIG. 5) to fire or throw the target T. Actuation of the fire pedal 36 disengages the throwing arm stop 42 and the throwing arm 24 from one another to permit the throwing arm to rotate, under the force of the throwing spring 26, to throw the target T. The fire pedal 36 is operatively connected to the throwing arm stop 42 to move the throwing arm stop between the holding and release positions. In the illustrated embodiment, the fire pedal 36 engages a first engagement surface of the throwing arm stop 42 to pivot the throwing arm stop from the holding position to the release position. In operation, with reference to FIGS. 4 and 5, as the operator presses the foot pad 46 of the fire pedal 36 downward from the initial position, an end portion of the fire pedal opposite the foot pad moves upward and pivots the throwing arm stop 42 from the holding position to the release position, thereby permitting the throwing arm to rotate to throw the target T. A return spring 48 biases the fire pedal 36 in the initial position and returns the fire pedal to the initial position after the operator raises (or removes) their foot. As the fire pedal 36 returns to its initial position, the throwing arm stop 42 also returns to the holding position due to its return spring 44. The throwing arm stop 42 and fire pedal 36 are now at rest and ready to be actuated to throw the next target T.

Figure 6:
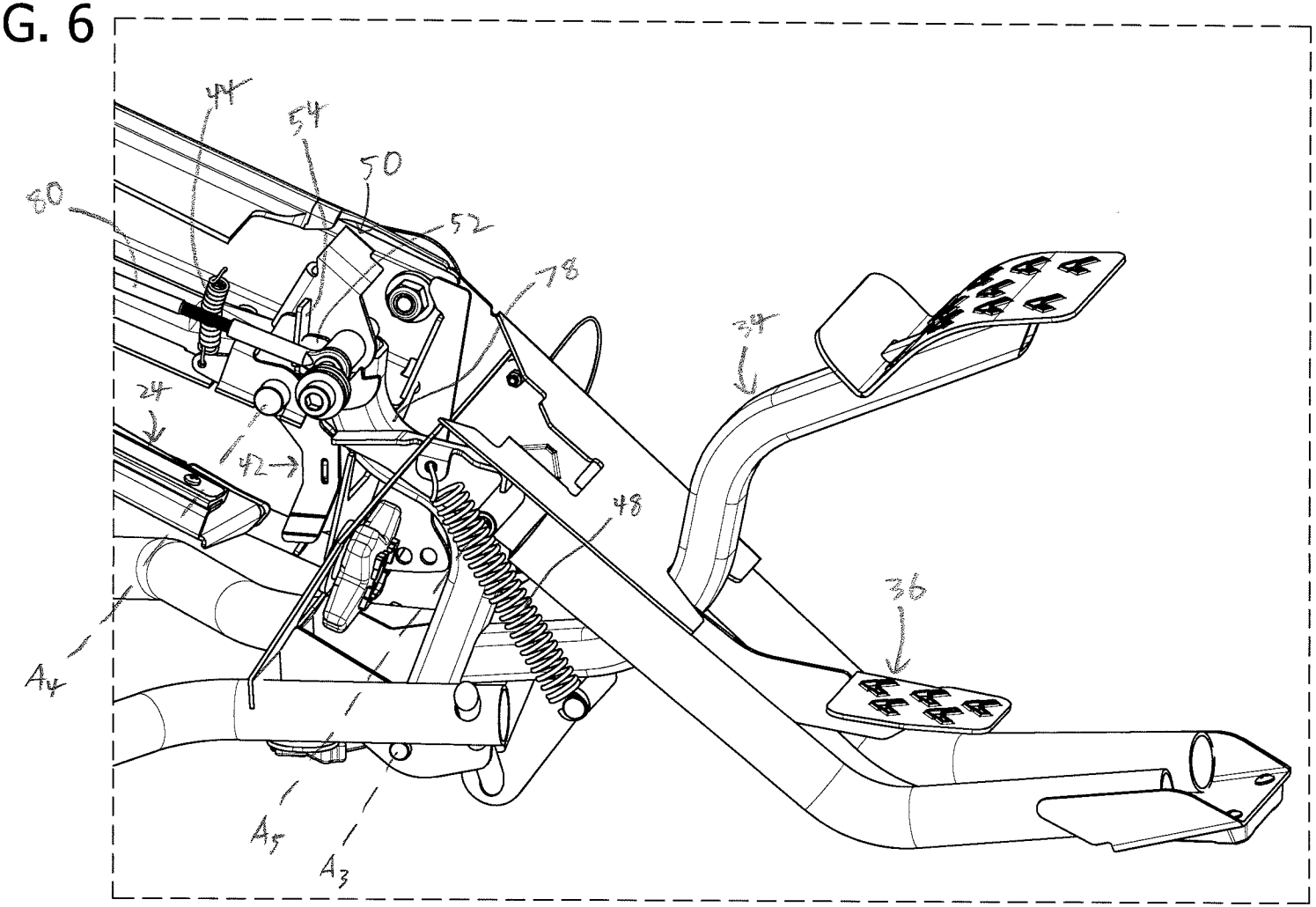
FIG. 6 is similar to FIG. 4, with the fire mode selector in a fire position.

Actuating the fire pedal 36 is one way for an operator to interact with the target thrower 10 to throw the target T. In the illustrated embodiment, the target thrower 10 provides a second way for the operator to interact with the target thrower 10 to throw the target T using the charge pedal 34. The target thrower 10 includes a fire mode selector 50. The fire mode selector 50 is movable (e.g., pivotable) between a fire position (FIG. 4) and a non-fire position (FIG. 6). When the fire mode selector 50 is in the fire position, the charge pedal 34 permits or releases the throwing arm 24 to rotate, as described herein, to throw the target T during the return stroke of the charge pedal (broadly, actuation of the charge pedal throws the target). In this mode (e.g., a first or fire mode), the operator can repeatedly push the charge pedal 34 down and release the charge pedal upward to repeatedly throw targets T. When the fire mode selector 50 is in the non-fire position, the charge pedal 34 does not permit or release the throwing arm 24 to rotate to throw the target T during the return stroke of the charge pedal (broadly, actuation of the charge pedal does not throw the target). In this mode (e.g., a second or non-fire mode), when the fire mode selector 50 is in the non-fire position, the fire pedal 36 must be used to release the throwing arm 24 to throw the target T, as described above. It is understood the fire pedal 36 can also be used to release the throwing arm 24 to throw the target T when the fire mode selector 50 is in the fire position, but it is not desired or required. The charge pedal 34 performs its other functions, as described herein, regardless of the position of the fire mode selector 50.

Figure 4:
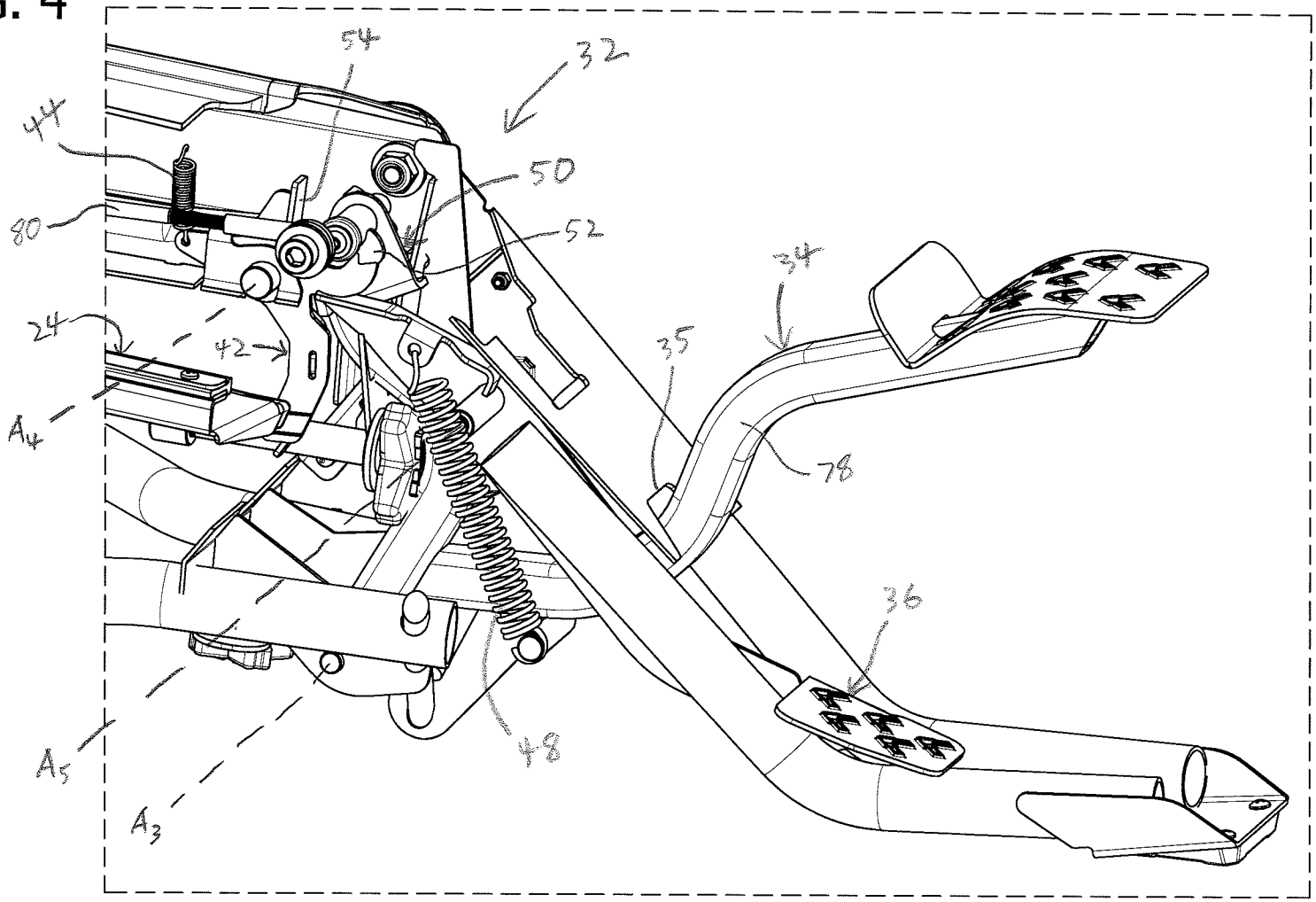
FIG. 4 is a perspective a portion of a drive assembly of the shooting target thrower, with a fire pedal and a charge pedal both in at-rest positions and a fire mode selector in a non-fire position.
Figure 5:
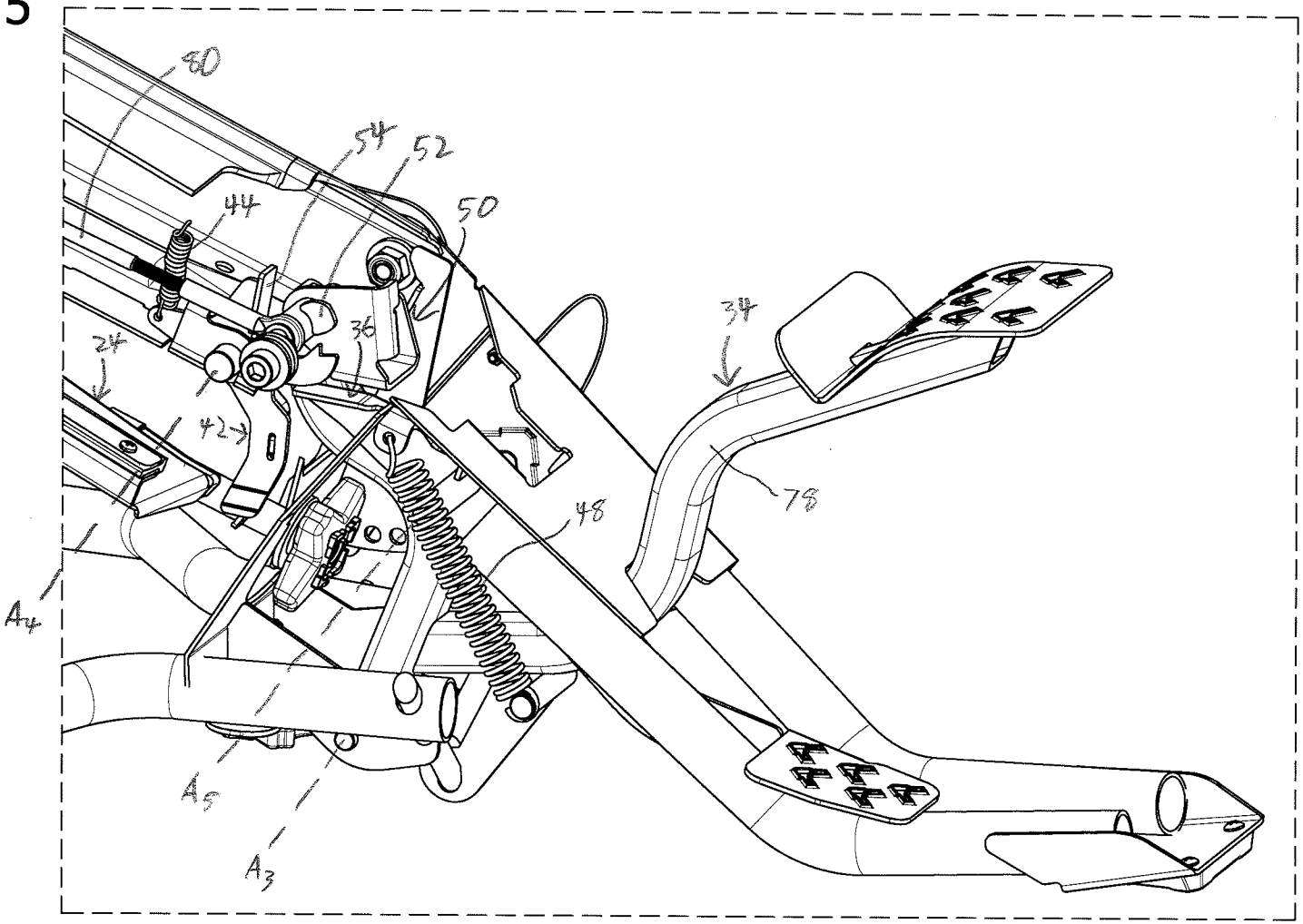
FIG. 5 is similar to FIG. 4, with the fire pedal in a firing position.

When the fire mode selector 50 is in the fire position, the operator uses the charge pedal 34 to release the throwing arm 24 to throw the target T. As the charge pedal moves along its return stroke and returns to its initial position, the throwing arm 24 is released and the target T is thrown. In the illustrated embodiment, the throwing arm 24 is released when the charge pedal nears its initial position, but in other embodiments the throwing arm can be released at generally any point along the return stroke of the charge pedal 34. Referring to FIGS. 4 and 6, the fire mode selector 50 selectively operatively connects and disconnects the charge pedal 34 to the throwing arm stop 42. In the non-fire position, the charge pedal 34 is not operatively connected to the throwing arm stop 42. In the fire position, the charge pedal 34 is operatively connected to the throwing arm stop 42. The fire mode selector 50 is operatively coupled to the charge pedal 34. In the illustrated embodiment, the fire mode selector 50 is supported by the charge pedal 34. The fire mode selector 50 is mounted on and moves with the charge pedal 34 (specifically, the upper end of the charge bracket 78).

The target thrower 10 includes an engagement surface 54 operatively coupled to the fire mode selector 50. As such the engagement surface 54 moves with respect to the throwing arm stop 42 with the movement of the fire mode selector 50. When the fire mode selector 50 is in the fire position, the engagement surface 54 is arranged to engage and move the throwing arm stop 42 during the return stroke of the charge pedal 34 to disengage the throwing arm stop from the throwing arm 24 to release the throwing arm to rotate to throw the target T (e.g., move the throwing arm stop from the holding position to the release position). When the fire mode selector 50 is in the non-fire position, the engagement surface 54 is arranged to not engage and not move the throwing arm stop 42 during the return stroke of the charge pedal 34. Therefore, when the fire mode selector 50 is in the non-fire position, movement of the charge pedal 34 during the return stroke does not disengage the throwing arm stop 42 from the throwing arm 24 to release the throwing arm to rotate to throw the target T. Instead, the fire pedal 36 is used to throw the target T, as described herein. In the illustrated embodiment, the engagement surface 54 is part of the fire mode selector 50. The fire mode selector 50 includes a cam 52. The cam 52 defines the engagement surface 54. Placing the fire mode selector 50 in the fire position arranges the cam 52 (e.g., the engagement surface 54 thereof) to engage the throwing arm stop 42 as the charge pedal 34 returns to its initial position. The cam 52 engages a second engagement surface (spaced from the first engagement surface) of the throwing arm stop 42 to pivot the throwing arm stop from the holding position to the release position. In the illustrated embodiment, the engagement between the cam 52 and the throwing arm stop 42 occurs as the charge pedal 34 nears the end of the return stroke (e.g., nears the initial position). Placing the fire mode selector 50 in the non-fire position arranges the cam 52 (e.g., the engagements surface 54 thereof) such that the cam remains spaced apart and will not engage the throwing arm stop 42 at any point along the return stroke (broadly, the charging cycle).

It will be appreciated that the fire mode selector 50 can be referred to as a "flurry mode" selector in that it permits the user to (in the "fire position" of the selector) throw a flurry of targets from the thrower, one target after another, as the charging pedal is cycled downward and upward, as explained in further detail below.

Figure 11:
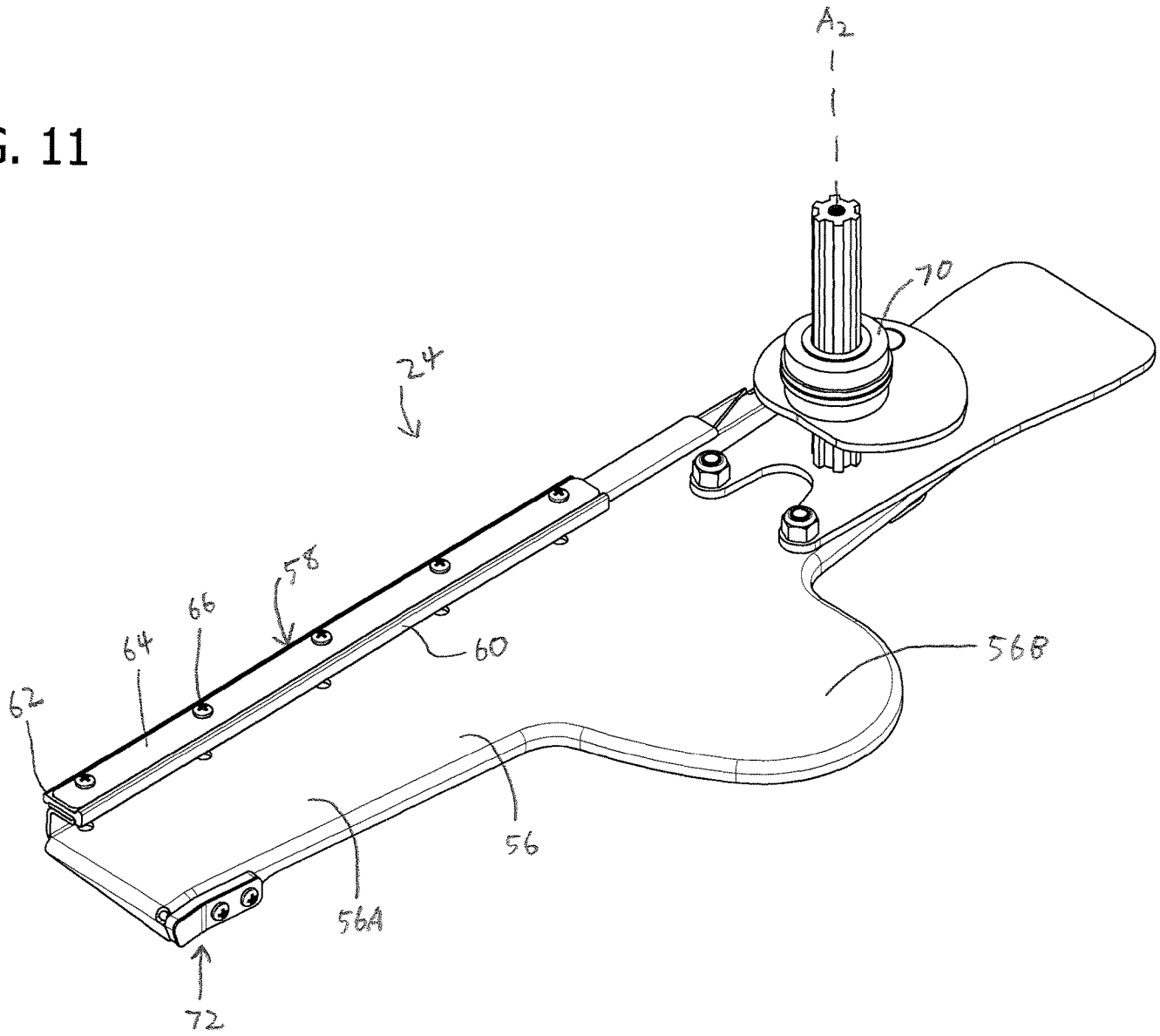
FIG. 11 is a perspective of the throwing arm.
Figure 12:
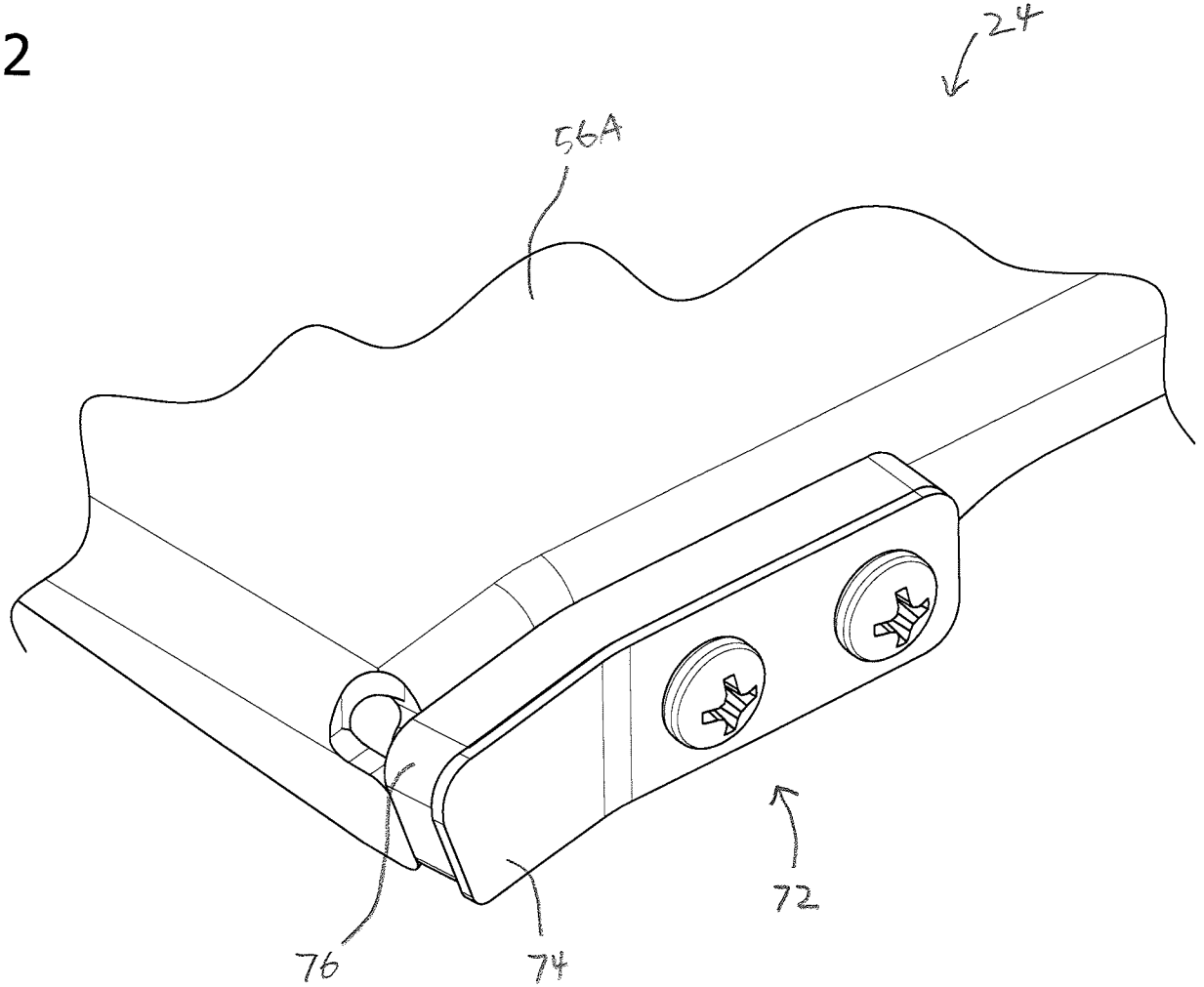
FIG. 12 is an enlarged perspective of a bumper of the throwing arm.
Figure 13:
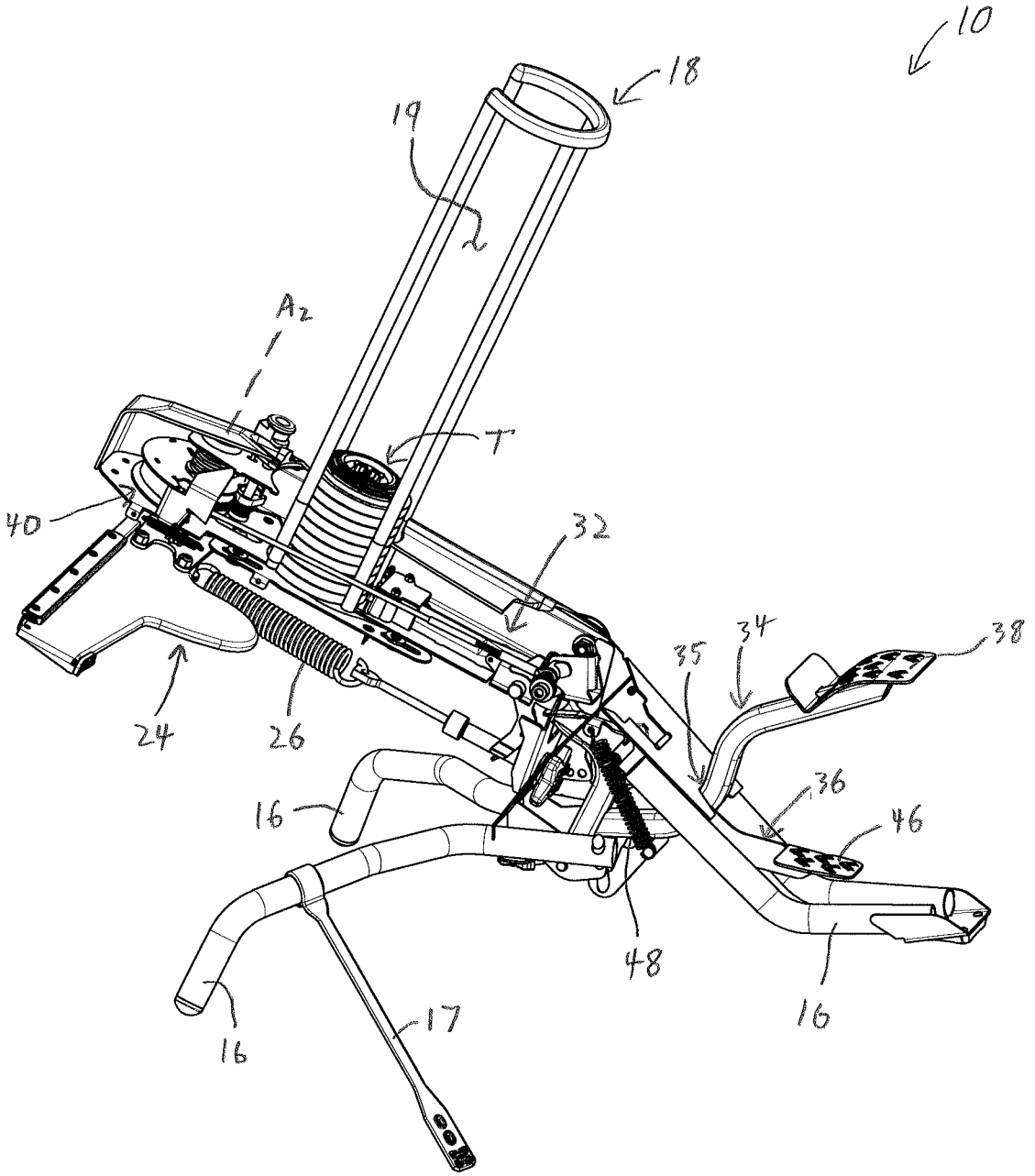
FIG. 13 is another perspective of the shooting target thrower, with portions of the shooting target thrower hidden from view or cut away to show interior details and the throwing arm in the thrown position.
Figure 14:
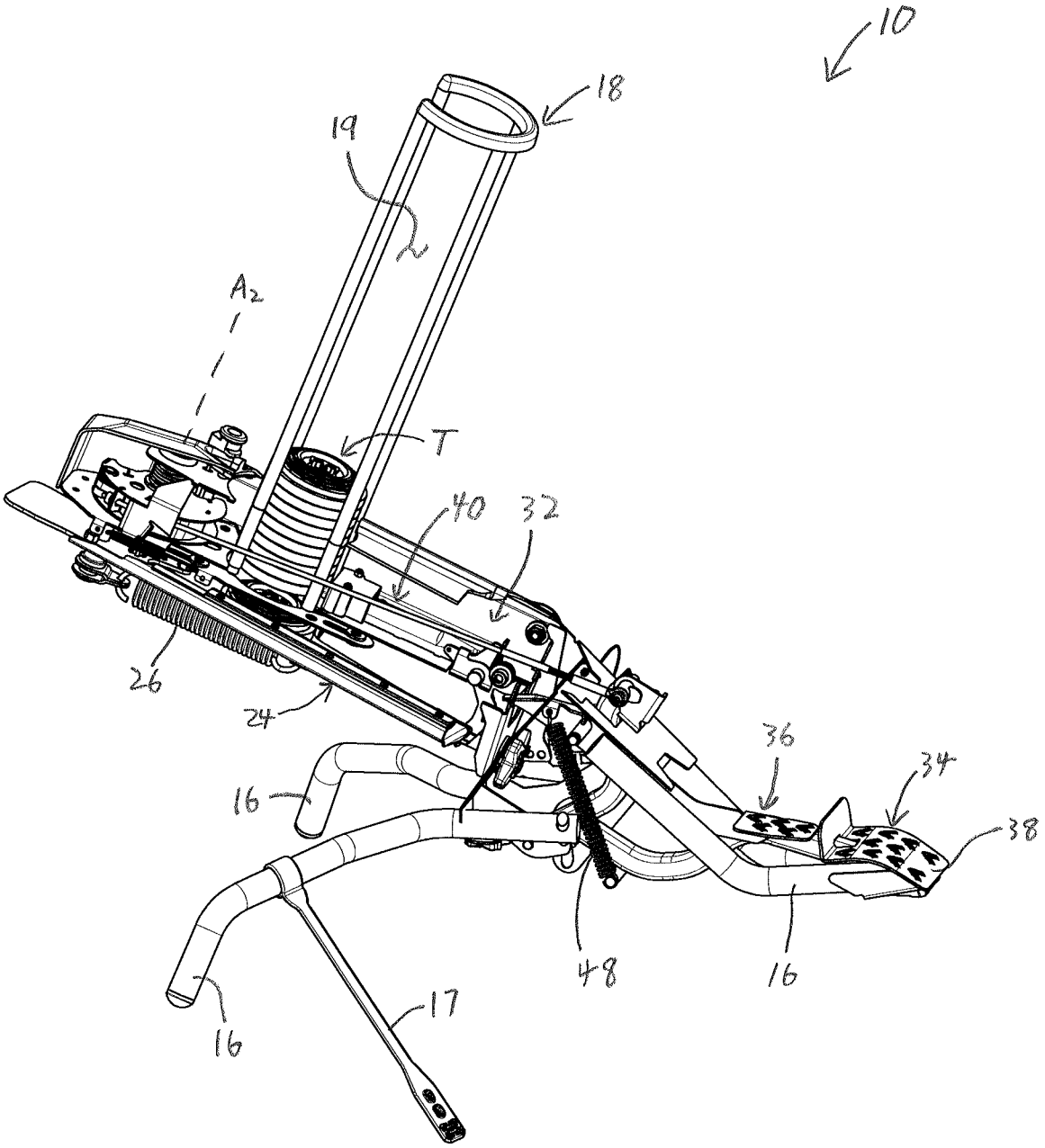
FIG. 14 is another perspective of the shooting target thrower, with the charge pedal rotated to move the throwing arm to the cocked position.

Referring to FIGS. 11 and 12, the throwing arm 24 includes a bed 56 arranged to receive and support the target T. The bed 56 includes a main bed 56A (e.g., main bed section) and an extended bed 56B (e.g., an extended bed section) projecting outward from a side of the main bed. The throwing arm 24 also includes a throwing bumper 58 arranged to engage and brace the target T as the throwing arm 24 rotates to throw the target. The throwing bumper 58 includes an engagement surface 60 (e.g., a target engagement surface) arranged to engage a side of the target T. The engagement surface 60 extends along a side of the bed 56. In the illustrated embodiment, the throwing bumper 58 includes a resiliently compressible (e.g., rubber) throwing strip 62 that defines the engagement surface 60. The throwing strip 62 has a t-shaped cross-section. The throwing strip 62 helps cushion the impact between the target T and the throwing bumper 58 to prevent the target from breaking. In the illustrated embodiment, the throwing strip 62 is secured to the rest of the throwing arm 24 by a metal bar 64 and a plurality of fasteners 66 (e.g., nuts and bolts). This provides a robust connection between the throwing strip 62 and the rest of the throwing arm 24 while also allowing the throwing strip to be easily replaced if it wears out over time. Generally, when the throwing arm 24 rotates to throw the target T, the target slides radially outward from the throwing axis $A_2$ along the main bed 56A and rolls along the engagement surface 60. The centrifugal force generated by the rotation of the throwing arm 24 forces the target T to slide off the end of the main bed 56A and into the air.

The throwing arm 24 includes a bumper 72. The bumper 72 is arranged to engage the throwing arm stop 42 when the throwing arm 24 is in the cocked position. In the illustrated embodiment, the bumper 72 is disposed adjacent the outer end of the throwing arm 24. The bumper 72 is mounted to the leading edge of the throwing arm 24. The bumper 72 is configured to cushion the impact between the throwing arm 24 and the throwing arm stop 42. This extends the life of the throwing arm 24 and the throwing arm stop 42 by preventing the throwing arm and/or throwing arm stop from deforming over time due to repeated forceful contact with the throwing arm stop. The bumper 72 includes a cover strip 74 and a resiliently deformable backing 76. The cover strip 74 covers the backing 76 to protect the backing. The cover strip 74 is arranged to engage the throwing arm stop 42 when the throwing arm 24 is in the cocked position, with the backing 76 arranged behind the cover strip to absorb the impact. In one embodiment, the cover strip 74 comprises a thin piece of metal and the backing 76 is made of rubber or any other suitable material.

The throwing mechanism includes a shaft 68 (e.g., a central shaft) that defines and is rotatable about the throwing axis $A_2$. The throwing arm 24 is fixed to and rotatable with the shaft 68. The shaft 68 and throwing arm 24 rotate together. Bearings 70 connect the shaft 68 to the housing of the head 14. In the illustrated embodiment, the shaft 68 includes a plurality of splines to facilitate the connection of components (e.g., the throwing arm 24) to the shaft 68 as well as ensuring such components rotate with the shaft.

Referring to FIGS. 13-16D, as mentioned above, the drive train 32 includes the charge pedal 34 and the puller 40. The puller 40 operatively connects the charge pedal 34 to the shaft 68 (and therefore the throwing arm 24). Actuation of the charge pedal 34 (in particular, movement of the charge pedal during the charging stroke) moves the puller 40 to rotate the throwing arm 24 about the throwing axis $A_2$ in the first direction toward the cocked position. The puller 40 is coupled to the upper end of the charge pedal. When the operator steps on the foot pad 38 of the charge pedal 34, the force or power is transmitted through the charge pedal to the puller 40. The charge pedal 34 pivots about the charge pedal axis $A_3$. This rotates the upper end of the charge pedal 34 away from the throwing axis $A_2$, which causes the puller 40 attached to the upper end of the charge pedal to be pulled during the charging stroke. As the puller 40 is pulled, the puller rotates the shaft 68, and thereby the throwing arm 24, about the throwing axis $A_2$ to the cocked position, thereby charging (e.g., adding tension to) the throwing spring 26.

Figure 15:
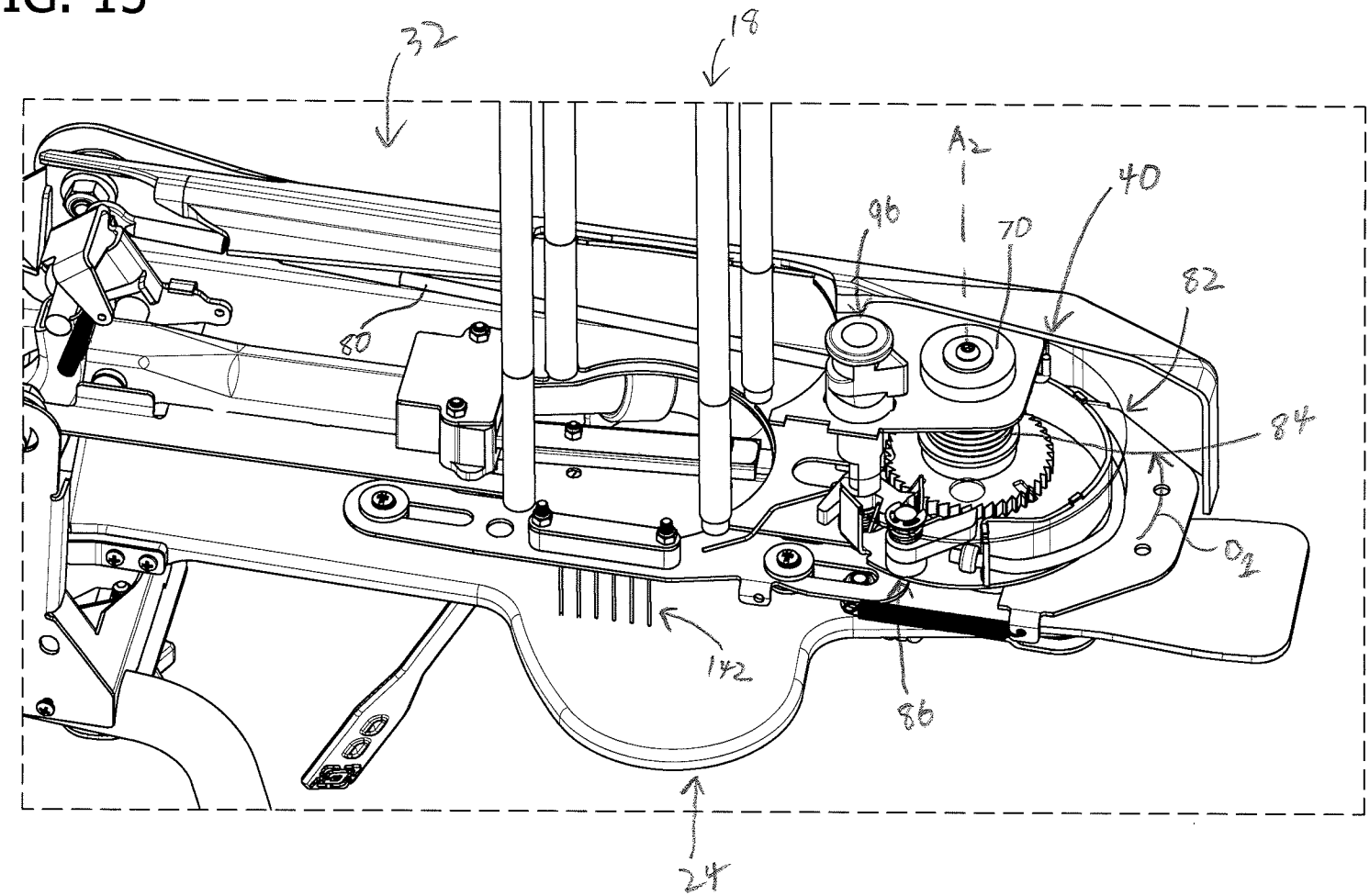
FIG. 15 is another perspective of the drive assembly, with portions of the shooting target thrower hidden from view, cut away, or shown transparent to show interior details.

The puller 40 includes a cable 80 and a pulley 82. One end of the cable 80 is attached to the charge pedal 34 (specifically, the upper end of the charge bracket 78) and the opposite end is attached to the pulley 82. The end portion of the cable 80 attached to the pulley 82 curves around the pulley so that the pulley rotates when pulled by the cable. The pulley rotates about the throwing axis $A_2$. The pulley 82 is rotatable about the shaft 68. One or more bearings 70 connect the pulley 82 to the shaft 68. Movement of the charge pedal 34 during its charging stroke rotates the pulley 82 in the first direction $D_1$ about the throwing axis $A_2$. The drive train 32 includes a return spring 84 that biases the pulley 82 in a second direction $D_2$ about the throwing axis $A_2$, that is opposite the first direction $D_1$, toward an initial or at-rest position, as shown in FIG. 15. In the illustrated embodiment, the return spring 84 is a torsion spring mounted about the shaft 68 above the pulley 82. One end of the return spring 84 engages the housing of the head 14 and the other end of the return spring engages the pulley 82. The return spring 84 may also assist in biasing the charge pedal 34 in its initial position. In the illustrated embodiment, the charge pedal 34 is also biased toward its initial position by return spring 48. In operation, when the charge pedal 34 is pushed downward in its charging stroke, the cable 80 pulls the pulley 82 to rotate the pulley and the throwing arm 24, against the bias of the return spring 84, in the first direction $D_1$ about the throwing axis $A_2$. When the charge pedal 34 is released, the charge pedal is spring-returned, via the return springs 48, 84, during the return stroke to its initial position, and the pulley is spring-returned, via the return spring 84, back to its initial position.

The pulley 82 (broadly, the puller 40) is operatively connected to the shaft 68 and thereby the throwing arm 24. The drive train 32 includes a ratchet 86. The ratchet 86 is operatively coupled to the shaft 68 and the throwing arm 24. The ratchet 86 permits the shaft 68 and throwing arm 24 to rotate in only the first direction $D_1$ about the throwing axis $A_2$. Thus, unless the ratchet 86 is disengaged (as described below), the ratchet prevents the throwing arm 24 from rotating in the second direction $D_2$ about the throwing axis $A_2$. The ratchet 86 enables (1) the pulley 82 to rotate the throwing arm 24 about the throwing axis $A_2$ when the puller 40 is pulled, (2) the throwing arm to rotate relative to the pulley when the throwing arm is rotated by the throwing spring 26 to throw the target T, and (3) the pulley to rotate relative to the throwing arm to return to its initial position.

In the illustrated embodiment, the ratchet 86 includes a ratchet wheel 88, a first or charging pawl 90, and a second or holding pawl 92. The ratchet wheel 88 is fixed to and rotatable with the shaft 68. In this manner, the ratchet wheel 88 is fixed to the throwing arm 24 (via the shaft 68) such that the ratchet wheel and throwing arm rotate together. Rotation of the ratchet wheel 88 drives rotation of the shaft 68, and therefore the throwing arm 24. The ratchet wheel 88 includes a plurality of ratchet teeth. The ratchet wheel 88 is splined in the center to mate with the splines of the shaft 68. The charging and holding pawls 90, 92 are engaged with the ratchet wheel (the ratchet teeth thereof). The charging pawl 90 is pivotable about a first pawl axis $A_6$ and the holding pawl 92 is pivotable about a second pawl axis $A_7$. The charging and holding pawls 90, 92 are each biased toward the ratchet wheel 88 by respective ratchet springs 94. The charging and holding pawls 90, 92 can operate independently of one another. For example, the charging and holding pawls 90, 92 can each rotate independently about their respective pawl axes $A_6$, $A_7$. The charging and holding pawls 90, 92 are arranged relative to the ratchet wheel 88 to permit the ratchet wheel to rotate in the first direction $D_1$ and inhibit the ratchet wheel from rotating in the second direction $D_2$. In general, when the ratchet wheel 88 rotates in the first direction $D_1$ relative to the charging and holding pawls 90, 92, the charging and holding pawls slide along and are deflected (e.g., pivoted) by the ratchet teeth, thereby permitting rotation of the ratchet wheel. If the ratchet wheel 88 attempts to rotate in the second direction $D_2$ relative to the charging and holding pawls 90, 92, the charging and holding pawls lock with the ratchet teeth to inhibit the ratchet wheel from rotating.

Figure 16A:
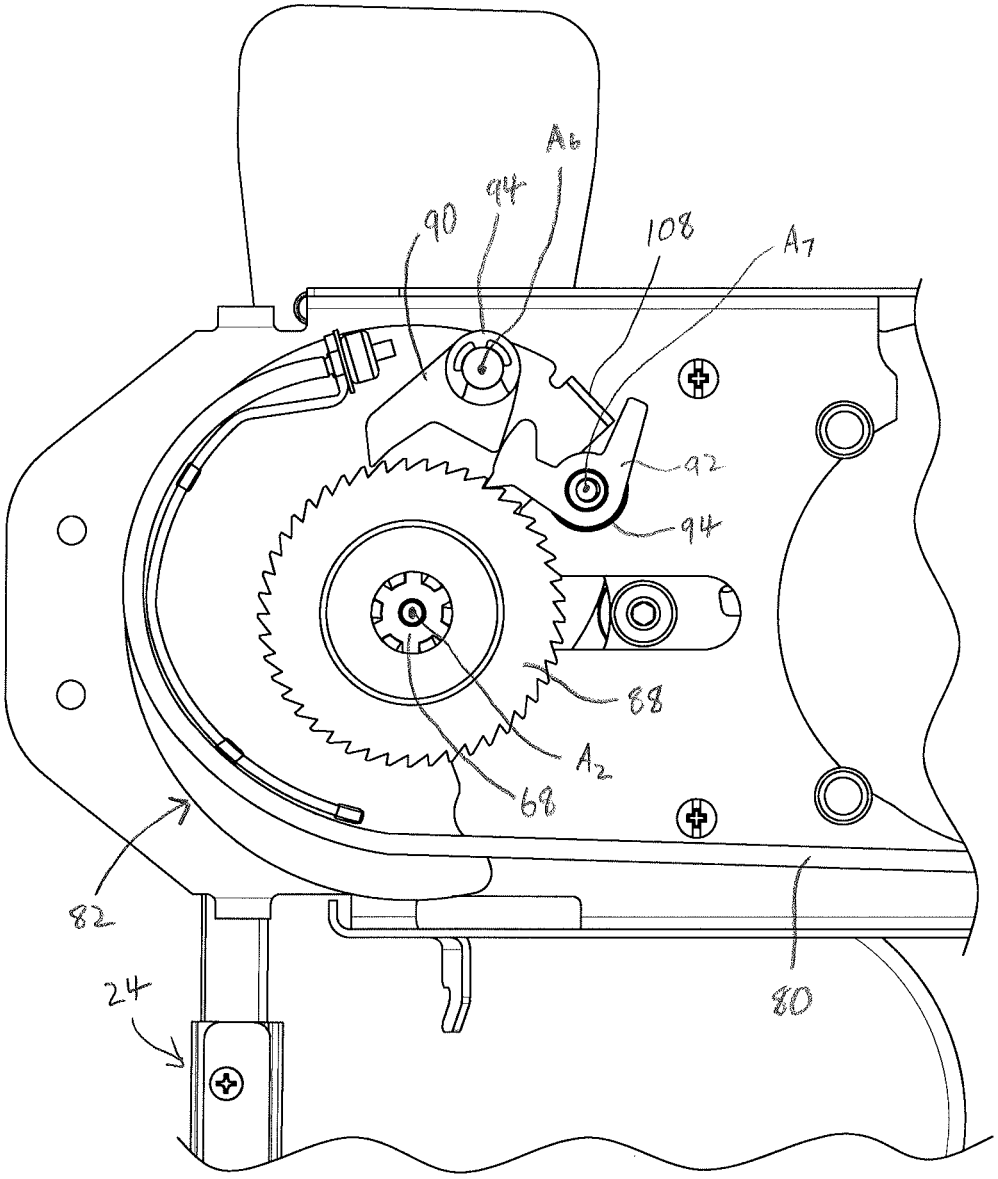
FIG. 16A is a top view of a pulley and a ratchet of the drive assembly, with the pulley in an at-rest position and the throwing arm in a thrown position.
Figure 16B:
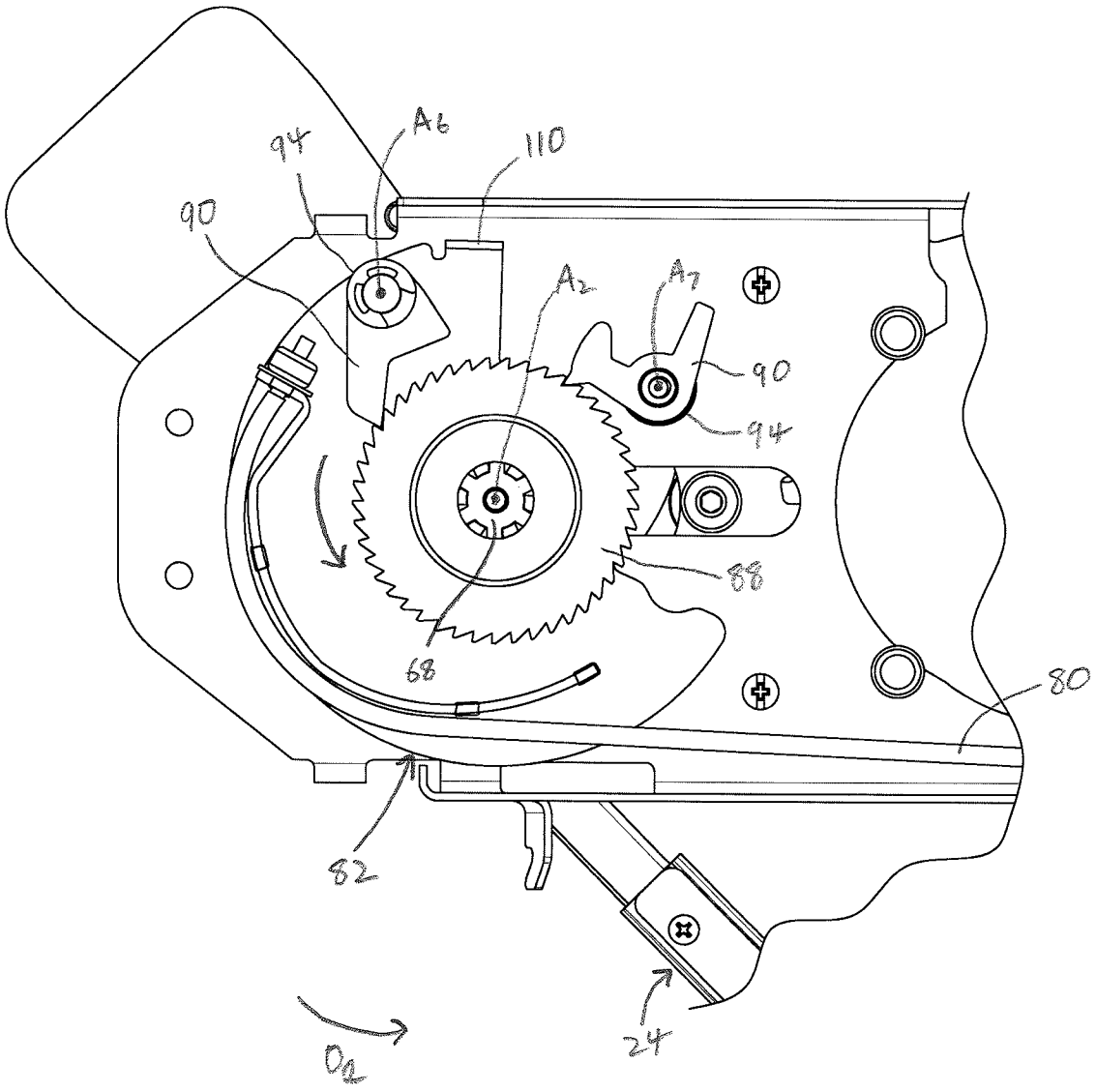
FIG. 16B is similar to FIG. 16A, with the pulley rotating counter-clockwise to rotate the throwing arm toward the cocked position.
Figure 16C:
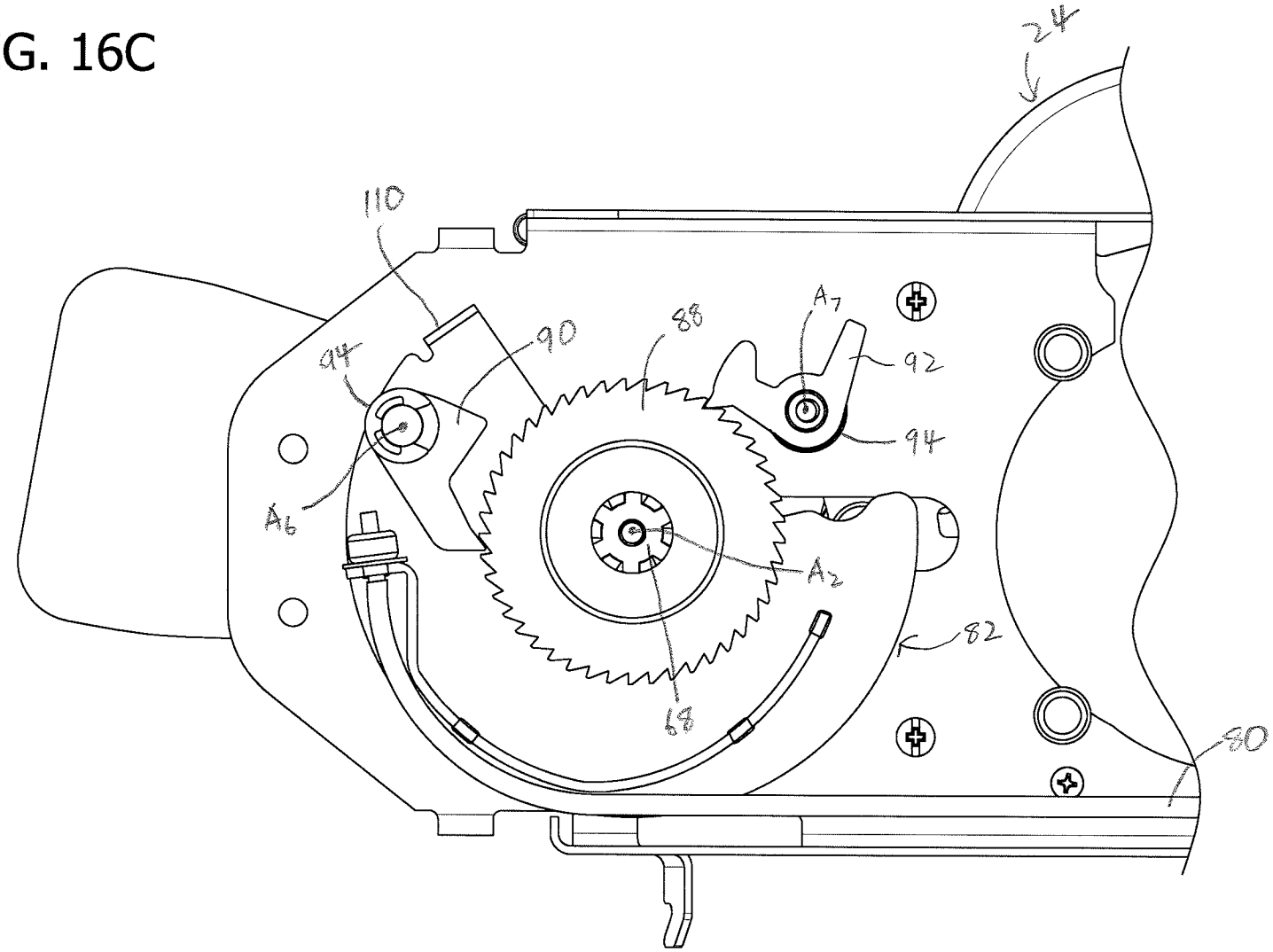
FIG. 16C is similar to FIG. 16A, with the pulley finishing rotating the throwing arm to the cocked position.
Figure 16D:
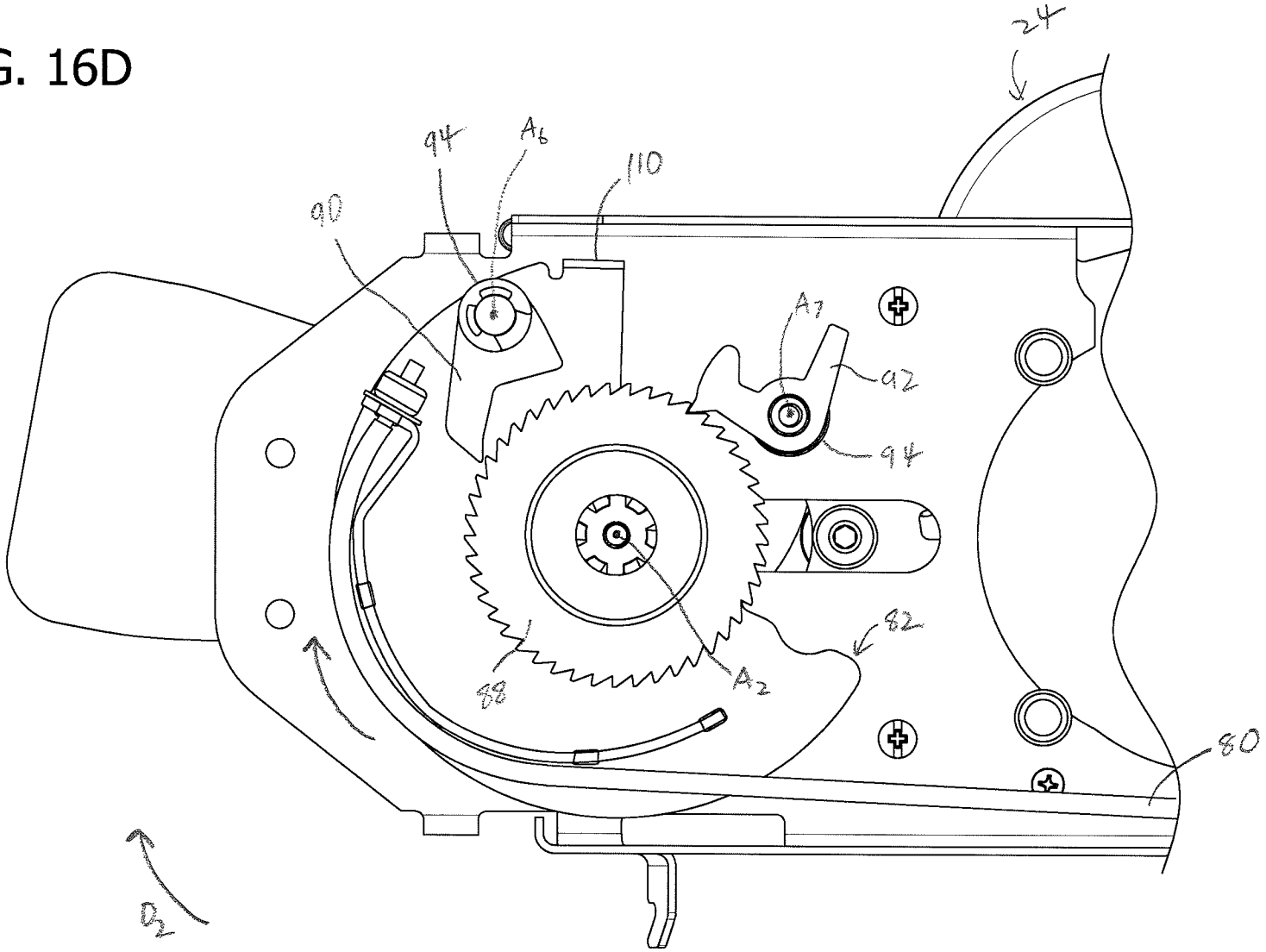
FIG. 16D is similar to FIG. 16C, with the pulley returning towards its at-rest position.

The charging and holding pawls 90, 92 work together during the operation of the target thrower 10. During the charging stroke of the charge pedal 34, the charging pawl 90 rotates the ratchet wheel 88 and thereby the shaft 68 and the throwing arm 24 in the first direction $D_1$ about the throwing axis $A_2$ to move the throwing arm toward the cocked position. The charging pawl 90 is supported by (specifically, mounted to) and rotatable about the throwing axis $A_2$ with the pulley 82. In operation, when the pulley 82 is rotated by the cable 80 in the first direction $D_1$, the charging pawl 90 rotates the ratchet wheel 88 in the first direction, thereby rotating the shaft 68 and the throwing arm toward the cocked position. The holding pawl 92 is arranged to inhibit the ratchet wheel 88 from rotating in the second direction $D_2$ about the throwing axis $A_2$. During the return stroke of the charge pedal 34, the holding pawl 92 holds the ratchet wheel 88, and thereby the shaft 68 and the throwing arm 24, in position by preventing the ratchet wheel from rotating in the second direction $D_2$. This allows the pulley 82 to return to its initial position after the charging stroke. The holding pawl 92 is supported by (specifically, mounted to) the housing of the head 14. Accordingly, the holding pawl 92 is generally stationary relative to the throwing axis $A_2$ (e.g., the second pawl axis $A_7$ is stationary relative to the throwing axis). The holding pawl 92 allows the charging pawl 90 to be unloaded so that the pulley 82 (broadly, the puller 40) can be returned to its initial position (reset for further pulling) without having the throwing arm 24 rotate. In operation, the holding pawl 92 prevents the ratchet wheel 88 from rotating in the second direction $D_2$ as the pulley 82 rotates in the second direction to return to its initial position during the return stroke of the charge pedal 34. As the pulley 82 returns to its initial position after rotating the throwing arm 24 to the cocked position, the holding pawl 92 prevents the ratchet wheel 88 (and thereby the throwing arm) from rotating with the pulley in the second direction. As the pulley 82 returns to its initial position, the charging pawl 90 rides along the ratchet teeth of the ratchet wheel 88. The movement of the pulley 82 and ratchet 86 during the charging cycle is shown in FIGS. 16A-D. In FIG. 16A, the pulley 82 is in its initial or at-rest position. In FIG. 16B, the pulley 82 and charging pawl 90 are rotating the ratchet wheel 88 in the first direction $D_1$ to move the throwing arm 24 to the cocked position due to the charge pedal 34 being moved along the charging stroke. In FIG. 16C, the pulley 82 and charging pawl 90 have rotated the ratchet wheel a sufficient distance to move the throwing arm 24 to the cocked position. Desirably, the charge bracket 78 is dimensioned such that only one charging stroke of the charge pedal 34 is needed to move the throwing arm 24 to the cocked position. However, it is understood multiple charging strokes of the charge pedal 34 can be used if needed. In this case, the holding pawl 92 inhibits the throwing arm 24 from rotating in the second direction while the charge pedal 34 is in-between charging strokes (e.g., being reset). In FIG. 16D, the pulley 82 is rotating in the second direction $D_2$ and returning to its initial position. As the pulley 82 rotates in the second direction $D_2$, the charging pawl 90 rides along the ratchet teeth of the ratchet wheel. The holding pawl 92 is locked with the ratchet wheel 88 to prevent the ratchet wheel from rotating in the second direction $D_2$ with the pulley.

The ratchet 86 is also arranged to hold the throwing arm 24 in the thrown position after the throwing arm throws the target T. When the throwing arm 24 is in the thrown position, both the charging and holding pawls 90, 92 lock with the ratchet wheel 88 to prevent the ratchet wheel from rotating in the second direction $D_2$ under the force of the throwing spring 26.

Figure 18A:
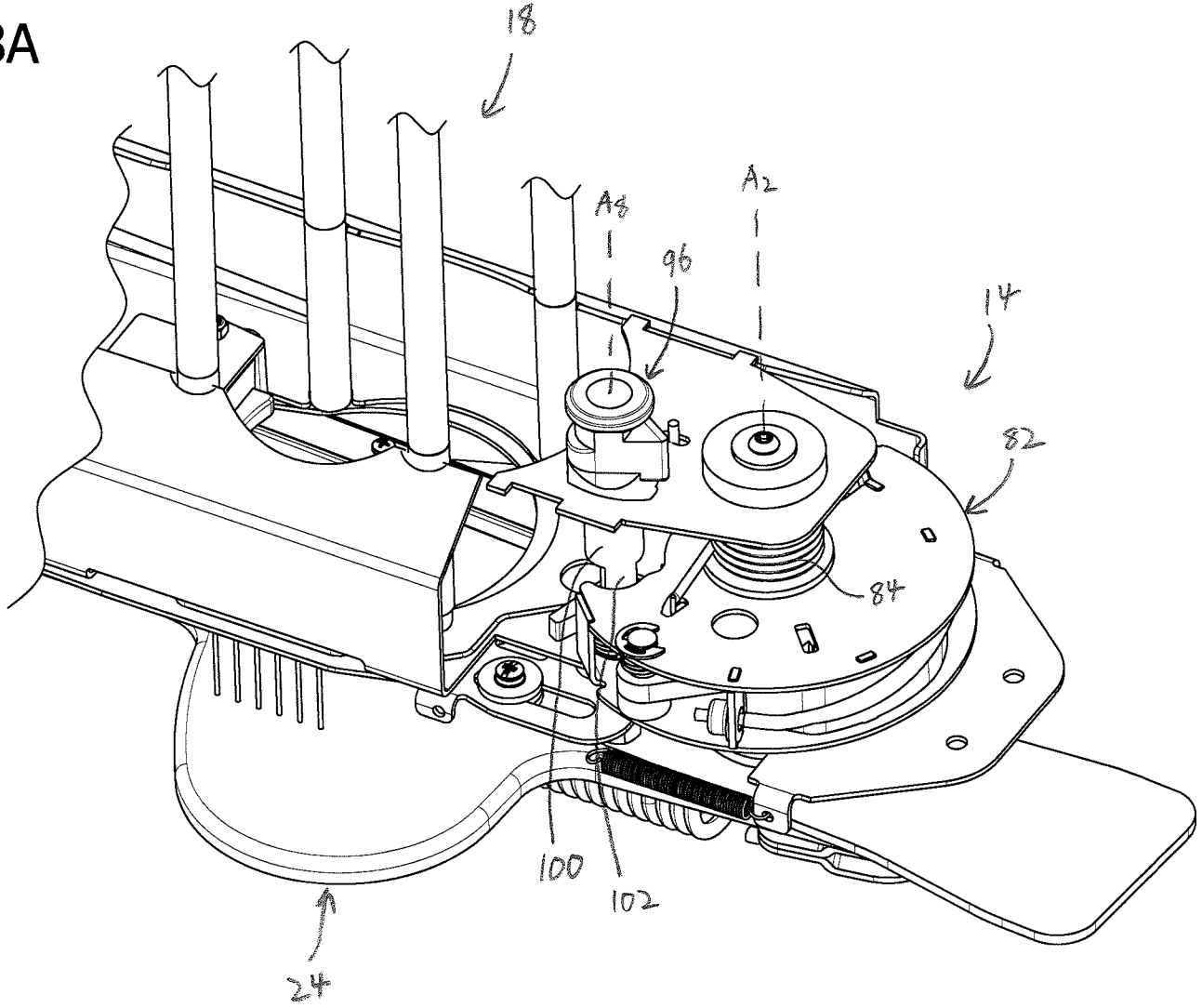
FIG. 18A is similar to FIG. 17A, with portions of the shooting target thrower hidden from view or cut away to show interior details.
Figure 18B:
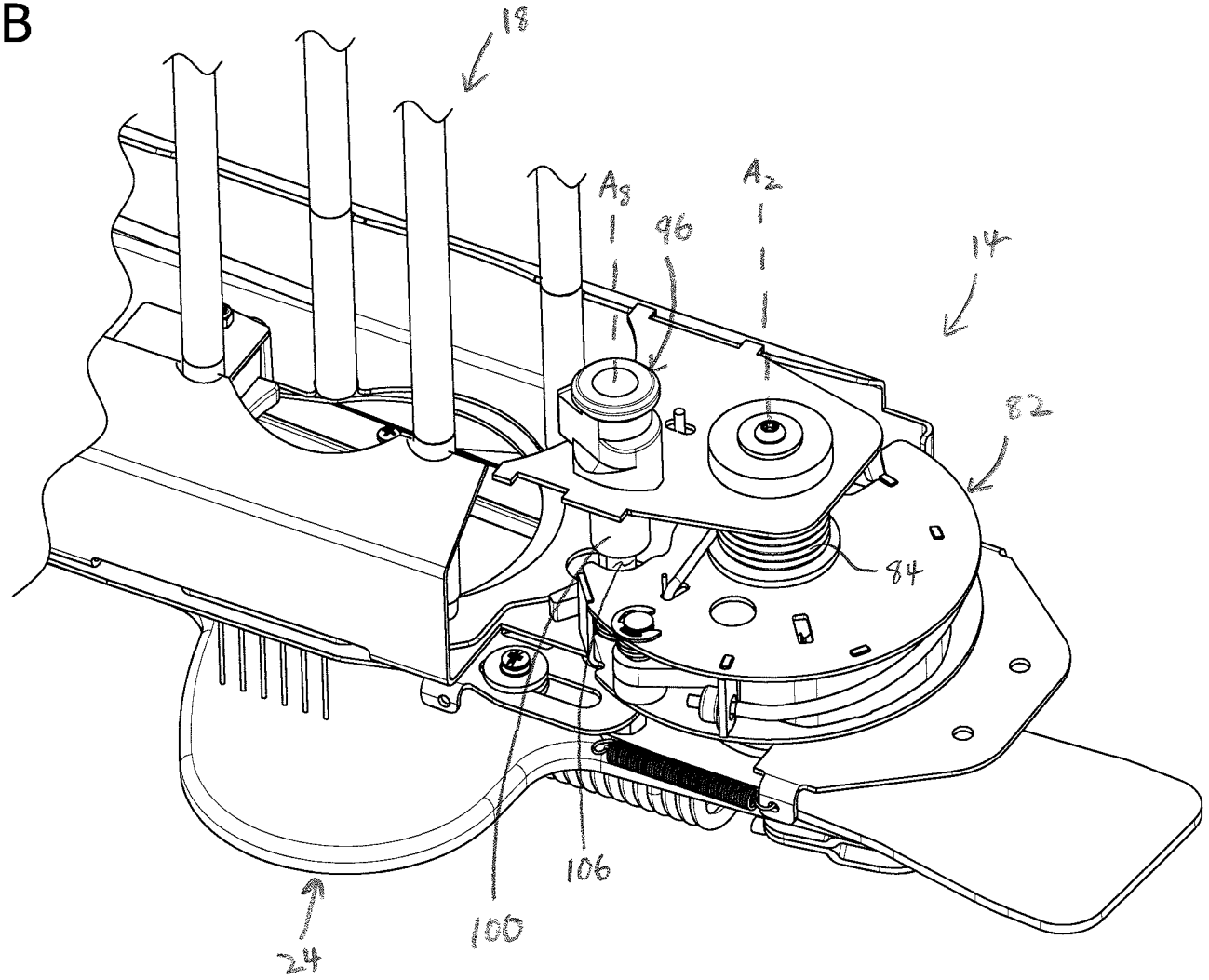
FIG. 18B is similar to FIG. 17B, with portions of the shooting target thrower hidden from view or cut away to show interior details.
Figure 19:
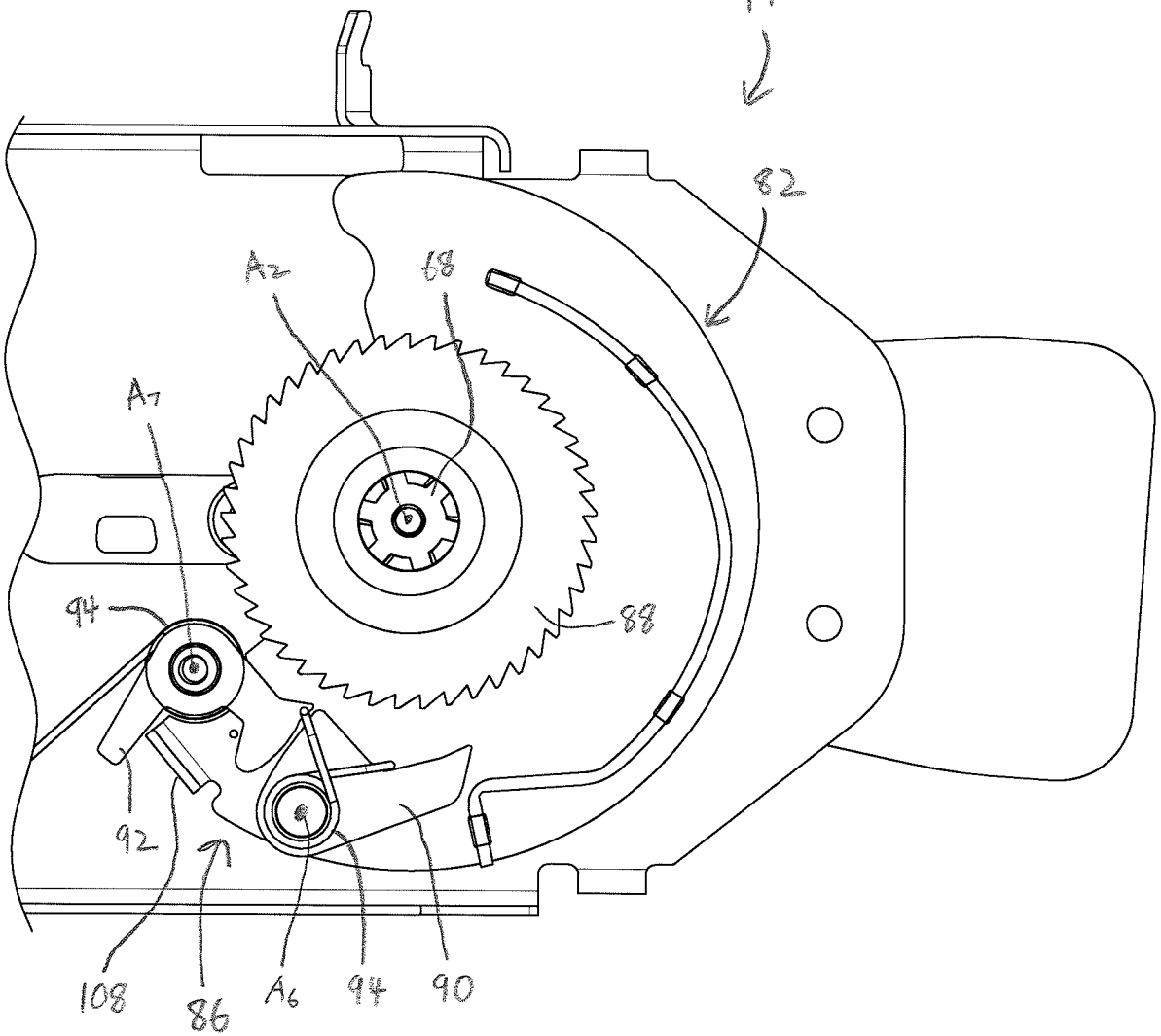
FIG. 19 is a top view of the ratchet, with pawls of the ratchet in a ratchet wheel disengaged position.
Figure 20:
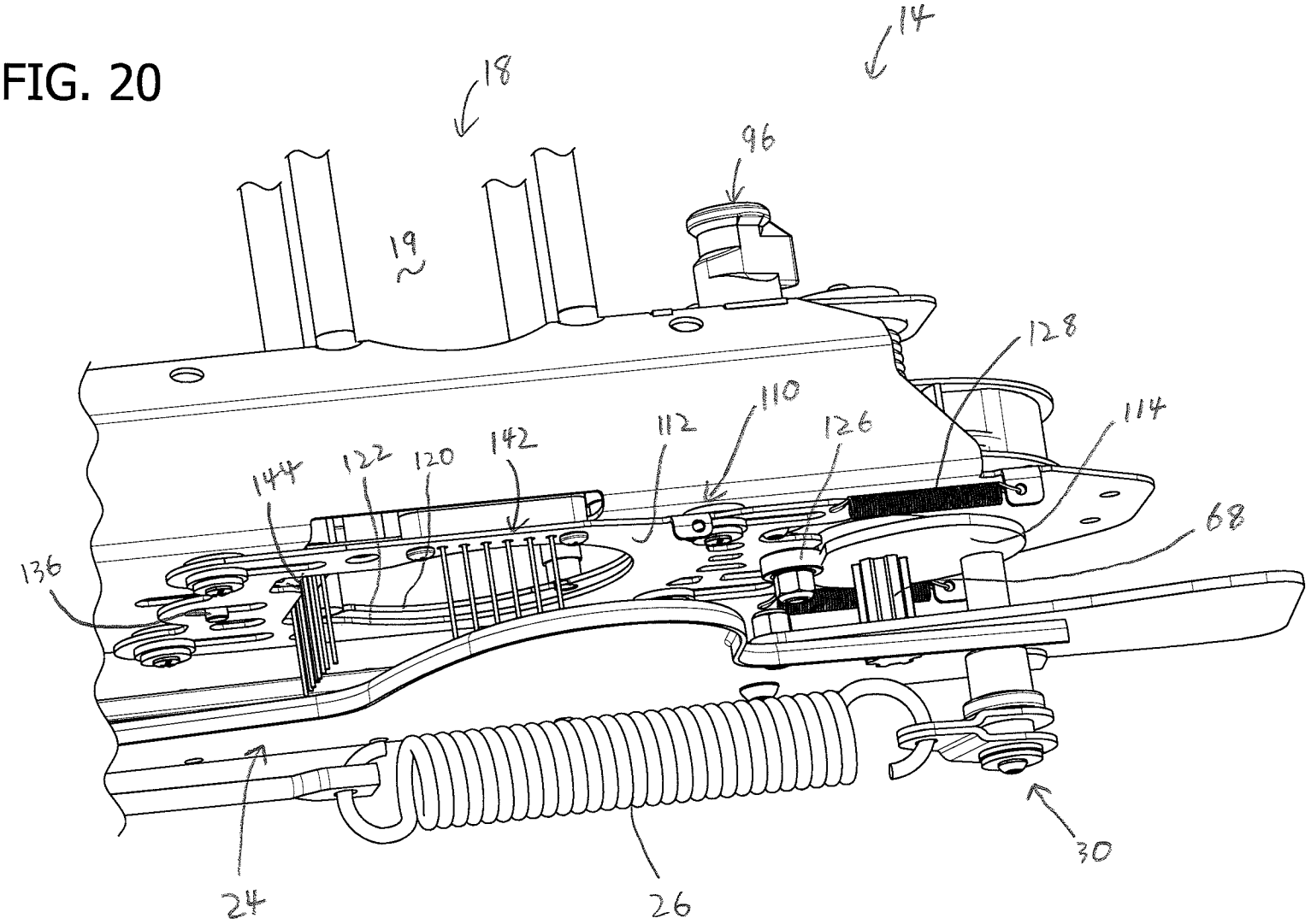
FIG. 20 is a perspective of a target feeder of the shooting target thrower, with portions of the shooting target thrower hidden from view to show interior details.

Referring to FIGS. 17A-19, the ratchet 86 includes a ratchet actuator 96. The ratchet actuator 96 engages and disengages the ratchet 86 with the throwing arm 24. The charging pawl 90 and the holding pawl 92 are each movable (e.g., pivotable about their respective axes $A_6$, $A_7$) between a ratchet wheel engaged position (FIG. 16A) and a ratchet wheel disengaged position (FIG. 19). In the ratchet wheel engaged position, each respective pawl 90, 92 is engaged with the ratchet wheel 88. In the ratchet wheel disengaged position, each respective pawl 90, 92 is disengaged (e.g., spaced apart from) the ratchet wheel 88. When the pawls 90, 92 are in the ratchet wheel disengaged position, the throwing arm 24 is free to rotate in any direction (first or second direction $D_1$, $D_2$) about the throwing axis $A_2$. Typically, the throwing arm 24 will freely rotate to the non-cocked position under the force of the throwing spring 26 when the ratchet 86 is disengaged.

Figure 17A:
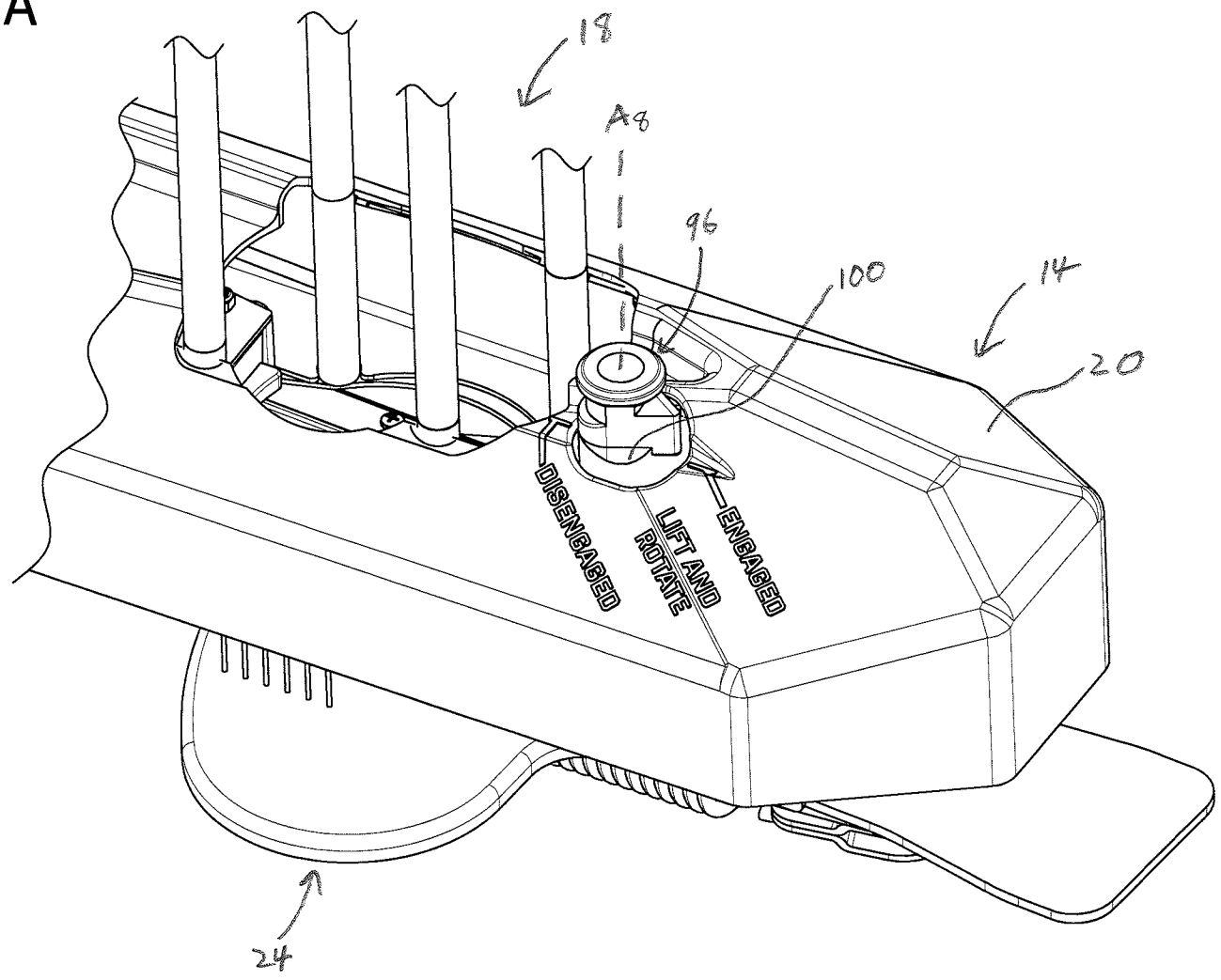
FIG. 17A is a perspective of a head of the shooting target thrower, with a ratchet actuator in a ratchet engaged position.
Figure 17B:
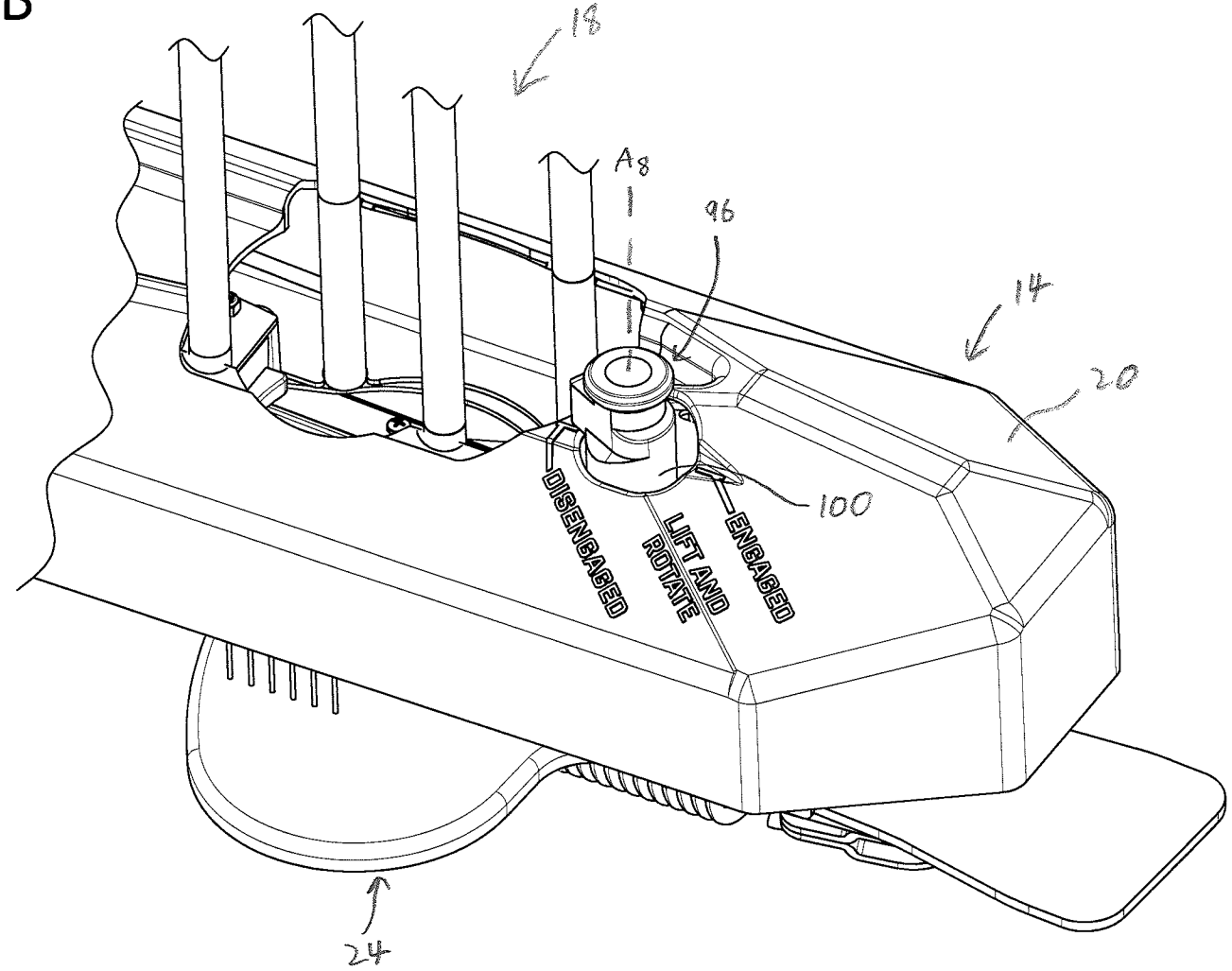
FIG. 17B is similar to FIG. 17A, with the ratchet actuator in a ratchet disengaged position.

The ratchet actuator 96 is operatively coupled to the charging and holding pawls 90, 92 to move these pawls between the ratchet wheel engaged and disengaged positions. The ratchet actuator 96 is movable (e.g., rotatable) between a ratchet engaged position (FIG. 17A) and a ratchet disengaged position (FIG. 17B). Generally speaking, the charging and holding pawls 90, 92 are both in the ratchet wheel engaged position when the ratchet actuator 96 is in the ratchet engaged position and are both in the ratchet wheel disengaged position when the ratchet actuator is in the ratchet disengaged position.

In the illustrated embodiment, the ratchet actuator 96 comprises a knob 98 and a stop 100 connected to the knob. The stop 100 comprises a shaft. Rotation of the knob 98 about an actuator axis $A_8$ rotates the stop 100 about the actuator axis. In the illustrated embodiment the actuator axis $A_8$ is coextensive with the second pawl axis $A_7$, although in other embodiments these two axes can be spaced part. In one embodiment, the knob 98 is biased downward by a spring (not shown). In this embodiment, the knob 98 can be pulled upward to move the ratchet actuator 98 from a locked position, where the ratchet actuator is inhibited from rotating between the ratchet engaged and disengaged positions, to an unlocked position, where the ratchet actuator 98 is free to rotate between the ratchet engaged and disengaged positions. The knob 98 and head 14 (e.g., shroud 20) may include corresponding indicia, such as arrows, lines, words (e.g., "engaged" and "disengaged"), etc., to visually indicate when the ratchet actuator 96 is in the ratchet engaged and disengaged positions. The stop 100 includes a stop surface 102 and a recess 106. The recess 106 is generally opposite the stop surface 102.

During normal operation, where the target thrower 10 is used to throw the target T, the ratchet actuator 96 is in the ratchet engaged position. In this position, the stop surface 102 is arranged relative to the pulley 82 such that the pulley engages the first stop surface when the pulley is in its initial position. In other words, the pulley 82 contacts the stop 100 and is held in its initial position by the stop 100. The stop 100 prevents further rotation of the pulley 82 in the second direction $D_2$ when the pulley is returning toward its initial position during the return stroke of the charge pedal 34. The pulley 82 includes (broadly, supports) a holding pawl mover or flange 108. For reasons that will become apparent, the stop 100 prevents the holding pawl mover 108 from engaging the holding pawl 92 when the ratchet actuator 96 is in the ratchet engaged position.

To disengage the ratchet, the ratchet actuator 96 is placed in the ratchet disengaged position. In this position, the stop 100 is arranged relative to the pulley 82 such that the recess 106 receives the pulley. This allows the pulley 82 to rotate a few extra degrees in the second direction $D_2$ past the initial position into the recess 106. The holding pawl mover 108 is arranged to engage and rotate the holding pawl 92 when the pulley 82 moves the few extra degrees past the initial position. As shown in FIGS. 18B and 19, as the pulley 82 rotates the extra amount past the initial position, the holding pawl mover 108 engages an arm of the holding pawl 92. This causes the holding pawl 92 to pivot about the second pawl axis $A_7$ from its ratchet wheel engaged position to its disengaged position. As a result, the holding pawl 92 moves away from the ratchet wheel 88. As the holding pawl 92 rotates away from the ratchet wheel 88 (due the force of the return spring 84), the holding pawl contacts the charging pawl 90 (FIG. 19). This causes the charging pawl 90 to pivot about the first pawl axis $A_6$ from its ratchet wheel engaged position to disengaged position. As a result, the charging pawl 90 also moves away from the ratchet wheel 88. Eventually, continued rotation of the holding pawl 92 creates an interference with the charging pawl 90 that prevents the holding pawl from further rotating about the second pawl axis $A_7$. In turn, this interference prevents further rotation of the pulley 82 in the second direction $D_2$. Thus, the pulley 82, under the bias of the return spring 84, holds the charging and holding pawls 90, 92 in their respective ratchet wheel disengaged positions. With both pawls 90, 92 disengaged from the ratchet wheel 88, the only force acting on the throwing arm 24 is the throwing spring 26. This permits the throwing arm 24 to move to the non-cocked position, via the throwing spring 26, where the throwing spring is under its least amount of tension. This may be desirable to perform maintenance on the throwing arm 24 (e.g., replace the throwing strip 62) and/or facilitate the collapsing of the target thrower 10 for storage (e.g., disconnect the throwing spring 26 from the frame 12).

Referring to FIGS. 20-25, the target thrower 10 includes a target feeder 110 configured to feed each target T held in the hopper 18 to the throwing arm 24. The target feeder 110 dispenses the targets T one at a time from the bottom of the stack to the throwing arm 24. The hopper 18 is aligned with an opening 120 (e.g., a first or housing opening) of the housing of the head 14. The opening 120 is sized and shaped to permit the targets T to move (e.g., fall) therethrough toward the throwing arm 24. The target feeder 110 includes a feed door 112 (broadly, a first target retainer) and a feed cam 114. The feed door 112 is arranged to release the bottom-most target T from the stack in the hopper 18 toward the throwing arm 24. The feed door 112 includes a feed door opening 122 (e.g., a second or target opening). The feed door opening 122 is sized and shaped to permit the targets T to move (e.g., fall) therethrough toward the throwing arm 24. In the illustrated embodiment, the feed door 112 generally underlies the opening 120 of the housing of the head 14. The feed door 112 includes a support portion or platform 124. The platform 124 is generally disposed between the feed door opening 122 and the throwing axis $A_2$. The feed door 112 is movably coupled to the housing of the head 14. The feed door 112 is movable between a first or feed door retaining position (FIGS. 23A-B) and a second or feed door release position (FIGS. 21A-B). In the feed door retaining position, the feed door 112 is arranged with respect to the hopper 18 (specifically, the stack of targets T) to retain the targets T. Specifically, the platform 124 is at least partially aligned with and underlying the opening 120 of the head 14 to support the stack of targets T thereon. In the feed door release position, the feed door 112 is arranged to release or dispense the targets T (e.g., the bottom-most target in the stack) toward the throwing arm 24. Specifically, the feed door opening 122 is aligned with and underlying the opening 120 of the head 14 to permit the targets T to move (e.g., fall) therethrough toward the throwing arm 24. In other words, the feed door opening 122 becomes aligned with the bottom-most target T in the stack in the hopper 18. In the illustrated embodiment, the feed door 112 moves linearly or in a radial direction relative to the throwing axis $A_2$ between the feed door retaining and release positions. The feed door 112 includes a plurality of slots 116 through which fasteners 118 connecting the feed door to the housing of the head 14 extend. The slots 116 permit the feed door 112 to slide relative to the fasteners 118 between the feed door retaining and release positions.

The feed cam 114 is operatively connected to the feed door 112 such that the feed door moves in response to movement of the feed cam. The feed cam 114 is rotatable responsive to rotation of the shaft 68. In the illustrated embodiment, the feed cam 114 is fixed to and rotatable with the shaft 68 such that the feed cam rotates about the throwing axis $A_2$. Thus, the feed cam 114 rotates with the throwing arm 24. The feed door 112 includes a bearing 126 that is engaged with and follows the feed cam 114. Accordingly, the feed door 112 follows or is moved by the feed cam. The bearing 126 (broadly, the feed door 112) is biased toward the feed cam 114 (broadly, toward the feed door release position) with one or more feed door springs 128. The feed door springs 128 ensures the feed door 112 remains engaged with the feed cam 114 as the feed cam rotates. Rotation of the feed cam 114 moves the feed door 112 between the feed door retaining and release positions. The feed door 112 moves toward the shaft 68 or throwing axis $A_2$ as the feed door moves from the feed door retaining position toward the feed door release position. Likewise, the feed door 112 moves away from the shaft 68 or throwing axis $A_2$ as the feed door moves from the feed door release position toward the feed door retaining position.

Figure 23A:
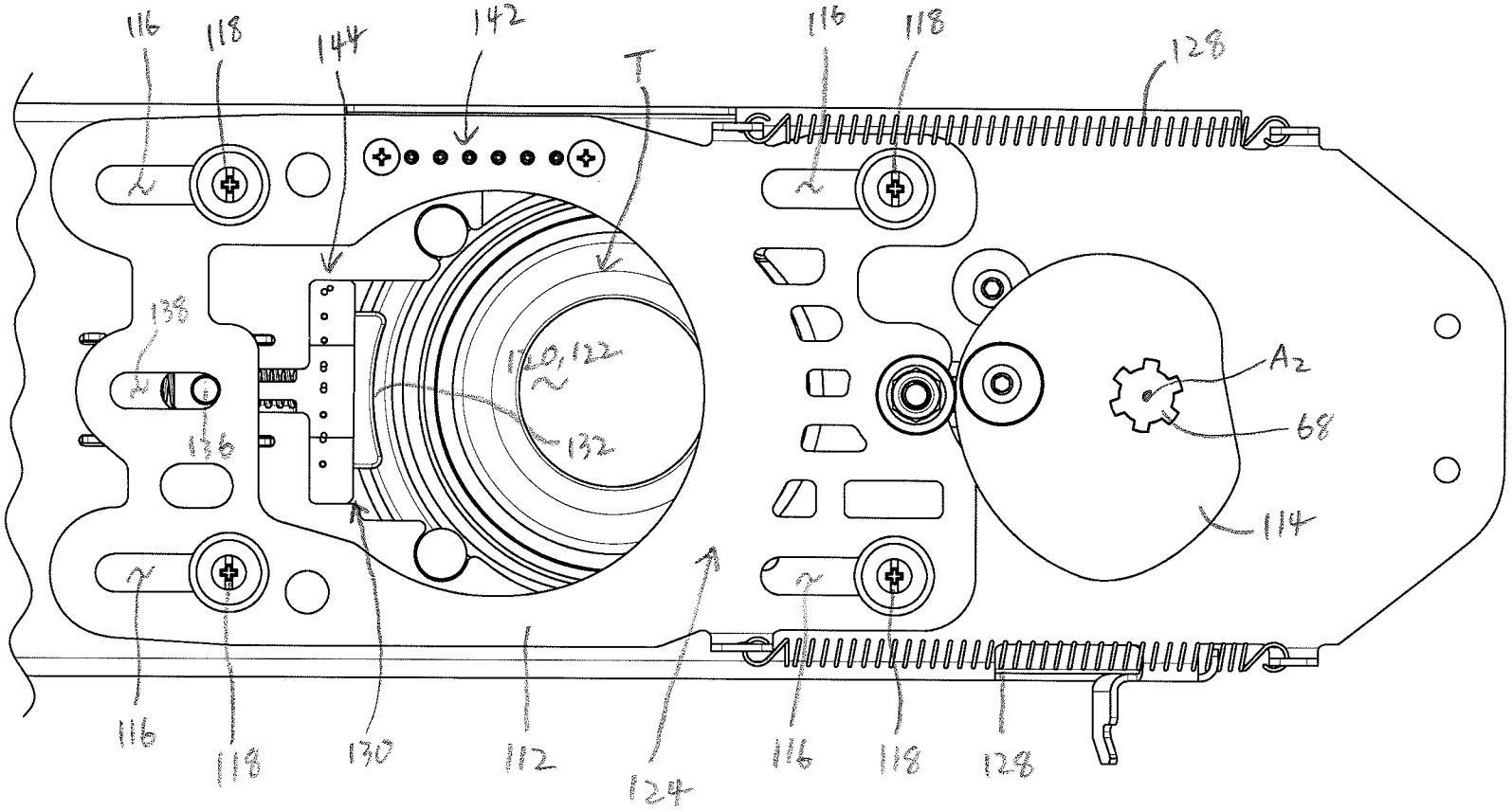
FIG. 23A is a bottom view of the target feeder with the throwing arm in the non-cocked position.
Figure 23B:
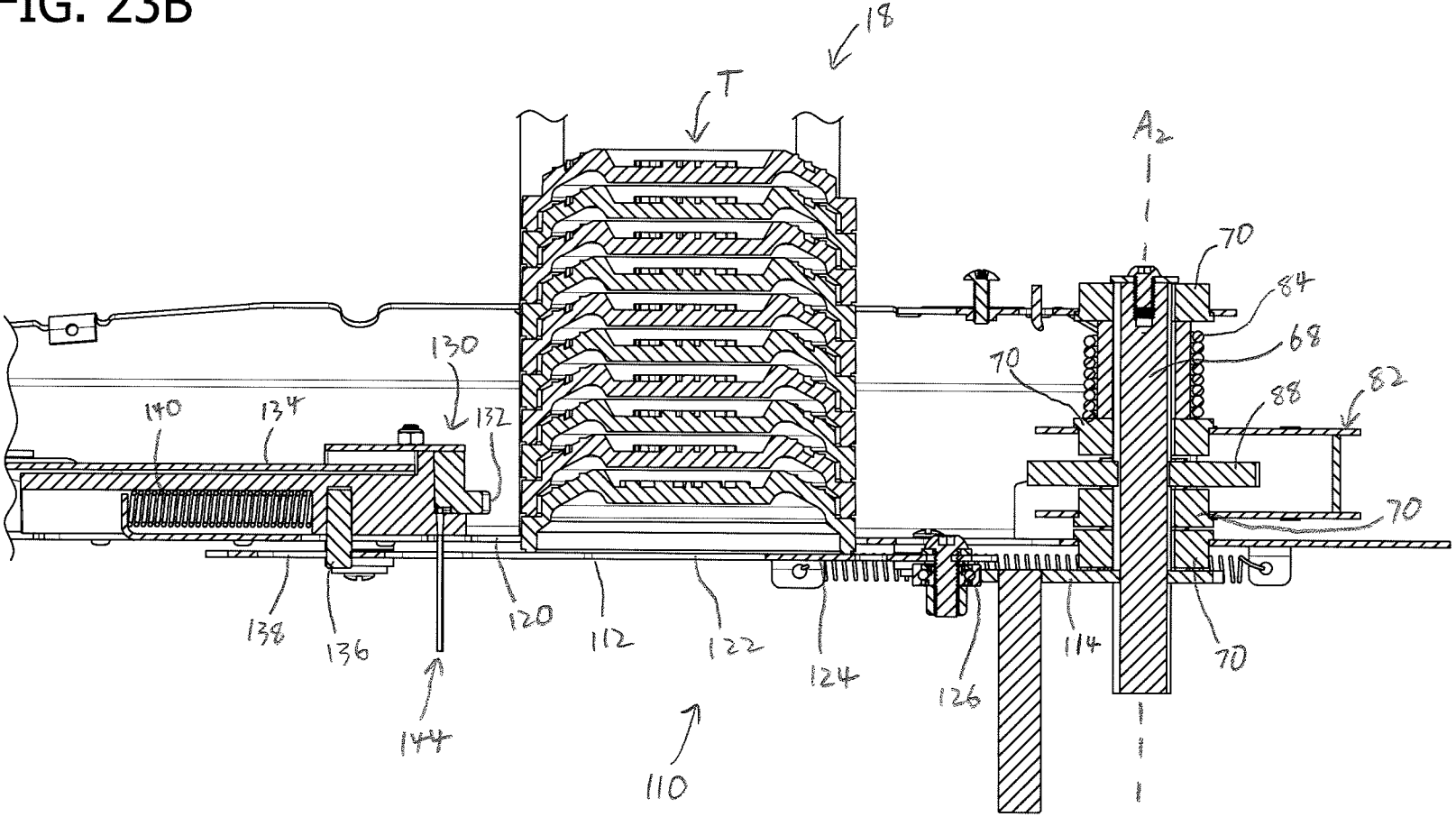
FIG. 23B is an elevation of the target feeder with the throwing arm in the non-cocked position.

The target feeder 110 includes a feed foot 130 (broadly, a second target retainer). The feed foot 130 is configured to retain the targets T in the hopper 18. The feed foot 130 and the feed door 112 work together to dispense the targets T one at a time from the hopper 18 to the throwing arm 24. The feed foot 130 includes a target engagement surface 132 facing the targets T in the hopper 18 (e.g., facing the interior 19 of the hopper). The target engagement surface 132 selectively engages the targets T in the hopper 18 to retain the targets. The feed foot 130 is movably coupled to the housing of the head 14. The feed foot 130 is movable between the first or feed foot retaining position (FIGS. 21A-B) and a second or feed foot release position (FIGS. 23A-B). In the feed foot retaining position, the feed foot 130 is arranged to retain the targets T. Specifically, the target engagement surface 132 engages the second-to-bottom target T in the stack of the targets to hold the second-to-bottom target and any targets stacked thereon in the hopper 18 and prevent these targets from moving (e.g., falling) toward the throwing arm 24. The feed foot 130 generally squeezes or clamps the second-to-bottom target T between the target engagement surface 132 and an opposite side of the hopper 18. Thus, in the feed door retaining position, the feed foot 130 prevents the entire stack of targets T from falling through the feed door 112 (e.g., opening 122 thereof) when the feed door is in the feed door release position. In the feed foot release position, the feed foot 130 is arranged to release the targets T. Specifically, the target engagement surface 132 is spaced from the targets T (e.g., the second-to-bottom target) to permit the targets T to move (e.g., fall) toward the feed door 112 and the throwing arm 24. In the illustrated embodiment, the feed foot 130 moves linearly or in the radial direction relative to the throwing axis $A_2$ between the feed foot retaining and release positions. The feed foot 130 is mounted on a feed foot support 134 which permits the feed foot to slide between the feed foot retaining and release positions. In the illustrated embodiment, the feed foot 130 is disposed adjacent a first end (e.g., outer radial end relative to the throwing axis $A_2$) of the feed door 112 and the shaft 68 is disposed adjacent an opposite second end (e.g., inner radial end) of the feed door. In other words, the feed foot 130 is across the feed door opening 122 from the throwing axis $A_2$ and moves toward the throwing axis to engage the stack of targets T. This arrangement permits a compact configuration of the target feeder 110.

The feed foot 130 is operatively connected to the feed door 112 such that the feed foot moves in response to movement of the feed door. Thus, the feed foot 130 is operatively connected to the feed cam 114 such that rotation of the feed cam causes the feed foot to move. The feed foot 130 includes a pin 136 disposed in (e.g., extends through) a feed foot slot 138 in the feed door 112. This ties the feed foot 130 to the feed door 112 so that the feed foot will move with the feed door at certain times when the pin 136 is engaged by a portion of the feed door defining an end of the feed foot slot 138. Accordingly, the feed foot 130 follows or is moved by the feed door 112. The feed foot 130 is biased toward the targets 19 (e.g., the interior 19 of the hopper 18) with a feed foot spring 140. In other words, the feed foot spring 140 biases the feed foot 130 toward the feed foot retaining position. In the illustrated embodiment, the feed foot spring 140 biases the feed foot 130 radially inward such that the pin 136 will generally be disposed at the radial inward end of the slot 138. Movement of the feed door 112 moves the feed foot 130 between the feed foot retaining and release positions. The feed foot 130 moves toward the shaft 68 or throwing axis $A_2$ as the feed foot moves from the feed foot release position toward the feed foot retaining position. Likewise, the feed foot 130 moves away from the shaft 68 or throwing axis $A_2$ as the feed foot moves from the feed foot retaining position toward the feed foot release position.

The feed foot 130 and the feed door 112 work together to dispense the targets T one at a time from the hopper 18 to the throwing arm 24. During the throwing cycle, at certain times the feed door 112 and the feed foot 130 move together and at other times the feed door moves independently of the feed foot. Generally, the feed foot 130 is disposed in the feed foot retaining position when the feed door 112 is disposed in the feed door release position. Similarly, generally the feed foot 130 is disposed in the feed foot release position when the feed door 112 is disposed in the feed door retaining position.

The target thrower 10 includes one or more brushes or brush segments (broadly, target guides or pushers) for controlling the positioning of the target T on the throwing arm 24. In the illustrated embodiment, the target feeder 110 includes a first brush segment 142 and a second brush segment 144. The first and second brush segments 142, 144 may be part of the same brush or may be separate brushes, as illustrated. The first and second brush segments 142, 144 retain the target T in the correct position relative to the throwing arm 24 and help guide the target into place on the throwing arm. The first brush segment 142 is arranged to bring the target T into engagement with the engagement surface 60 of the throwing arm 24. The second brush segment 144 is arranged to set a radial distance of the target T from the throwing axis $A_2$. Desirably, the first and second brush segments 142, 144 are movable with respect to one another. This allows the first and second brush segments 142, 144 to better control the target's T movement and positioning on the throwing arm 24. In the illustrated embodiment, the first brush segment 142 is mounted (broadly, coupled) to the feed door 112. Accordingly, the first brush segment 142 moves with the feed door 112. The first brush segment 142 is disposed on the leading side (relative to the first direction $D_1$) of the feed door opening 122. The second brush segment 144 is mounted (broadly, coupled) to the feed foot 130. Accordingly, the second brush segment 144 moves with the feed foot 130. When the throwing arm 24 rotates to throw the target T, the throwing arm generally pushes past and moves the first and second brush segments 142, 144 out of the way.

The target feeder 110 operates responsive to rotation of the shaft 68. The operation of the target feeder 110 is coordinated with respect to the cocking of the throwing arm 24. Accordingly, moving the charge pedal 34 during the charging stroke not only moves the throwing arm 24 to the cocked position but also dispenses or feeds a target T from the hopper 18 to the throwing arm. Thus, the throwing arm 24 has a target T thereon when in the cocked position. Referring to FIGS. 21A-25, the operational sequence of the target feeder 110 will now be described. Starting at FIGS. 24A-B, the target thrower 10 has just thrown a target T and the throwing arm 24 has come to rest in the thrown position. In this position, the feed door 112 is in the feed door retaining position and the feed foot 130 is in or near the feed foot release position. Therefore, the stack of targets T in the hopper 18 rests on the platform 24 of the feed door 112. At this moment, the charge pedal 34 is ready to be engaged to start the next throwing cycle.

Figure 21A:
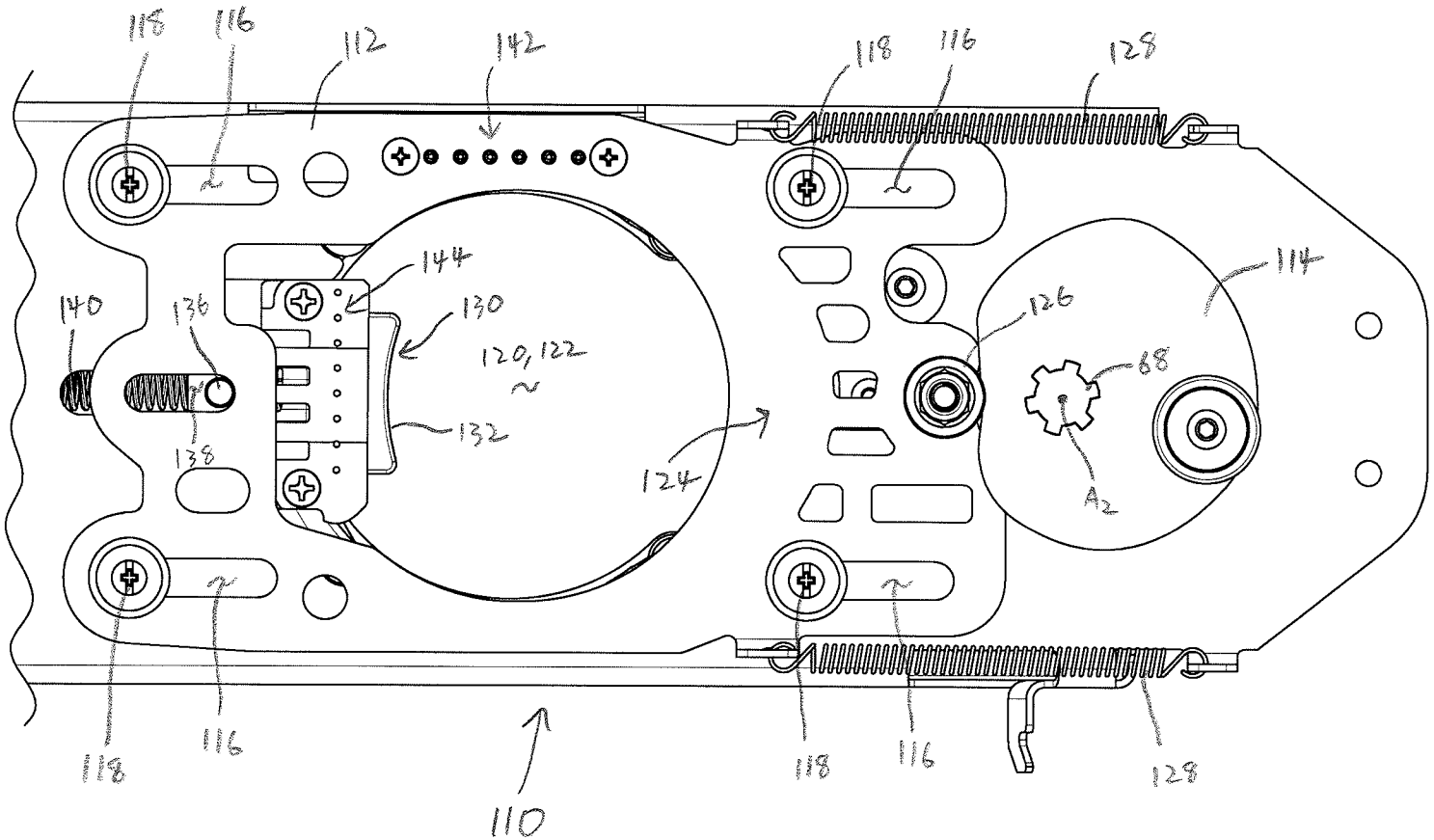
FIG. 21A is a bottom view of the target feeder with the throwing arm in the cocked position.
Figure 21B:
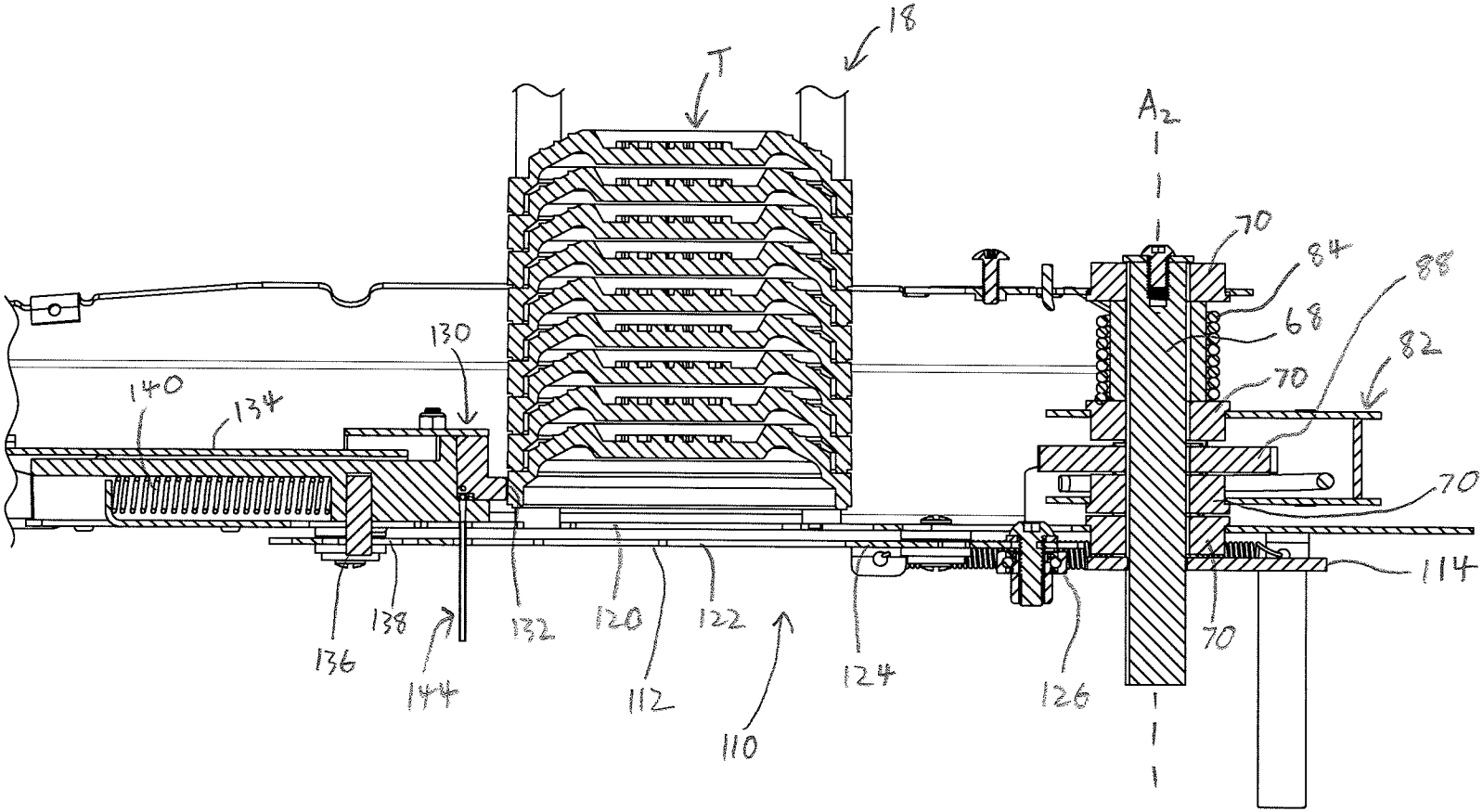
FIG. 21B is an elevation of the target feeder with the throwing arm in the cocked position.
Figure 25:
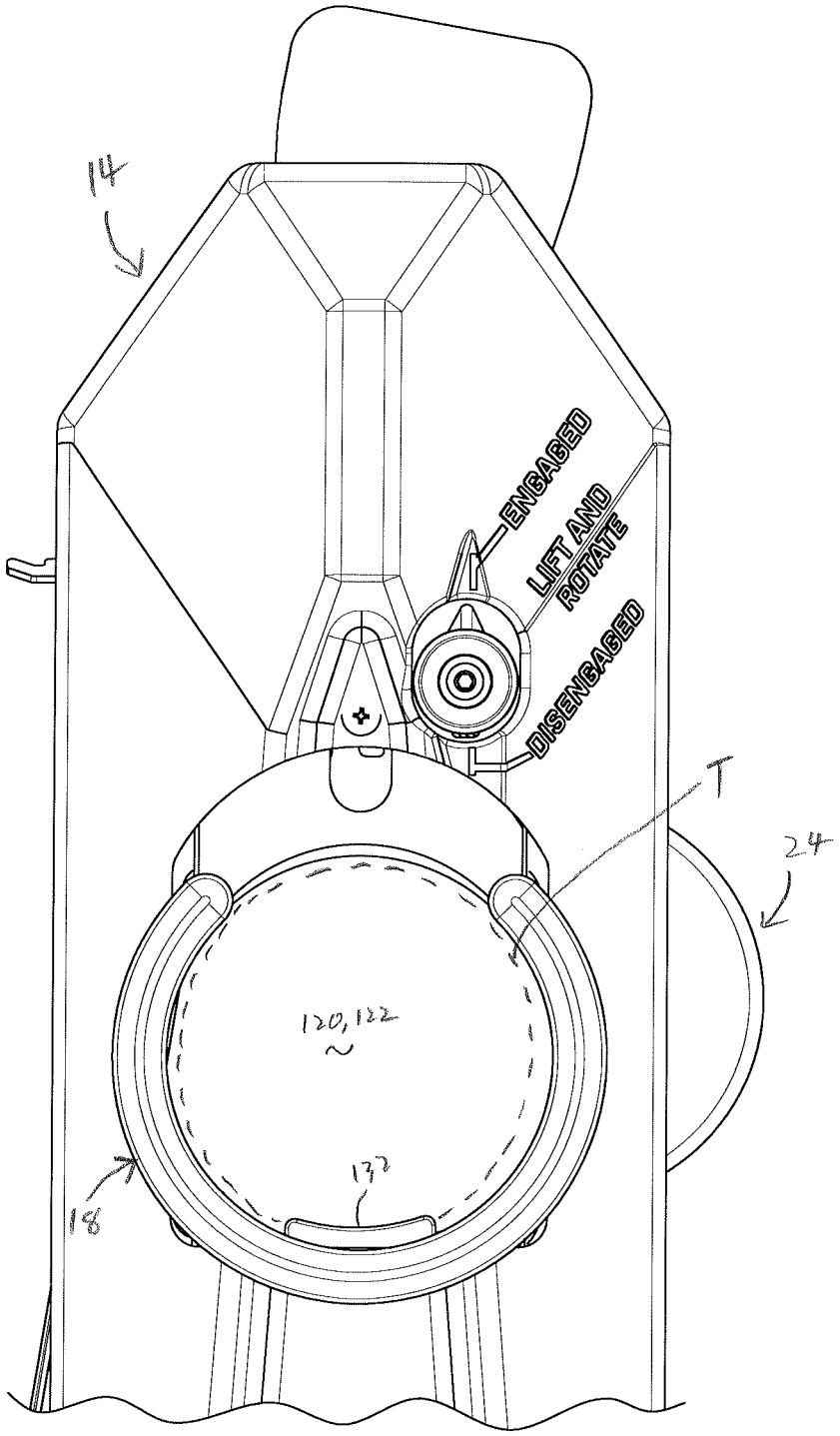
FIG. 25 is a top view of the shooting target thrower showing the position of the throwing arm as the target feeder releases a target.

To throw another target T, the operator presses the charge pedal 34 (e.g. initiates the charging stroke) to rotate the throwing arm 24 toward the cocked position. As the throwing arm 24 rotates, the feed cam 114 also rotates about the throwing axis $A_2$, which permits the feed door 112 to move (under the influence of the feed door springs 128) toward the feed door release position. This movement of the feed door 112 also permits the feed foot 130 to move (under the influence of the feed foot spring 140) toward the feed foot retaining position (if not there already). The feed foot 130 reaches the feed foot retaining position before the feed door 112 reaches the feed door release position. The target engagement surface 132 of the feed foot 130 contacts the second-to-bottom target T in the stack and retains it-thus holding the other targets above in the stack. It is understood the target engagement surface 132 may contact the second-to-bottom target T before the charge pedal 34 is actuated due to the ending position of the throwing arm 24 after the clay is thrown. After the feed foot 130 reaches the feed foot retaining position (FIGS. 21A-B), the feed door 112 continues to move toward the feed door release position. When the feed door 112 reaches the feed door release position, the bottom-most target T (which is not retained by the feed foot 130) drops through the feed door (e.g., aligned openings 120, 122) and down onto the throwing arm 24 (FIGS. 21A-B). As this point, the throwing arm 24 is in the position shown in FIG. 25. The throwing arm 24 is near, but not yet at, the cocked position. The throwing arm 24 (e.g., at least the extended bed 56B) underlies or is situated below the feed door 112 (specifically, the feed door opening 122). Thus, the dispensing or feeding of a target T to the throwing arm 24 is coordinated with the relative angular position of the throwing arm about the throwing axis $A_2$. More specifically, the target feeder 110 is configured to feed the target T to the throwing arm while throwing arm is rotating about the throwing axis $A_2$ toward the throwing arm stop 42 (e.g., toward the cocked position). In other words, the throwing arm stop 42 is arranged to stop the movement of (e.g., engage) the throwing arm 24 after the target feeder 110 feeds the target to the throwing arm. Due to this timing, the throwing arm stop 42 engages and stops the movement of the throwing arm 24 about the throwing axis $A_2$ before the engagement surface 60 of the throwing arm engages the side of the target T. Desirably, the timing is such that the target feeder 110 feeds the target T to the throwing arm 24 as the throwing arm is rotating about the throwing axis $A_2$ before the engagement surface 60 becomes aligned with or underlies the feed door opening 122. As shown in FIG. 25, the extended bed 56B of the throwing arm 24 is arranged to receive at least a portion of the target T when the target is fed by the target feeder 110. The extended bed 56B enables the target feeder 110 to feed the target T to the throwing arm 24 before the throwing arm is in the cocked position. After the target T is dropped by the target feeder 110, the first brush segment 142 engages the target T and prevents the target from rotating with the throwing arm 24. Instead, as the throwing arm 24 continues to rotate toward the cocked position, the first brush segment 142 generally holds the target T so that the target slides on (e.g., over) the bed 56 as the engagement surface 60 moves toward (but does not engage) the target. In addition, after the target T is dropped by the target feeder 110, the second brush segment 144 engages the target T and prevents the target from moving radially outward with respect the throwing arm 24. Further, because the second brush segment 144 is mounted on the feed foot 130 (which is engaged with the second-to-bottom target T when the bottom target is dropped), the second brush segment may guide the bottom target as the bottom target falls from the bottom of the stack to the throwing arm 24. Such guiding is particularly useful to ensure the target is at the correct radial location (e.g., distance from the throwing axis $A_2$) on the throwing arm 24 when the head 14 is set at a large angle relative to the horizontal.

Completely stopping the rotation of the throwing arm 24 with the throwing arm stop 42 before the engagement surface 60 engages the side of the target T dispensed by the target feeder 110 reduces the likelihood of the throwing arm breaking the target T. On certain conventional throwers, such as electric throwers, the target T is fed to the throwing arm before a throwing spring goes over center to allow a brush to push the target against a side of the throwing arm as the throwing spring goes over center. Such an operational sequence is not desirable for the present target thrower 10 because the rotational speed of the throwing arm 24 may be high enough to break the target T as the throwing spring 26 goes over-center. Because the rotational speed of the throwing arm 24 is a direct result of the speed the operator pushes the charge pedal 34 in the charge stroke, the speed the throwing arm 24 rotates toward the cocked position can vary greatly and can occasionally be fast enough to break the target T. Stopping the throwing arm 24 with the throwing arm stop 42 after the throwing arm rotates to a position where the throwing spring 26 is over-center but before the engagement surface 60 engages the side of the target T ensures the speed the throwing arm rotates toward the cocked position has no bearing on whether the target T will break.

Figure 22A:
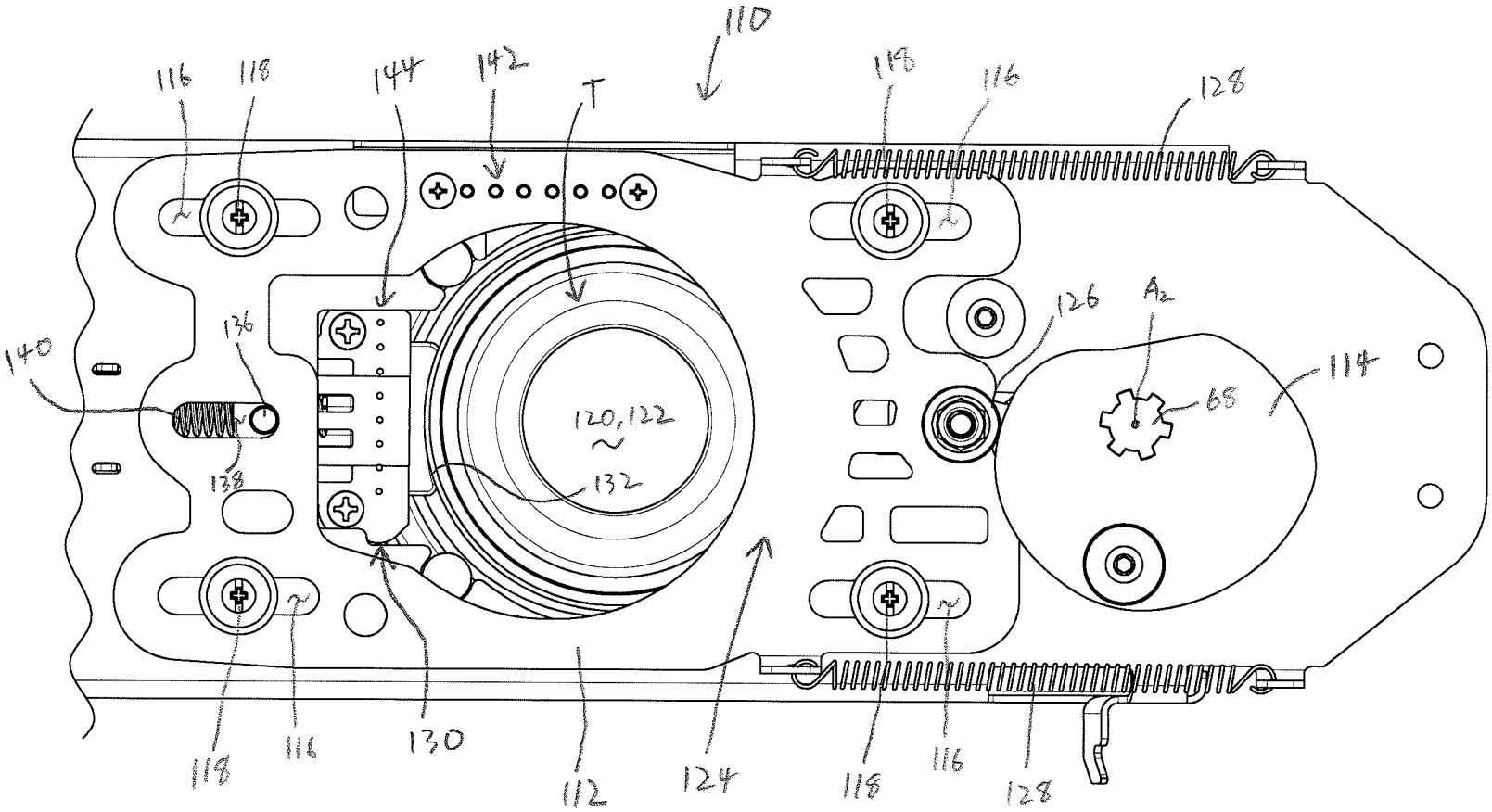
FIG. 22A is a bottom view of the target feeder with the throwing arm throwing a target.
Figure 22B:
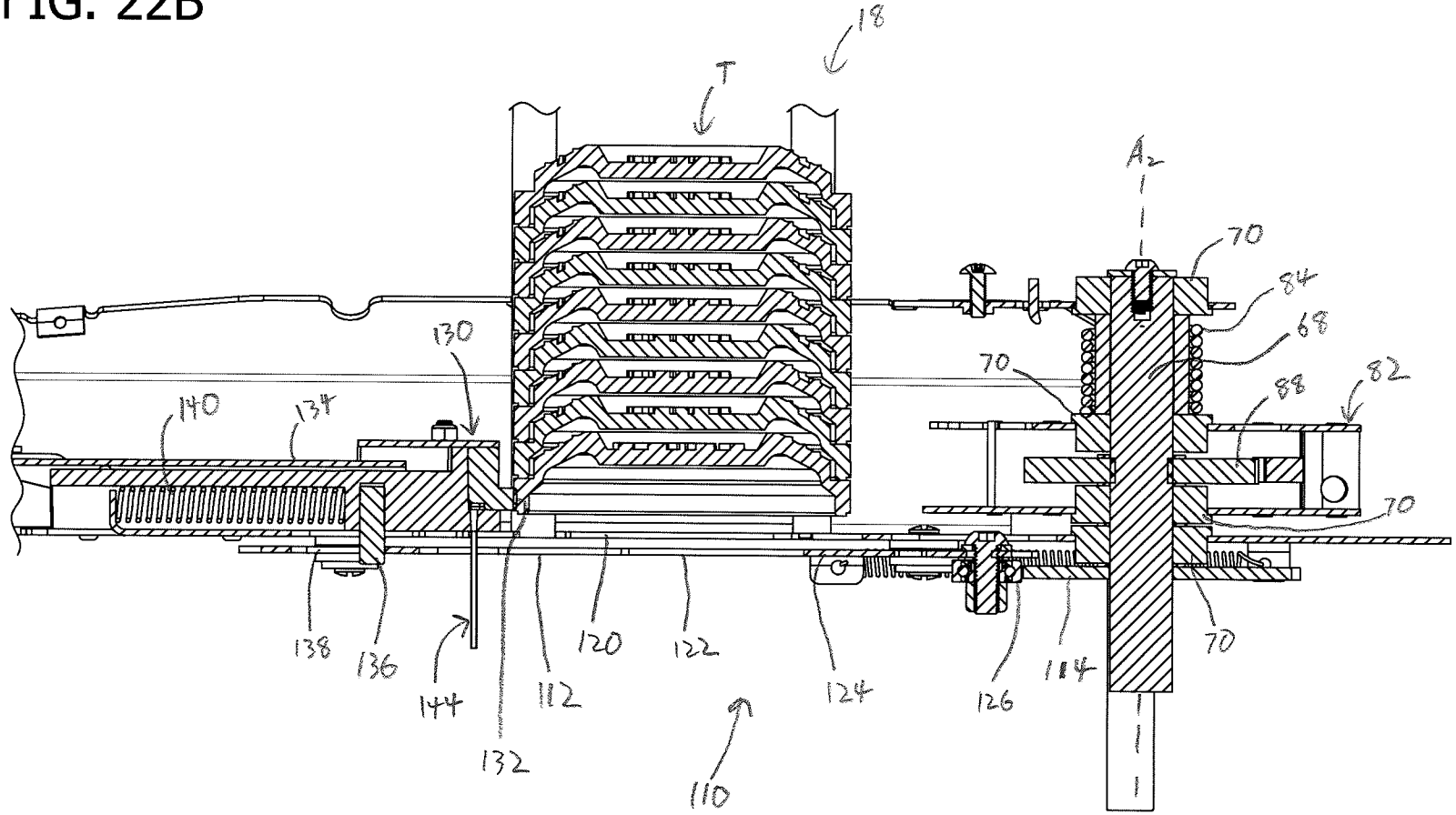
FIG. 22B is an elevation of the target feeder with the throwing arm throwing a target.
Figure 24A:
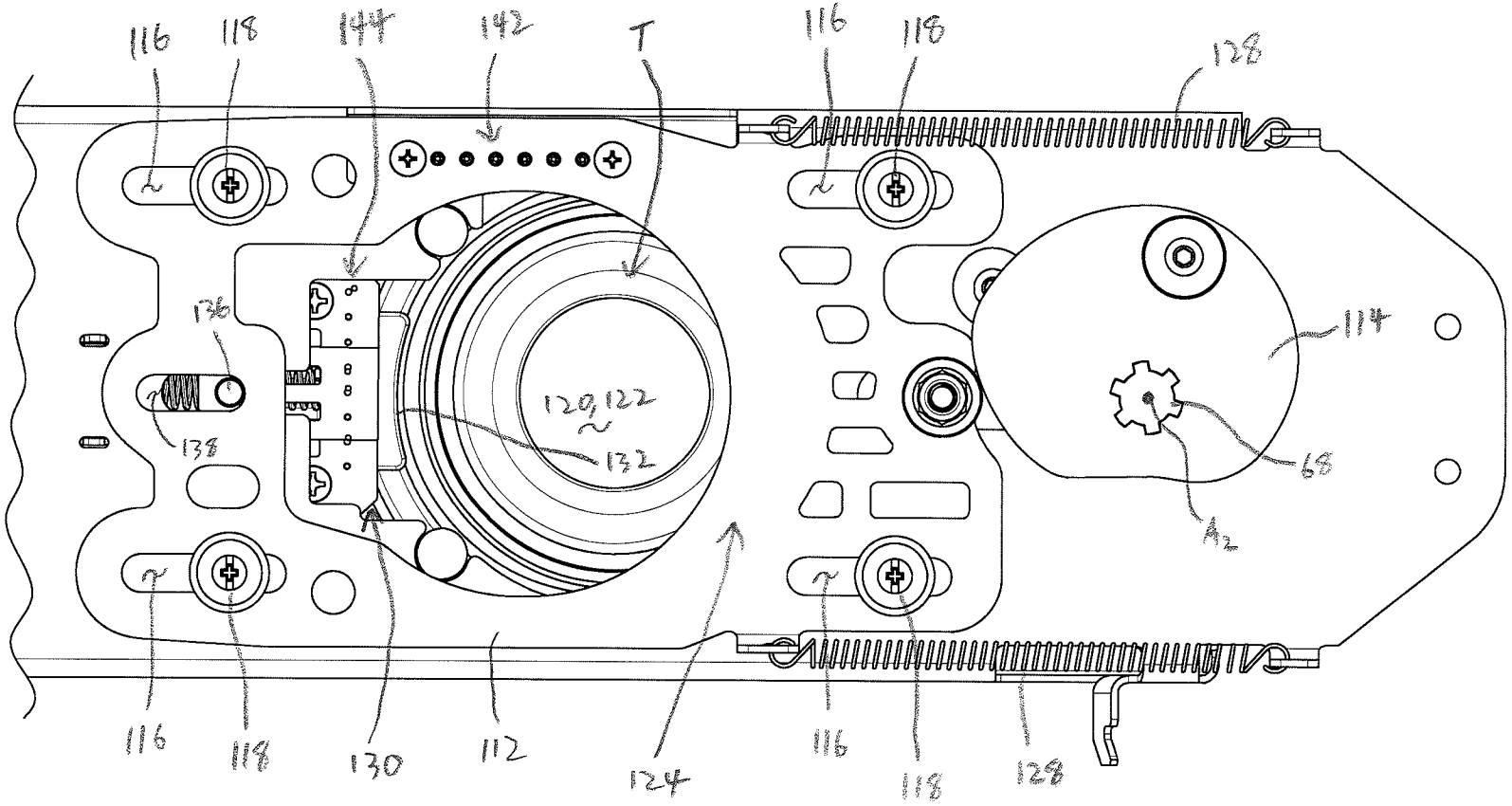
FIG. 24A is a bottom view of the target feeder with the throwing arm in the thrown position.
Figure 24B:
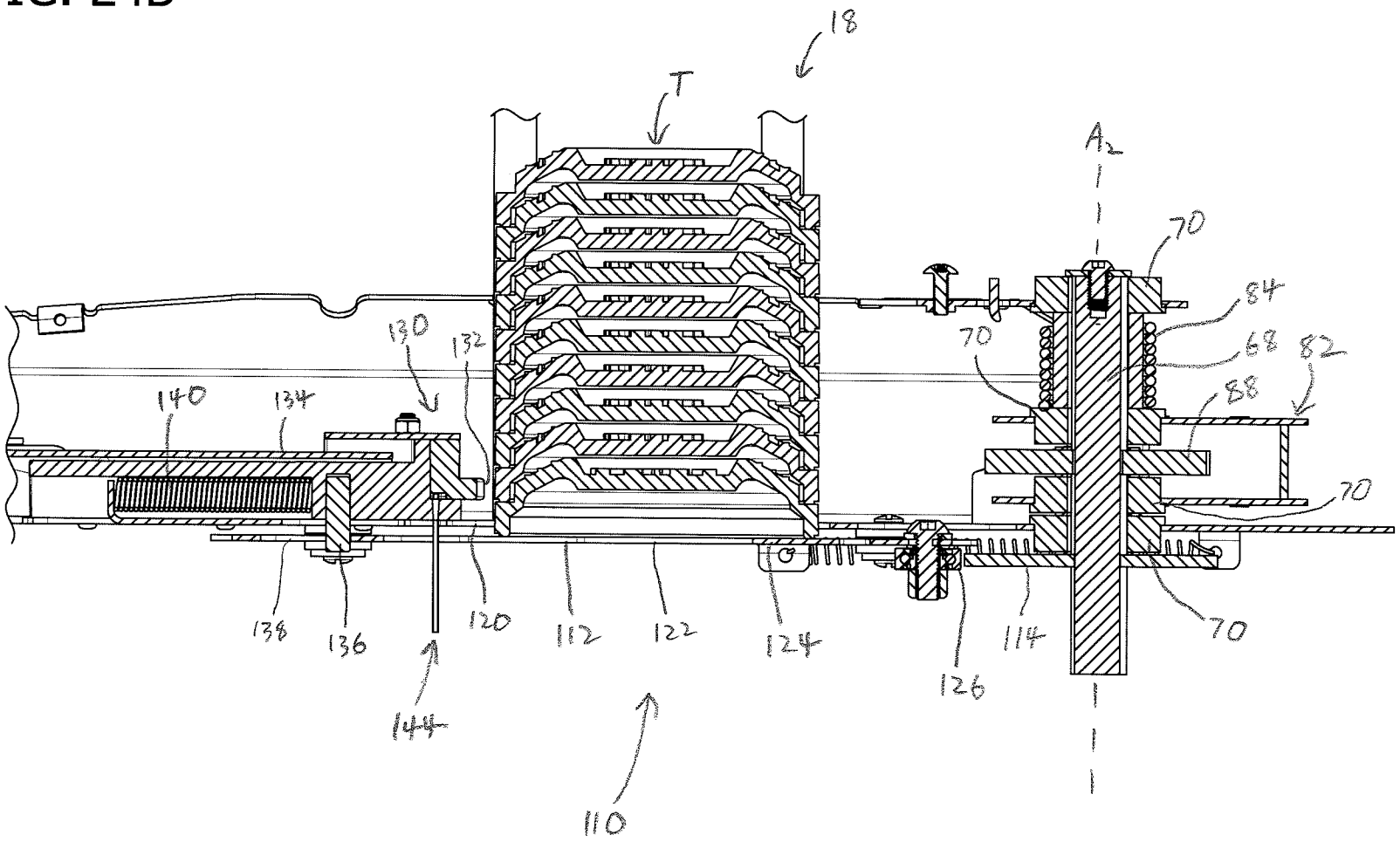
FIG. 24B is an elevation of the target feeder with the throwing arm in the thrown position.

Referring to FIGS. 21A-B, the throwing arm 24 is now in the cocked position. The throwing arm 24 has stopped rotating and is engaged with the throwing arm stop 42. In this position, the feed door 112 is generally still in the feed door release position (the target T having already dropped down while the throwing arm was rotating toward the cocked position as described above) and the feed foot 130 is still in the feed foot retaining position. In addition, the engagement surface 60 of the throwing arm 24 is spaced apart from and has not yet engaged the side of the target T. At this moment, the throwing arm 24 is ready to be released, either by the fire pedal 36 or the charge pedal 34 (when the fire mode actuator 50 is in the fire position). After the throwing arm 24 is released by the throwing arm stop 42, the engagement surface 60 of the throwing arm engages the side of the target T. The first brush segment 142 pushes the target T against the engagement surface 60 of the throwing arm 42 as the throwing arm rotates in the first direction $D_1$ from the cocked position. Referring to FIGS. 22A-B, the throwing arm 24 is in the process of throwing the target T. The throwing arm 24 is rotating about the throwing axis $A_2$ in the first direction $D_1$ from the cocked position to the thrown position. As the throwing arm 24 rotates in the first direction $D_1$ from the cocked position, the feed door 112 begins to move from the feed door release position toward the feed door retaining position. In the position shown in FIGS. 22A-B, the feed door 112 is nearing in the feed door retaining position (and is able to retain the stack of targets T in the hopper), the feed door begins to move the feed foot 130 from the feed foot retaining position to the feed foot release position. In other words, the pin 136 contacts the portion of the feed door 112 defining the inner radial end of the feed foot slot 138 and beings to move radially outward with the slot. Referring to FIGS. 23A-B, the throwing arm 24 has thrown (or is about to throw) the target T and is beginning to move against the force of the throwing spring 26 toward the thrown position. In this position, the feed door 112 is in the feed door retaining position. In addition, the feed door 112 has also moved the feed foot 130 into the feed foot release position. As a result, the feed foot 130 is now disengaged with the stack of targets T in the hopper 18 and the stack has fallen downward so that the new bottom-most target T (formerly the second-to-bottom target) now rests on the platform 124 of the feed door 112. The throwing arm 24 continues to rotate toward and come to a stop in the thrown position (FIGS. 24A-B). With the throwing arm 24 now in the thrown position, the process (e.g., throwing cycle) is ready to be repeated to throw another target T.

In one embodiment, the target thrower 10 is collapsible for easy transport and storage. For example, in one embodiment of a collapsed configuration, the front two legs 16 are pivoted rearward to the underside of the rear leg and the head 14 is pivoted rearward (about the head axis $A_1$) to overlie or rest on the charge pedal 34. The strap 17 can be used to secure the legs 16 and head 14 in this position, such as by wrapping around the target support or having one end secured to a leg and the other end secured to the head. For example, one end of the strap 17 can be looped around one leg 16 and the other end of the strap can have one or more openings to selectively receive a hook on the head 14. In the collapsed configuration, the hopper 18 is removed or disconnected from the head 14 before the head is pivoted rearward. In one embodiment, the space (e.g., length, width, height) taken up by the target thrower 10 in the collapsed configuration is about the same space as a box of 135 targets T. This allows the target thrower 10 to be stored in most retail stores in the same area as the targets and enables the target thrower to fit easily in a seat or trunk of a vehicle.

Referring to FIG. 1, in the illustrated embodiment, the target thrower 10 may include a safety pin 146. The safety pin 146 can be removably inserted through an opening in the head 14. When disposed in the opening of the head 14, the safety pin 146 blocks the travel path of the throwing arm 24 from the cocked position, thereby preventing the throwing arm from inadvertently moving from the cocked position under the force of the throwing spring 26. Before the target thrower 10 throws a target T, the user removes the safety pin 146 from the opening in the head 14.

It is appreciated that the person of ordinary skill in the art is readily able to determine the scope of terms of degree such as, but not limited to, "about," "substantially," and "generally." For example, when a term of degree is used in relation to a numeric value, the person of ordinary skill in the art understands that the term of degree covers an inclusive range of plus or minus 10% of the numeric value, unless clearly indicated or stated otherwise.

When introducing elements of the present invention or the embodiment(s) thereof, the articles "a", "an", "the" and "said" are intended to mean that there are one or more of the elements. The terms "comprising", "including" and "having" are intended to be inclusive and mean that there may be additional elements other than the listed elements.

Modifications and variations of the disclosed embodiments are possible without departing from the scope of the invention defined in the appended claims. For example, where specific dimensions are given, it will be understood that they are exemplary only and other dimensions are possible. As various changes could be made in the above constructions, products, and methods without departing from the scope of the invention, it is intended that all matter contained in the above description and shown in the accompanying drawings shall be interpreted as illustrative and not in a limiting sense.

Other Statements of Invention

The following are statements or features of invention described in the present disclosure. Some or all of the following statements may not be currently presented as claims. Nevertheless, the statements are believed to be patentable and may subsequently be presented as claims. Associated methods corresponding to the statements or apparatuses or systems below are also believed to be patentable and may subsequently be presented as claims. It is understood that the following statements may refer to and be supported by one, more than one, or all the embodiments described above.

A1. A shooting target thrower for throwing a shooting target, the shooting target thrower comprising: a frame; a throwing arm supported by the frame and rotatable about a throwing axis in a first direction, the throwing arm configured to throw the shooting target as the throwing arm rotates about the throwing axis in the first direction, the throwing arm including an engagement surface arranged to engage a side of the shooting target to impart force to the side of the shooting target to throw the shooting target from the throwing arm; a throwing spring operatively coupled to the throwing arm, the throwing spring configured to rotate the throwing arm in the first direction to throw the shooting target; a target feeder configured to feed the shooting target to the throwing arm; and a throwing arm stop arranged to engage the throwing arm to stop movement of the throwing arm about the throwing axis in the first direction before the engagement surface engages the side of the shooting target.

A2. The shooting target thrower of statement A1, wherein the throwing arm stop is arranged to stop movement of the throwing arm about the throwing axis in the first direction after the target feeder feeds the shooting target to the throwing arm to be thrown by the throwing arm.

A3. The shooting target thrower of statement A2, wherein the target feeder is configured to feed the shooting target to the throwing arm while the throwing arm is rotating about the throwing axis toward the throwing arm stop.

A4. The shooting target thrower of statement A3, wherein the target feeder includes a feed opening sized and shaped to permit the shooting target to move therethrough, the target feeder configured to feed the shooting target to the throwing arm as the throwing arm is rotating about the throwing axis in the first direction before the engagement surface becomes aligned with the feed opening.

A5. The shooting target thrower of statement A3, wherein the throwing arm includes a main bed and an extended bed projecting from the main bed, the extended bed being arranged to receive at least a portion of the shooting target when the shooting target is fed by the target feeder.

A6. The shooting target thrower of statement A1, wherein the throwing arm stop is movable relative to the throwing arm to disengage the throwing arm to release the throwing arm to rotate, under force of the throwing spring, in the first direction to throw the shooting target.

A7. The shooting target thrower of statement A6, wherein the engagement surface is arranged to engage the side of the shooting target after the throwing arm is released by the throwing arm stop.

A8. The shooting target thrower of statement A1, wherein the throwing arm includes a throwing strip comprising resiliently deformable material, the throwing strip defining the engagement surface.

A9. The shooting target thrower of statement A1, wherein the throwing arm includes a bumper arranged to engage the throwing arm stop, the bumper configured to cushion an impact between the throwing arm and the throwing arm stop.

A10. The shooting target thrower of statement A9, wherein the bumper comprises a resiliently deformable material.

All. The shooting target thrower of statement A10, wherein the bumper includes a resiliently deformable backing and a cover strip covering the backing, the cover strip being arranged to engage the throwing arm stop.

A12. The shooting target thrower of statement A1, wherein the throwing spring is configured to move over center to bias the throwing arm in the first direction before the throwing arm stop engages the throwing arm to stop movement of the throwing arm about the throwing axis in the first direction.

A13. The shooting target thrower of statement A12, wherein the target feeder is configured to feed the shooting target to the throwing arm before the throwing spring moves over center to bias the throwing arm in the first direction.

A14. The shooting target thrower of statement A1, wherein the throwing arm stop is configured to be in a travel path of the throwing arm to be impacted by the throwing arm to stop movement of the throwing arm in the first direction.

B1. A shooting target thrower for throwing a shooting target, the shooting target thrower comprising: a frame; a throwing arm supported by the frame and rotatable about a throwing axis, the throwing arm rotatable to a cocked position and a thrown position, the throwing arm configured to throw the shooting target as the throwing arm rotates about the throwing axis from the cocked position toward the thrown position; a throwing spring operatively coupled to the throwing arm, the throwing spring arranged to rotate the throwing arm from the cocked position toward the thrown position to throw the shooting target; a charge pedal movable through a charging cycle, the charge pedal movable in a charging stroke of the charging cycle to move the throwing arm toward the cocked position; a fire mode selector moveable between a fire position and a non-fire position to change between a fire mode in which the charge pedal is operable to release the throwing arm to rotate, under force of the throwing spring, from the cocked position toward the thrown position to throw the shooting target and a non-fire mode in which the charge pedal is not operable to release the throwing arm to rotate, under force of the throwing spring, from the cocked position toward the thrown position to throw the shooting target.

B2. The shooting target thrower of statement $B_1$, further comprising a fire pedal configured to release the throwing arm to rotate, under the force of the throwing spring, from the cocked position toward the thrown position to throw the shooting target.

B3. The shooting target thrower of statement B2, wherein the fire pedal is configured to release the throwing arm regardless of whether the fire mode selector is in the fire position or the non-fire position.

B4. The shooting target thrower of statement B3, wherein the fire mode selector is operatively coupled to the charge pedal.

B5. The shooting target thrower of statement B4, wherein the fire mode selector is supported by the charge pedal.

B6. The shooting target thrower of statement B5, wherein the fire mode selector is carried by the charge pedal.

B7. The shooting target thrower of statement of $B_1$, wherein the fire mode selector is pivotable between the fire and non-fire positions.

B8. The shooting target thrower of statement B1, further comprising a throwing arm stop arranged to engage the throwing arm when the throwing arm is in the cocked position to hold the throwing arm in the cocked position, the throwing arm stop being movable relative to the throwing arm to disengage the throwing arm to release the throwing arm to rotate, under the force of the throwing spring, from the cocked position toward the thrown position to throw the shooting target.

B9. The shooting target thrower of statement B8, further comprising an engagement surface operatively coupled to the fire mode selector, wherein the engagement surface is arranged to move the throwing arm stop relative to the throwing arm during the return stroke of the charge pedal to disengage the throwing arm to release the throwing arm to rotate when the fire mode selector is in the fire position, and wherein the engagement surface is arranged to not move the throwing arm stop relative to the throwing arm during the return stoke of the charge pedal to disengage the throwing arm to release the throwing arm to rotate when the fire mode selector is in the non-fire position.

B10. The shooting target thrower of statement B9, wherein the fire mode selector defines the engagement surface.

C1. A shooting target thrower for throwing a shooting target, the shooting target thrower comprising: a frame; a throwing arm supported by the frame and rotatable about a throwing axis, the throwing arm rotatable to a cocked position and a thrown position, the throwing arm configured to throw the shooting target as the throwing arm rotates about the throwing axis from the cocked position toward the thrown position; a throwing spring operatively coupled to the throwing arm, the throwing spring configured to rotate the throwing arm from the cocked position toward the thrown position to throw the shooting target, wherein a force imparted by the throwing spring to the throwing arm varies as the throwing arm rotates about the throwing axis; and a ratchet operatively coupled to the throwing arm and configured to permit the throwing arm to rotate in one direction about the throwing axis, the ratchet configured to hold the throwing arm in the thrown position after the throwing arm throws the shooting target, wherein a force imparted by the throwing spring on the throwing arm when the throwing arm is in the thrown position is greater than a lowest amount of force imparted by the throwing spring on the throwing arm.

C2. The shooting target thrower of statement C1, wherein the throwing spring comprises a tension spring with opposite first and second ends, the first and second ends being separated by a first distance when the throwing spring imparts the lowest amount of force, the first and second ends being separated by a second distance greater than the first distance when the throwing arm is in the thrown position.

C3. The shooting target thrower of statement C1, wherein, in the thrown position, the throwing arm is more than 3.14 radians about the throwing axis from the cocked position.

C4. The shooting target thrower of statement C3, wherein, in the thrown position, the throwing arm is within an inclusive range of about 3.9 radians to about 5.5 radians about the throwing axis from the cocked position.

C5. The shooting target thrower of statement C1, wherein the ratchet includes a ratchet wheel rotatable with the throwing arm, and the ratchet includes a first pawl engaged with the ratchet wheel and a second pawl engaged with the ratchet wheel.

C6. The shooting target thrower of statement C5, wherein the first pawl, the ratchet wheel, and the throwing arm are arranged to rotate in the one direction about the throwing axis to move the throwing arm toward the cocked position.

C7. The shooting target thrower of statement C6, wherein the second pawl operates independently of the first pawl to limit rotation of the ratchet wheel and is configured to inhibit the ratchet wheel from rotating in a direction about the throwing axis opposite said one direction.

C8. The shooting target thrower of statement C7, further comprising a pulley rotatable about the throwing axis, the first pawl being supported by the pulley and rotatable about the throwing axis with the pulley, and wherein the first pawl is movable with respect to the second pawl to change a distance between the first pawl and the second pawl when the first pawl is rotated about the throwing axis with the pulley.

C9. The shooting target thrower of statement C7, wherein the first pawl and the second pawl are each movable from a respective ratchet wheel engaged position to a respective ratchet wheel disengaged position to permit the throwing arm to rotate about the throwing axis without obstruction by the first pawl or the second pawl.

C10. The shooting target thrower of statement C2, wherein the ratchet comprises a ratchet actuator movable between a ratchet engaged position and a ratchet disengaged position to change the first and second holding pawls from the ratchet wheel engaged position to the ratchet wheel disengaged position.

D1. A shooting target thrower for throwing a shooting target of a plurality of shooting targets, the shooting target thrower comprising: a frame; a throwing arm supported by the frame and rotatable about a throwing axis in a first direction, the throwing arm rotatable to a cocked position, the throwing arm configured to throw the shooting target as the throwing arm rotates about the throwing axis in the first direction from the cocked position, the throwing arm including an engagement surface arranged to engage a side of the shooting target to impart force to the side of the shooting target to throw the shooting target from the throwing arm; a throwing spring operatively coupled to the throwing arm, the throwing spring configured to rotate the throwing arm in the first direction from the cocked position to throw the shooting target; a charge pedal operatively coupled to the throwing arm and configured to rotate the throwing arm toward the cocked position when the charge pedal is manually actuated by a user; a hopper configured to store the plurality of shooting targets; and a target feeder configured to feed the plurality of shooting targets to the throwing arm one at a time, the target feeder including a first brush segment and a second brush segment, the first brush segment arranged to bring the shooting target into engagement with the engagement surface of the throwing arm and the second brush segment arranged to set a radial distance of the shooting target from the throwing axis.

D2. The shooting target thrower of statement D1, wherein the first and second brush segments are movable with respect to one another.

D3. The shooting target thrower of statement D2, wherein the target feeder includes a movable feed door arranged to release the shooting target toward the throwing arm, the first brush segment coupled to and movable with the feed door.

D4. The shooting target thrower of statement D3, wherein the target feeder includes a movable feed foot for retaining the plurality of shooting targets, the second brush segment coupled to and movable with the feed foot.

D5. The shooting target thrower of statement D4, further comprising a central shaft defining and rotatable about the throwing axis, the throwing arm rotatable with the central shaft, the feed foot disposed adjacent a first end of the feed door and the central shaft disposed adjacent an opposite second end of the feed door.

D6. The shooting target thrower of statement D5, wherein the target feeder includes a rotatable feed cam that rotates responsive to rotation of the central shaft, the feed cam operatively connected to the feed door such that rotation of the feed cam moves the feed door between a first retaining position and a first release position, wherein the feed door is arranged to retain the shooting target in the first retaining position, and wherein the feed door is arranged to release the shooting target in the first release position.

D7. The shooting target thrower of statement D6, wherein the feed foot is operatively coupled to the feed door such that the feed foot moves between a second retaining position and a second release position responsive to movement of the feed door, wherein the feed foot is arranged to retain the plurality of shooting targets in the second retaining position, and wherein the feed foot is arranged to release the plurality of shooting targets in the second release position.

D8. The shooting target thrower of statement D7, wherein the feed foot is operatively coupled to the feed door such that the feed foot is disposed in the second retaining position when the feed door is disposed in the first release position and such that the feed foot is disposed in the second release position when the feed door is disposed in the first retaining position.

D9. The shooting target thrower of statement D8, wherein the feed door is arranged to move toward the central shaft as the feed door moves from the first retaining position toward the first release position.

D10. The shooting target thrower of statement D9, wherein the target feeder includes a first spring biasing the feed door toward the first release position and a second spring biasing the feed foot toward the second retaining position.

E1. A shooting target thrower for throwing a shooting target of a plurality of shooting targets, the shooting target thrower comprising: a frame; a central shaft supported by the frame, the central shaft defining and rotatable about a throwing axis; a throwing arm supported by the central shaft and rotatable with the central shaft about the throwing axis in a first direction, the throwing arm rotatable to a cocked position, the throwing arm configured to throw the shooting target as the throwing arm rotates about the throwing axis in the first direction from the cocked position; a throwing spring operatively coupled to the throwing arm, the throwing spring configured to rotate the throwing arm in the first direction from the cocked position to throw the shooting target; a hopper configured to store the plurality of shooting targets; and a target feeder configured to feed the plurality of shooting targets to the throwing arm one at a time, the target feeder including a movable feed door arranged to release the shooting target toward the throwing arm and a movable feed foot for retaining the plurality of shooting targets, the feed foot disposed adjacent a first end of the feed door and the central shaft disposed adjacent an opposite second end of the feed door.

What is claimed is:

1. A shooting target thrower for throwing a shooting target, the shooting target thrower comprising:

a frame;

a throwing arm supported by the frame and rotatable about a throwing axis in a first direction, the throwing arm configured to throw the shooting target as the throwing arm rotates about the throwing axis in the first direction, the throwing arm including an engagement surface arranged to engage a side of the shooting target to impart force to the side of the shooting target to throw the shooting target from the throwing arm;

a throwing spring operatively coupled to the throwing arm, the throwing spring configured to rotate the throwing arm in the first direction to throw the shooting target;

a target feeder configured to feed the shooting target to the throwing arm; and a throwing arm stop arranged to engage the throwing arm to stop movement of the throwing arm about the throwing axis in the first direction before the engagement surface engages the side of the shooting target.

2. The shooting target thrower of claim 1, wherein the throwing arm stop is arranged to stop movement of the throwing arm about the throwing axis in the first direction after the target feeder feeds the shooting target to the throwing arm to be thrown by the throwing arm.

3. The shooting target thrower of claim 2, wherein the target feeder is configured to feed the shooting target to the throwing arm while the throwing arm is rotating about the throwing axis toward the throwing arm stop.

4. The shooting target thrower of claim 3, wherein the target feeder includes a feed opening sized and shaped to permit the shooting target to move therethrough, the target feeder configured to feed the shooting target to the throwing arm as the throwing arm is rotating about the throwing axis in the first direction before the engagement surface becomes aligned with the feed opening.

5. The shooting target thrower of claim 3, wherein the throwing arm includes a main bed and an extended bed projecting from the main bed, the extended bed being arranged to receive at least a portion of the shooting target when the shooting target is fed by the target feeder.

6. The shooting target thrower of claim 1, wherein the throwing arm stop is movable relative to the throwing arm to disengage the throwing arm to release the throwing arm to rotate, under force of the throwing spring, in the first direction to throw the shooting target.

7. The shooting target thrower of claim 6, wherein the engagement surface is arranged to engage the side of the shooting target after the throwing arm is released by the throwing arm stop.

8. The shooting target thrower of claim 1, wherein the throwing arm includes a throwing strip comprising resiliently deformable material, the throwing strip defining the engagement surface.

9. The shooting target thrower of claim 1, wherein the throwing arm includes a bumper arranged to engage the throwing arm stop, the bumper arranged to cushion an impact between the throwing arm and the throwing arm stop.

10. The shooting target thrower of claim 9, wherein the bumper comprises a resiliently deformable material.

11. The shooting target thrower of claim 10, wherein the bumper includes a resiliently deformable backing and a cover strip covering the backing, the cover strip being arranged to engage the throwing arm stop.

12. The shooting target thrower of claim 11, wherein the throwing spring is configured to move over center to bias the throwing arm in the first direction before the throwing arm stop engages the throwing arm to stop movement of the throwing arm about the throwing axis in the first direction.

13. The shooting target thrower of claim 12, wherein the target feeder is configured to feed the shooting target to the throwing arm before the throwing spring moves over center to bias the throwing arm in the first direction.

14. The shooting target thrower of claim 1, wherein the throwing arm stop is arranged to be in a travel path of the throwing arm to be impacted by the throwing arm to stop movement of the throwing arm in the first direction.

* * * * *